US010718084B2

(12) United States Patent
Kitagawa

(10) Patent No.: US 10,718,084 B2
(45) Date of Patent: Jul. 21, 2020

(54) PROCESSING APPARATUS FOR PROCESSING SUBJECT

(71) Applicants: Seven Dreamers Laboratories, Inc., Tokyo (JP); Panasonic Corporation, Osaka (JP); Daiwa House Industry Co., Ltd., Osaka (JP)

(72) Inventor: Hiroshi Kitagawa, Tokyo (JP)

(73) Assignees: Seven Dreamers Laboratories, Inc., Tokyo (JP); Panasonic Corporation, Osaka (JP); Daiwa House Industry Co., Ltd., Osaka (JP)

( * ) Notice: Subject to any disclaimer, the term of this patent is extended or adjusted under 35 U.S.C. 154(b) by 630 days.

(21) Appl. No.: 15/321,240

(22) PCT Filed: May 29, 2015

(86) PCT No.: PCT/JP2015/065514
§ 371 (c)(1),
(2) Date: Dec. 22, 2016

(87) PCT Pub. No.: WO2015/198791
PCT Pub. Date: Dec. 30, 2015

(65) Prior Publication Data

US 2017/0159232 A1 Jun. 8, 2017

(30) Foreign Application Priority Data

Jun. 24, 2014 (JP) ..... 2014-129281

(51) Int. Cl.
*D06F 89/02* (2006.01)
*D06F 89/00* (2006.01)
*A41H 33/00* (2006.01)

(52) U.S. Cl.
CPC ..... *D06F 89/02* (2013.01); *A41H 33/00* (2013.01); *D06F 89/00* (2013.01); *D06F 89/023* (2013.01)

(58) Field of Classification Search
CPC ..... D06F 89/00; D06F 89/02; D06F 89/023
(Continued)

(56) References Cited

U.S. PATENT DOCUMENTS 3,148,807 A 9/1964 Freeman
2012/0196734 A1* 8/2012 Endo ..... D06F 89/02 493/405

(Continued)

FOREIGN PATENT DOCUMENTS

DE 3825332 2/1989
JP 49-47690 5/1974

(Continued)

OTHER PUBLICATIONS

International Patent Application No. PCT/JP2015/065514, International Search Report and Written Opinion, dated Aug. 11, 2015, 11 pages.

*Primary Examiner* — Nathan E Durham
(74) *Attorney, Agent, or Firm* — Morgan, Lewis & Bockius LLP

(57) ABSTRACT

An object of the present invention is to provide a more compact processing apparatus than previously available. Provided is a processing apparatus for unfurling or folding a processing subject (T), including a pair of retaining devices (310A, 310B) capable of retaining the processing subject (T), a carrying device (402) capable of carrying the processing subject (T) such that a part of the processing subject (T) hangs down therefrom while the processing subject (T) is retained by at least one of the pair of retaining devices (310A, 310B), and a control device that controls movement of the retaining devices (310A, 310B) and the (Continued)

carrying device (402), wherein the control device rotates the carrying device (402) in a condition where the retained processing subject (T) hangs down from the carrying device (402).

11 Claims, 50 Drawing Sheets

(58) Field of Classification Search
USPC ..... 223/37
See application file for complete search history.

(56) References Cited

U.S. PATENT DOCUMENTS

| | | | | |
|---|---|---|---|---|
| 2012/0228340 | A1* | 9/2012 | Sakane | D06F 89/02 223/37 |
| 2017/0356124 | A1* | 12/2017 | Ozeki | D06F 33/02 |

FOREIGN PATENT DOCUMENTS

| | | |
|---|---|---|
| JP | 2000-024400 | 1/2000 |
| JP | 2011-115207 | 6/2011 |
| JP | 2013226408 | 11/2013 |
| WO | 2012/073500 | 6/2012 |

* cited by examiner (y)

(a)

(b)

(a)

(b)

(c)

(d)

(g)

(h)

(k)

(f)

(g)

PROCESSING APPARATUS FOR PROCESSING SUBJECT

CROSS-REFERENCE TO RELATED APPLICATIONS

This application is a U.S. National Phase Application under 35 U.S.C. 371 of International Application No. PCT/JP2015/065514, filed May 29, 2015, which claims priority to Japanese application No. 2014-129281 filed Jun. 24, 2014, all of which are incorporated herein by reference in their entireties.

TECHNICAL FIELD

The present invention relates to a processing apparatus for processing a processing subject such as a deformable thin object.

BACKGROUND ART

An apparatus for unfurling and folding a deformable thin object such as a garment has been developed in the prior art (see Patent Document 1, for example).

CITATION LIST

Patent Document

Patent Document 1: WO 2012/073500

SUMMARY

Technical Problem

Incidentally, this type of processing apparatus generally has large dimensions, and although the apparatus can be used for industrial applications, it cannot easily be disposed in a typical household.

Solution to Problem

An object of the present invention is to provide a more compact processing apparatus than previously available.

(1) A processing apparatus according to one aspect of the present invention includes a pair of retaining devices, at least one of which includes a movable retaining mechanism, and a carrying device that includes a carrying plate provided to be capable of carrying a processing subject and rotating.

According to the present invention, a more compact processing apparatus can be provided in a case where the processing apparatus is used to process the processing subject. More specifically, when the processing subject is retained by the pair of retaining devices and moved from a first side to a second side of the carrying plate during processing performed by the processing apparatus to recognize, fold, or otherwise process the processing subject, the carrying plate can be rotated in the direction in which the processing subject is to be moved. Hence, the processing subject can be moved to a desired side without lifting the entire processing subject above the carrying plate or moving the processing subject by a large amount in a horizontal direction. Therefore, a space in which the retaining devices move can be reduced, and as a result, the overall size of the processing apparatus can be made more compact.

Note that the "processing subject" is a deformable thin object represented by a textile such as a garment or a towel, a film, a piece of paper, a sheet, or the like, for example, and the processing subject may have a rectangular shape such as that of a towel, or a substantially rectangular shape such as that of a T-shirt or a running shirt.

Further, the "retaining mechanism" may have any configuration capable of retaining the processing subject. For example, the retaining mechanism includes a pair of finger members, and the pair of finger members are configured to approach and move away from each other. A hook onto which the processing subject is hooked may be cited as another example of the retaining mechanism.

Furthermore, the moving mechanism that enables the retaining mechanism to move may be a belt slider mechanism, a ball screw mechanism, an air cylinder mechanism, a motor cylinder mechanism, an electric slider mechanism, a linear slider mechanism, a rack and pinion mechanism, and so on. Note that these mechanisms are mainly constituted by a driving force source, a feed member, and a guide member. A belt slider mechanism is a slide moving mechanism that has a motor as the driving force source, a belt or a wire as the feed member, and an LM guide member or the like as the guide member, and causes a movement subject to slide along the LM guide member or other guide member by transmitting rotation of the motor to the belt or wire. Further, a ball screw mechanism is a slide moving mechanism that has a motor as the driving force source, a ball screw or a trapezoidal screw as the feed member, and an LM guide member or the like as the guide member, and causes a movement subject to slide along the LM guide member or other guide member by transmitting the rotation of the motor to the ball screw or trapezoidal screw. Furthermore, an air cylinder mechanism is a slide moving mechanism that has an air compressor as the driving force source and a piston rod that doubles as the feed member and the guide member, and causes a movement subject attached to the piston rod to slide using a linear motion of the piston rod. Further, a motor cylinder mechanism is a slide moving mechanism that has a motor as the driving force source and a piston rod that doubles as the feed member and the guide member, and causes a movement subject attached to the piston rod to slide by transmitting the rotation of the motor to the ball screw. An electric slider mechanism is a slide moving mechanism that has a motor as the driving force source, a ball screw or the like as the feed member, and an LM guide member or the like as the guide member, and causes a movement subject to slide along the LM guide member or other guide member by transmitting the rotation of the motor to the ball screw. Moreover, a linear slider mechanism is a slide moving mechanism that has a magnet as the driving force source, another magnet as the feed member, and an LM guide member or the like as the guide member, and causes a movement subject to slide using the principles of a linear motor. Furthermore, a rack and pinion mechanism is a slide moving mechanism that has a motor as the driving force source, a rack and pinion as the feed member, and an LM guide member or the like as the guide member, and causes a movement subject attached to the rack to slide along the LM guide member or other guide member by rotating the pinion using the rotation of the motor.

(2) The processing apparatus according to (1) further includes an imaging device that photographs the processing subject in order to obtain image data relating to the processing subject, and a control device that recognizes the type of the processing subject on the basis of the image data.

Hence, with this processing apparatus, the type of the processing subject can be recognized, and processing corresponding to the type of the processing subject can be performed.

(3) The processing apparatus according to (2) further includes an infrared light source that emits infrared rays onto the processing subject, wherein the imaging device obtains the image data relating to the processing subject via an infrared filter.

For example, when an attempt is made to recognize a processing subject having black parts on the surface thereof (a striped sweatshirt having black stripes, for example), the black parts may merge with the background such that the processing subject is recognized as being divided into separate pieces by the black parts, despite being an integral processing subject. With this processing apparatus, however, the image data relating to the processing subject are obtained via the infrared filter, and therefore image data on which the entire processing subject, including the black parts on the surface thereof, appears whitish can be obtained. Note that the background remains black. As a result, the black parts of the processing subject do not merge with the background, and therefore a processing subject having black parts on the surface thereof can be recognized correctly.

(4) In the processing apparatus according to any one of (1) to (3), the retaining devices and a carrying device fold the processing subject cooperatively.

With this processing apparatus, therefore, the processing subject can be folded.

(5) A folding system according to another aspect of the present invention includes a pair of retaining devices, at least one of which includes a movable retaining mechanism, a carrying device that includes a freely rotating carrying plate provided to be capable of carrying the processing subject such that a part of the processing subject hangs down therefrom, a clamping mechanism that moves relative to the carrying device and includes a pair of clamping members for clamping the carrying plate, and a control device. The control device performs Control A for controlling the carrying device and the retaining devices to align a first fold line of the processing subject with a first edge line of the carrying plate in a condition where the carrying plate is set at a predetermined angle from a horizontal condition, Control B for controlling the retaining devices to lift the processing subject up from the carrying plate while keeping the processing subject folded about the first fold line, Control C for controlling the carrying device and the retaining devices to place the processing subject folded about the first fold line on the surface of the carrying plate such that a central part of the processing subject on a center side of the first fold line overlaps a first end part on an end side of the first fold line, a second fold line of the processing subject is aligned with a second edge line of the carrying plate, and a second end part of the processing subject on an end side of the second fold line hangs down from the carrying plate, and Control D for controlling the carrying device and the clamping device to move relative to each other so that the second edge line of the carrying plate and the clamping device approach each other, clamp the carrying plate between the pair of clamping members, and then move the carrying plate away from the clamping device.

Hence, according to this aspect, when the processing subject is moved from a first side to a second side of the carrying plate while being retained by the pair of retaining devices in a case where the processing subject is "folded in three" about the first fold line and the second fold line thereof, the carrying plate can be rotated in the direction in which the processing subject is to be moved. Therefore, the processing subject can be moved to the desired side without lifting the entire processing subject above the carrying plate or moving the entire processing subject by a large amount in the horizontal direction. Accordingly, the space in which the retaining devices move can be reduced, and as a result, the overall size of the processing apparatus can be made more compact.

(6) An end point detection system according to a further aspect of the present invention includes a pair of retaining devices, at least one of which includes a movable retaining mechanism, a carrying device that includes a freely rotating carrying plate provided to be capable of carrying the processing subject, an imaging device that photographs the processing subject in order to obtain image data relating to the processing subject, and a control device. The control device includes an end point detection unit that detects an end point of the processing subject on the basis of the image data, and in order to obtain the image data used to detect the end point of the processing subject, the carrying plate is rotated toward the retaining devices before the retaining devices lower the processing subject.

Hence, according to this aspect, when the processing subject is moved from a first side to a second side of the carrying plate while being retained by the pair of retaining devices in order to detect the end point of the processing subject, the carrying plate can be rotated in the direction in which the processing subject is to be moved. Therefore, the processing subject can be moved to the desired side without lifting the entire processing subject above the carrying plate or moving the entire processing subject by a large amount in the horizontal direction. Accordingly, the space in which the retaining devices move can be reduced, and as a result, the overall size of the processing apparatus can be made more compact.

(7) A retaining mechanism according to a further aspect of the present invention includes a pair of finger members that approach and move away from each other, and a pair of gripping members that are attached respectively to the finger members to be capable of rotating, and grip the processing subject.

Hence, according to this aspect, when a part of the processing subject is retained by the pair of finger members while the finger members are oriented upward and then the finger members are oriented downward while continuing to retain the part of the processing subject, for example, the angles of the gripping members relative to the processing subject do not vary as the finger members rotate, but the angles of the gripping members relative to the finger members vary. In other words, when the finger members are oriented downward, the gripping members are rotated by the weight of the processing subject so that the processing subject hangs down from the finger members. As a result, the processing subject is less likely to become entangled on the tip end portions of the finger members. When the gripping members are not provided, the processing subject can only be disentangled by executing control to place the processing subject back on the carrying plate or the like temporarily, or by providing a more complicated mechanism than the finger members.

DESCRIPTION OF EMBODIMENTS

[Overall Configuration of Processing Apparatus]

Figure 1:
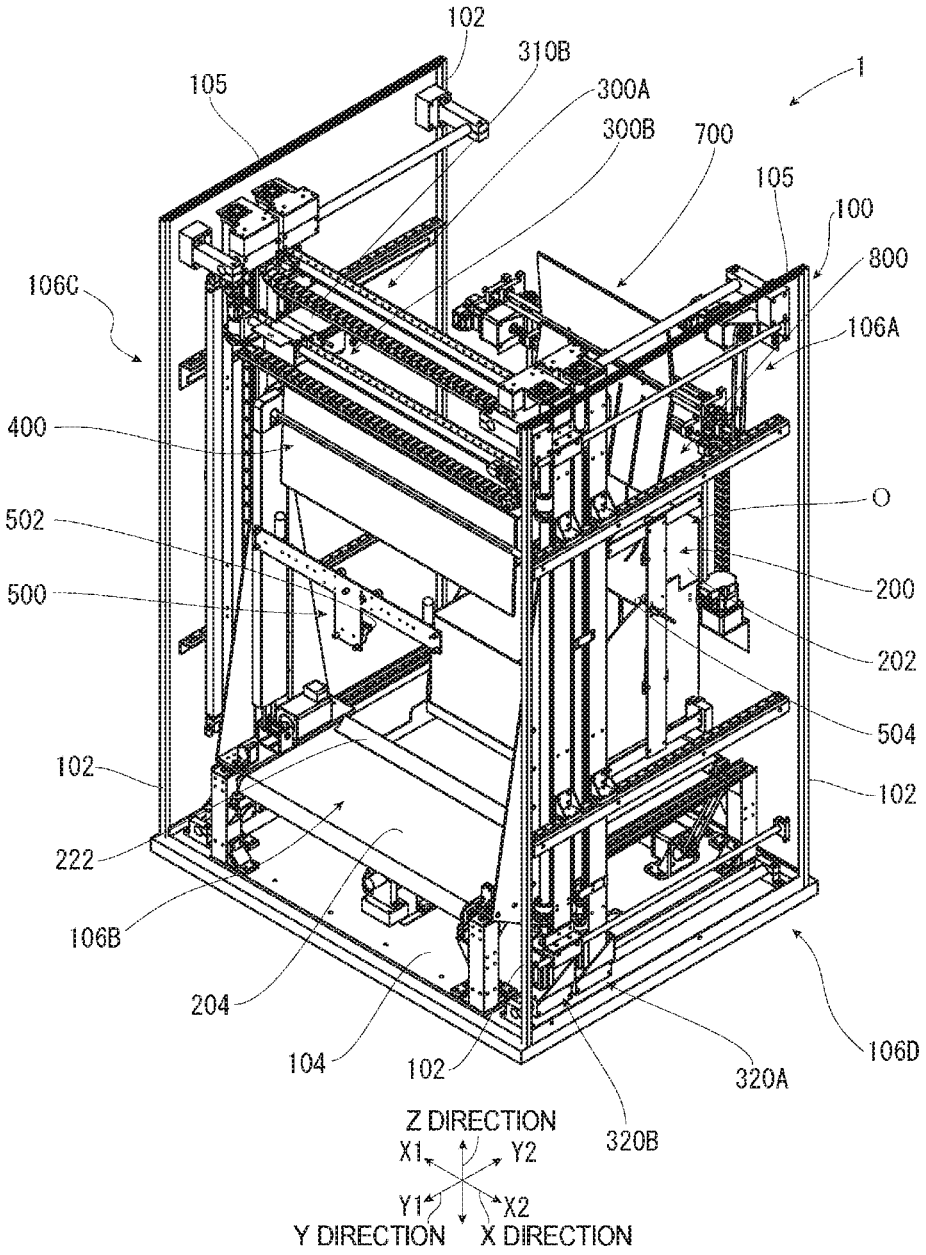
FIG. 1 is a perspective view showing a processing apparatus according to an embodiment of the present invention.
Figure 10:
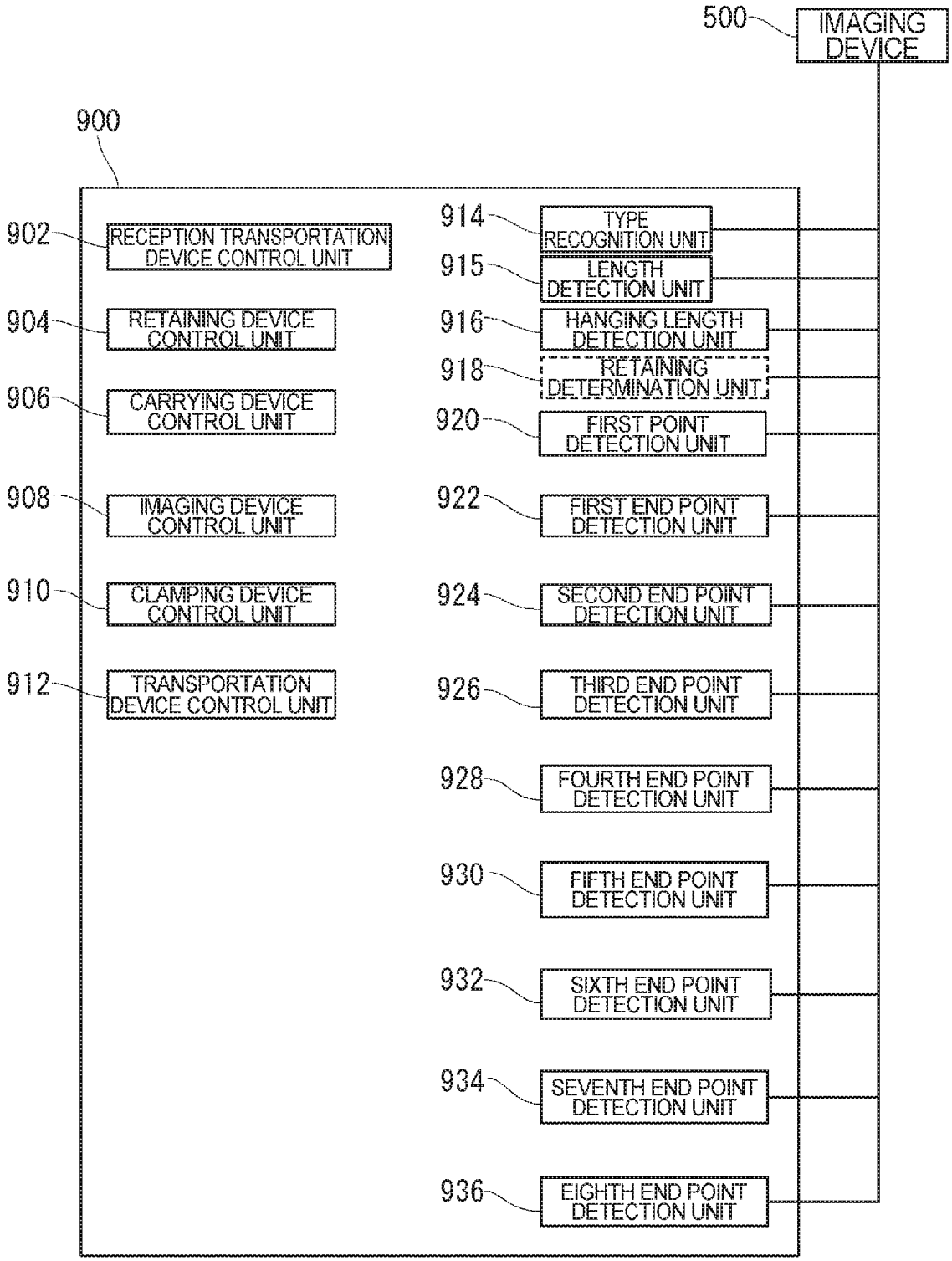
FIG. 10 is a function block diagram showing a control device of the processing apparatus according to this embodiment of the present invention.

A processing apparatus 1 according to this embodiment is an apparatus for retaining, recognizing, folding, and transporting a processing subject T constituted by a deformable thin object. As shown in FIG. 1, the processing apparatus 1 mainly includes a frame 100, a reception transportation device 200, retaining devices 300A, 300B, a carrying device 400, an imaging device 500, a clamping device 700, a transportation device 800, and a control device 900 (FIG. 10).

Note that the processing subject T is a deformable thin object represented by a textile such as a garment or a towel, a film, a piece of paper, a sheet, or the like, for example, and the processing subject may have a rectangular shape such as that of a towel, or a substantially rectangular shape such as that of a T-shirt or a running shirt.

[Frame 100]

The frame 100 is constituted by four frame pieces 102, and a frame base 104 provided on the bottom of the frame pieces 102. Further, respective upper ends of the frame pieces 102 that are adjacent to each other in a front-rear direction (the direction of an arrow Y) are connected by lateral frame pieces 105. Furthermore, wall surfaces are provided respectively between the frame pieces 102. As a result, an enclosed internal space is formed in the processing apparatus 1. Note that in the following description, a wall surface to which a door main body 210 is attached will be referred to as a front surface 106A, a wall surface opposing the front surface 106A will be referred to as a back surface 106B, a right side wall surface will be referred to as a right side surface 106C, and a left side wall surface will be referred to as a left side surface 106D.

[Reception Transportation Device 200]

Figure 2:
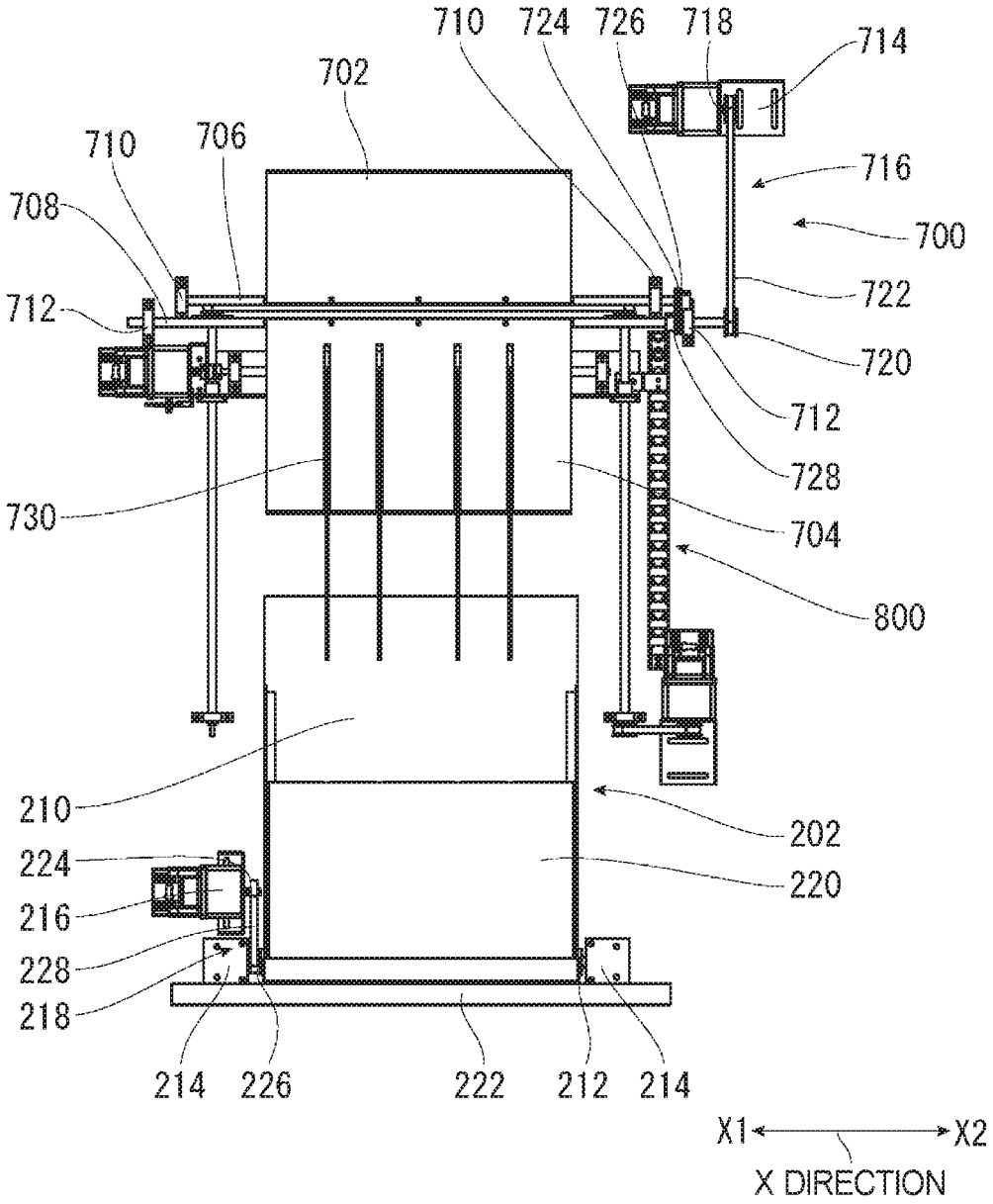
FIG. 2 is a view showing a front surface of the processing apparatus according to this embodiment of the present invention from the inside, and illustrating a reception transportation device, a clamping device, and a transportation device of the processing apparatus.
Figure 3:
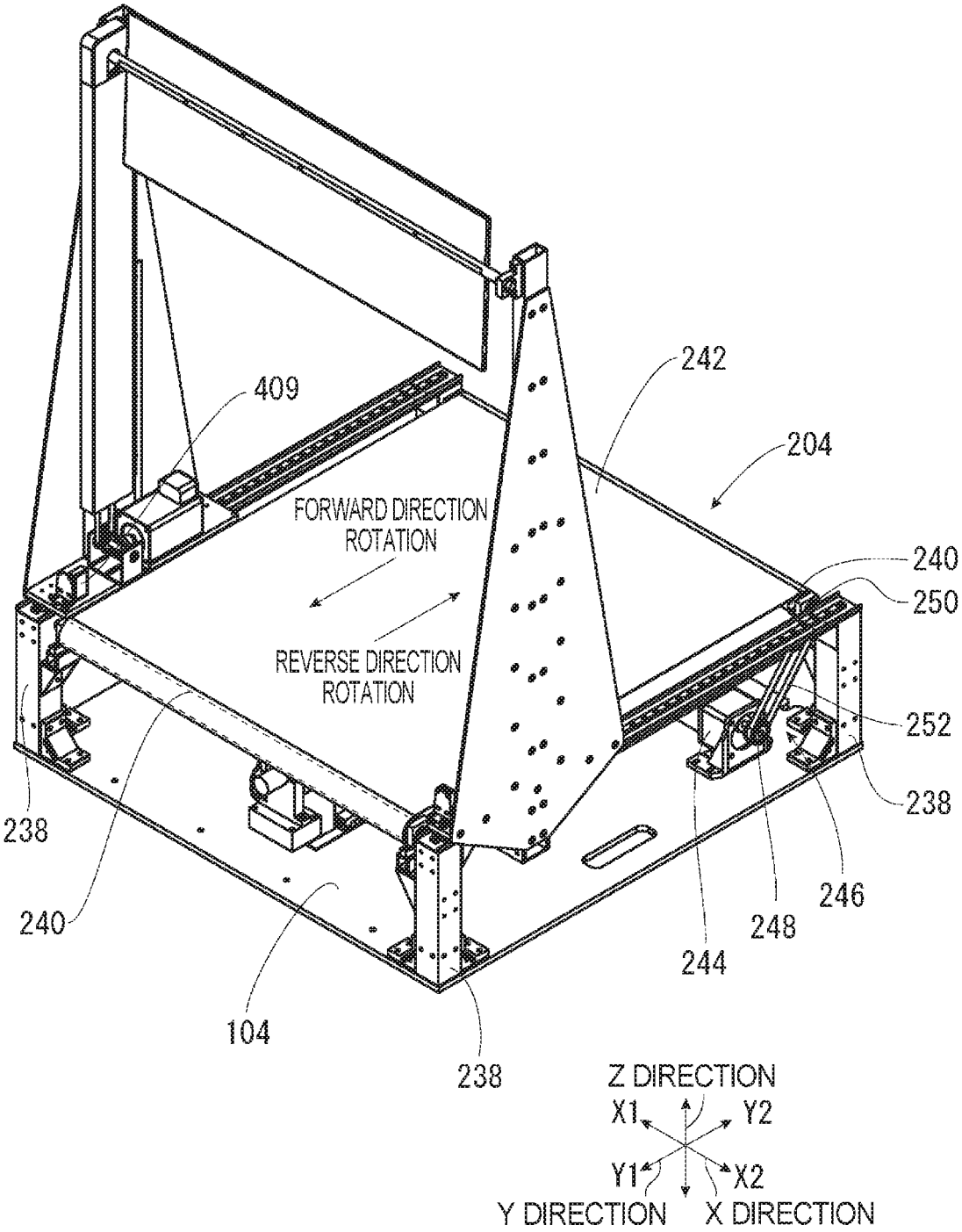
FIG. 3 is a perspective view showing the reception transportation device of the processing apparatus according to this embodiment of the present invention.
Figure 4:
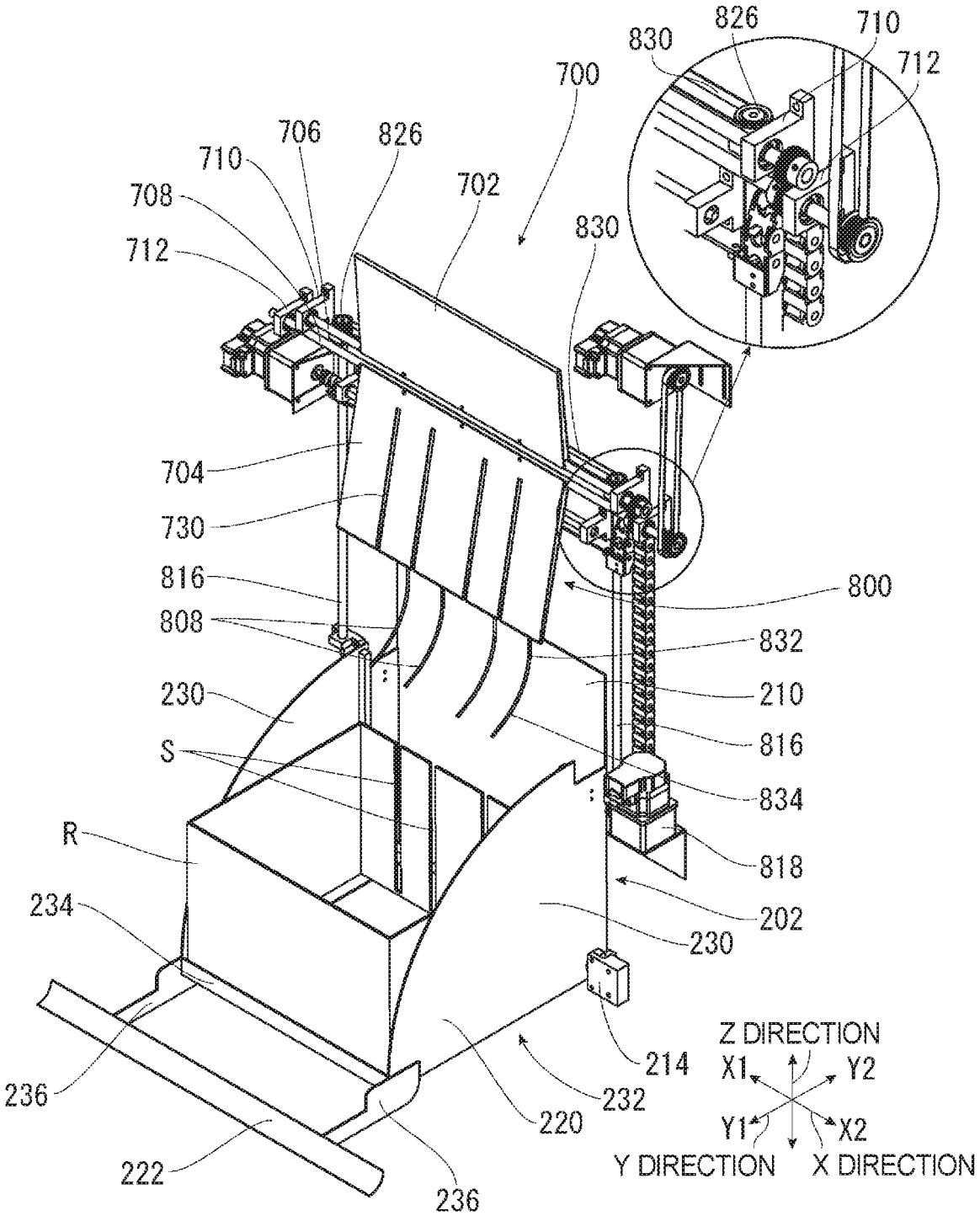
FIG. 4 is a perspective view showing the reception transportation device, the clamping device, and the transportation device of the processing apparatus according to this embodiment of the present invention.

The reception transportation device 200 is a device for receiving the processing subject T from the outside, and as shown in FIGS. 2 to 4, includes a door 202 (FIG. 2) and a transportation conveyor 204 (FIG. 3). The reception transportation device 200 is connected communicably to the control device 900, to be described below, either by wire or wirelessly. The control device 900 controls an operation of the transportation conveyor 204.

The door 202 is disposed in a position slightly below the center of the front surface 106A of the processing apparatus 1 so as to be easily accessible to a user. As shown in FIG. 2, the door 202 includes the door main body 210, a door shaft 212, a pair of door shaft retaining members 214, a door opening/closing motor 216, door opening/closing motor power transmitting means 218, a processing subject reception member 220, and a barrier member 222.

The door main body 210 is a rectangular plate used to open and close an opening portion O (FIG. 1) formed in the front surface 106A of the processing apparatus 1. The door shaft 212 is attached to a lower end portion of the door main body 210 such that a rotary axis thereof extends in a width direction (the direction of an arrow X).

The pair of door shaft retaining members 214 retain respective end portions of the door shaft 212 so that the door shaft 212 is free to rotate. Further, the respective door shaft retaining members 214 are attached to a rear side of the front surface 106A.

The door opening/closing motor 216 is capable of rotating normally and in reverse, and is attached to a rear surface of the front surface 106A in the vicinity of the opening portion O.

The door opening/closing motor power transmitting means 218 is constituted by a drive side pulley 224, a driven side pulley 226, and a belt 228. The drive side pulley 224 is attached to an output shaft end of the door opening/closing motor 216. The driven side pulley 226 is attached to the door shaft 212 in the vicinity of the door opening/closing motor 216. The belt 228 is wound around the drive side pulley 224 and the driven side pulley 226.

By means of this configuration, rotary force from the door opening/closing motor 216 is transmitted to the door shaft 212 via the door opening/closing motor power transmitting means 218. When the door shaft 212 rotates about the rotary axis, the door main body 210 rotates about the door shaft 212. The opening portion O is opened and closed by rotating the door main body 210.

As shown in FIG. 4, the processing subject reception member 220 is constituted by a pair of side surface plates 230, a bottom surface plate 232, and a back surface plate 234. The processing subject reception member 220 is attached to an inner surface of the door main body 210. By attaching the processing subject reception member 220 to the door main body 210, a space for receiving the processed processing subject T is formed on the rear side of the door main body 210. A processing subject reception box R is disposed in this space. A basket may be used instead of the processing subject reception box R, or the processed processing subject T may be carried directly on the bottom surface plate 232.

The barrier member 222 is an elongated member that extends in the width direction (the direction of the arrow X) and has an arc-shaped cross-section. A height of the barrier member 222 (in the direction of an arrow Z) may be set as desired, but is preferably set to be approximately equal to or slightly larger than a diameter (10 to 20 mm, for example) of a substantially disc-shaped gripping member 328 (see FIG. 6) of the retaining mechanism 322, for example. By setting the height in this manner, the processing subject can be gripped by the entire surface of the gripping member 328 of the retaining mechanism 322 when lifted onto the barrier member 222.

Further, one end of each of the pair of support members 236 is connected to a back surface (a convex surface opposing the door main body 210) of the barrier member 222. The other ends of the support members 236 are connected to respective lower end portions of the side surface plates 230 forming the processing subject reception member 220. As a result, the barrier member 222 is disposed substantially parallel to the door main body 210 in a more deep-set position than the processing subject reception member 220.

As shown in FIG. 3, the transportation conveyor 204 is disposed directly beneath the processing subject reception member 220 when the door main body 210 is closed. The transportation conveyor 204 includes four support frames 238 standing substantially vertically upright from the frame base 104, a pair of rollers 240, a conveyor belt 242, a conveyor drive motor 244, and conveyor drive motor power transmitting means 246.

The pair of rollers 240 are suspended rotatably between respective pairs of the support frames 238 such that respective rotary axes thereof extend in the width direction (the direction of the arrow X). Further, a height direction position of each roller 240 is set such that a line linking respective upper ends of the surfaces of the two rollers 240 is separated from a lower end of the barrier member 222 when the door main body 210 is closed by a slightly larger amount than a thickness of the conveyor belt 242. Hence, when the door main body 210 is closed, the lower end of the barrier member 222 is positioned in the vicinity of an upper surface of the conveyor belt 242. The conveyor belt 242 is wound around the pair of rollers 240.

The conveyor drive motor 244 is capable of rotating normally and in reverse, and as shown in FIG. 3, is attached to an upper surface of the frame base 104. The conveyor drive motor power transmitting means 246 is constituted by a drive side pulley 248, a driven side pulley 250, and a belt 252. The drive side pulley 248 is attached to an output shaft end of the conveyor drive motor 244. The driven side pulley 250 is attached to one of the rollers 240. The belt 252 is wound around the drive side pulley 248 and the driven side pulley 250.

By means of this configuration, rotary force from the conveyor drive motor 244 is transmitted to one of the rollers 240 (the roller 240 disposed directly beneath the door 202) via the conveyor drive motor power transmitting means 246. When this roller 240 rotates, the conveyor belt 242 rotates in the same direction. As will be described below, the rotation direction (a forward direction or a reverse direction) of the conveyor drive motor 244 is controlled by the control device 900. Note that in this specification, rotation by which the conveyor belt 242 moves away from the door main body 210 will be referred to as "forward direction rotation", and rotation by which the conveyor belt 242 approaches the door main body 210 will be referred to as "reverse direction rotation".

[Retaining Device 300]

The retaining device 300 retains and lifts up the processing subject T carried on the transportation conveyor 204 of the reception transportation device 200, and performs operations to recognize and fold the processing subject T cooperatively with the carrying device 400. (A retaining system for retaining the processing subject T is constituted by at least the transportation conveyor 204 and barrier member 222 described above, and the retaining device 300.) As shown in FIG. 1, the processing apparatus 1 includes the pair of retaining devices 300A, 300B, which respectively include retaining mechanisms 310A, 310B and moving mechanisms 320A, 320B. Note that the pair of retaining mechanisms 300A, 300B are disposed side by side in the front-rear direction (the direction of the arrow Y). In the following description, the two retaining devices and constituent elements thereof will be differentiated by attaching a suffix "A" to the retaining device and constituent elements thereof that are closer to the door 202 and attaching a suffix "B" to the retaining device and constituent elements thereof that are further from the door 202.

The retaining device 300B will now be described using FIG. 5. Note that the retaining device 300A is configured basically identically to the retaining device 300B, and can be described by replacing the reference symbol "B" of the retaining device 300A with the reference symbol "A". Accordingly, description thereof has been omitted.

The retaining mechanism 310B retains a part of the processing subject T. Further, the moving mechanism 320B moves the retaining mechanism 310B. The retaining device 300B is connected communicably to the control device 900, to be described below, either by wire or wirelessly. Operations of the retaining mechanism 3106 and the moving mechanism 320B are controlled by the control device 900.

A gripping mechanism that actively grips the processing subject T or a hooking mechanism that simply hooks the processing subject T may be used as the retaining mechanism 310B. In the processing apparatus 1 according to this embodiment, a gripping mechanism is used in the retaining device 300B as the retaining mechanism 310B, and therefore a case in which the retaining mechanism is a gripping mechanism will be described below.

Figure 6:
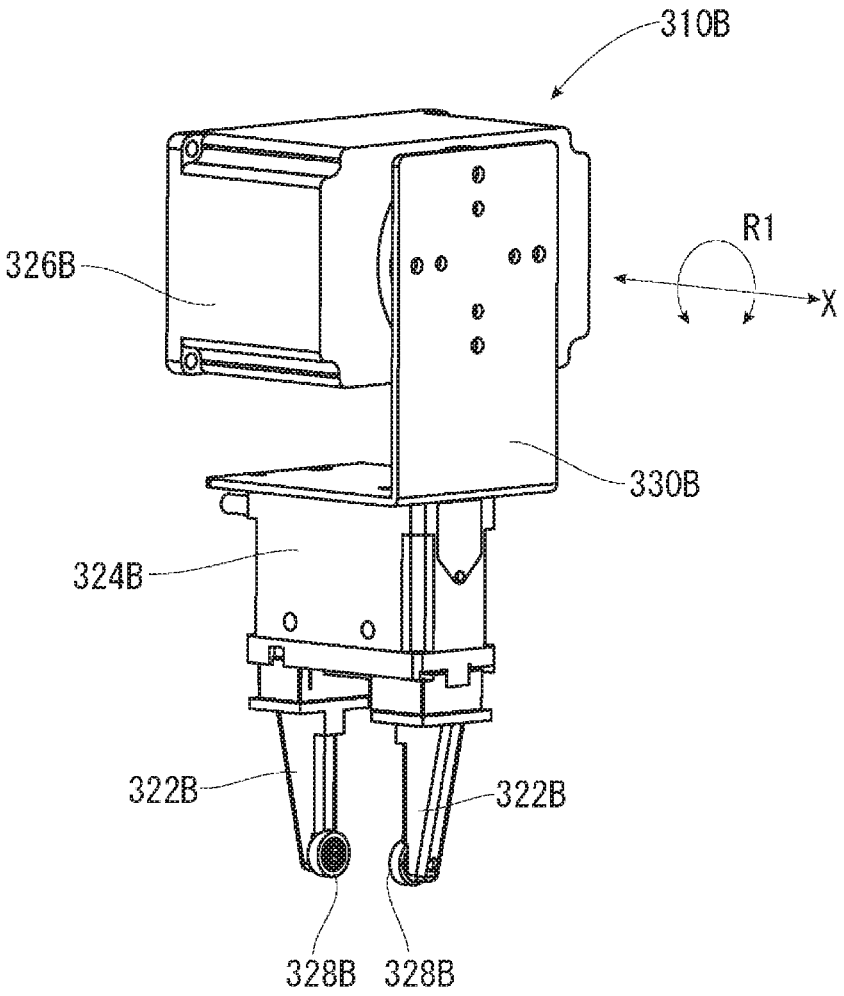
FIG. 6 is a perspective view showing a retaining mechanism according to this embodiment of the present invention.
Figure 7:
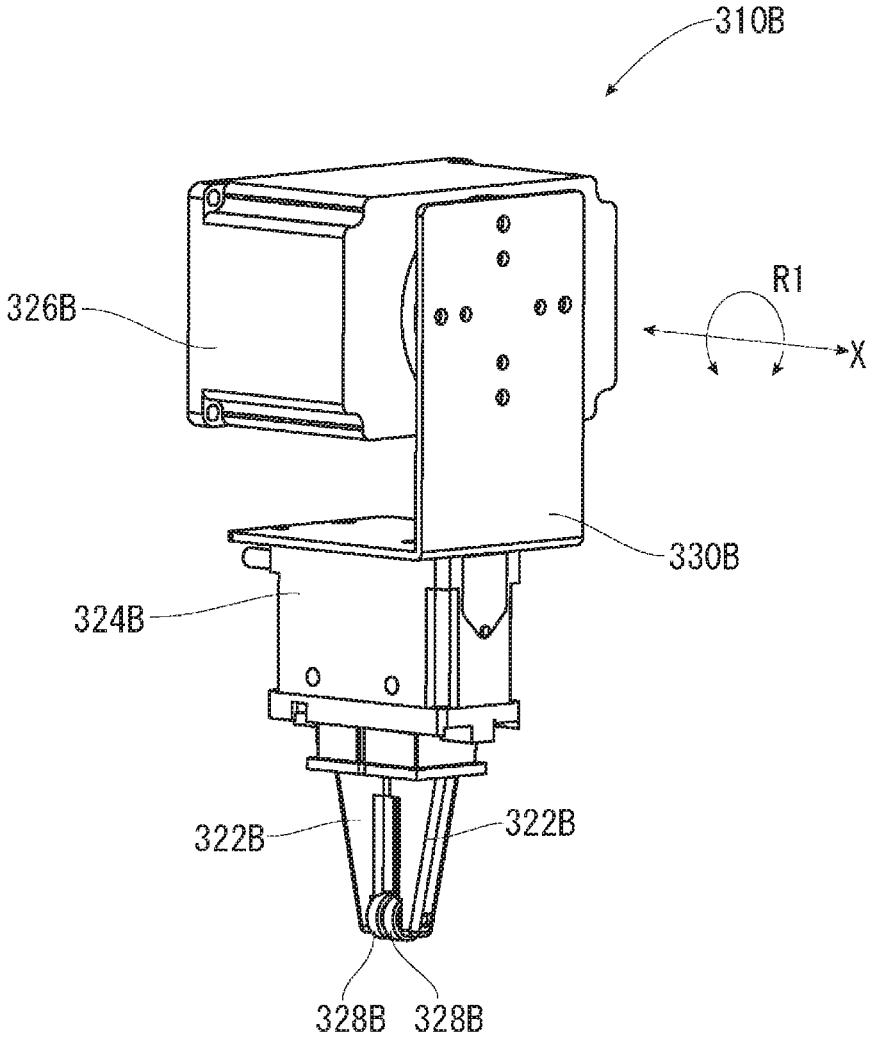
FIG. 7 is a perspective view showing the retaining mechanism according to this embodiment of the present invention.

As shown in FIGS. 6 and 7, the retaining mechanism 310B includes a pair of finger members 322B, a linear actuator 324B, and a rotary actuator 326B. Note that FIG. 6 shows a condition in which the pair of finger members 322B are separated from each other, while FIG. 7 shows a condition in which the pair of finger members 322B are in contact with each other. Further, a substantially disc-shaped gripping member 328B is attached to a tip end portion of each finger member 322B to be free to rotate. Furthermore, the linear actuator 324B is connected to the rotary actuator 326B via a connecting plate 330B having an L-shaped cross-section.

The pair of finger members 322B serve to grip the processing subject T. More specifically, the gripping members 328B attached to the respective tip end portions of the finger members 322B grip the processing subject T by directly contacting the processing subject T.

The linear actuator 324B causes the pair of finger members 322B to approach or move away from each other. In this embodiment, one of the finger members 322B is fixed to the linear actuator 324B, and the other finger member 322B moves in response to an operation of the linear actuator 324B.

The rotary actuator 326B rotates the linear actuator 324B in the direction of an arrow R1 via the connecting plate 330B with the horizontal direction (the direction of the arrow X) serving as a rotary axis.

Figure 5:
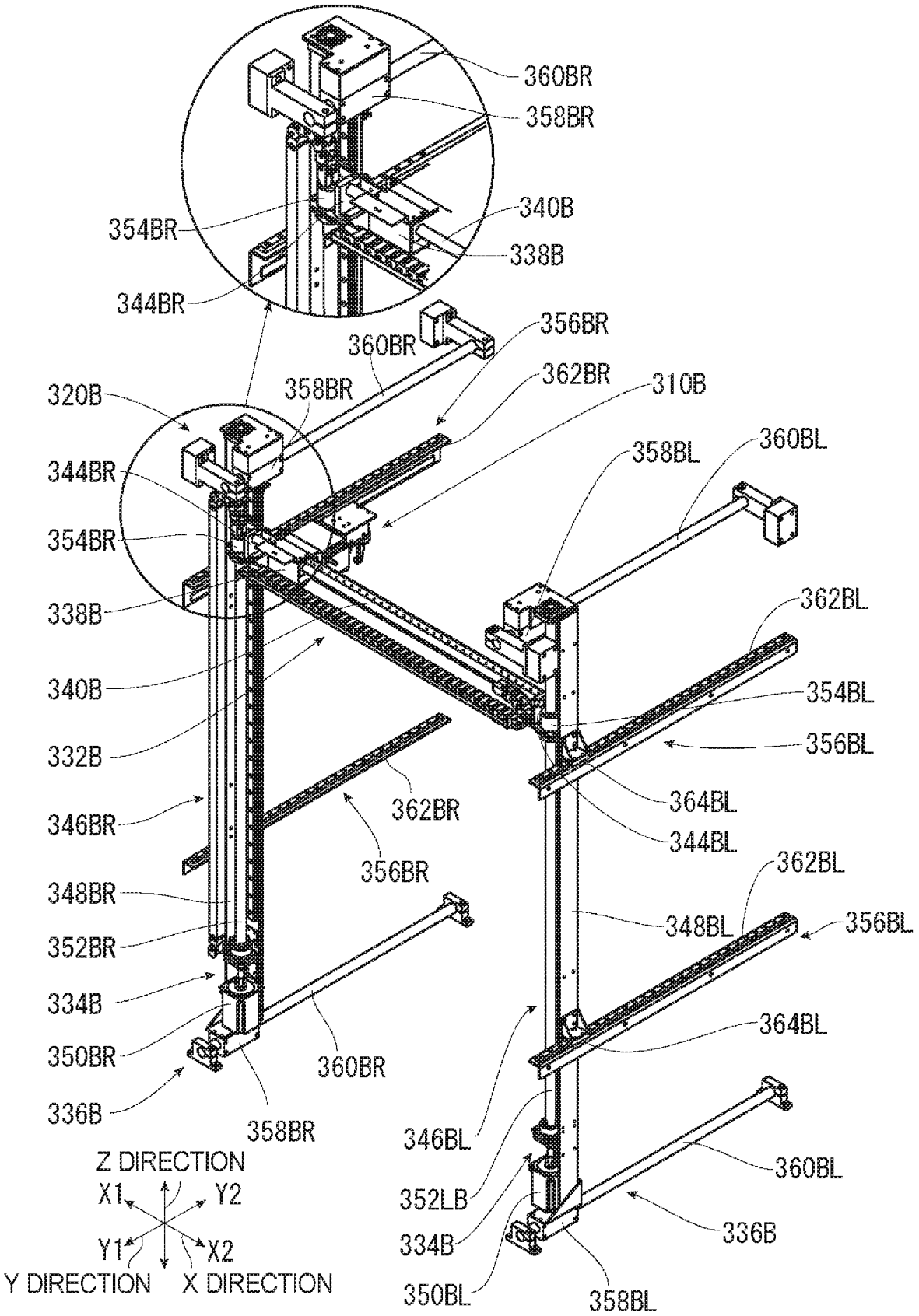
FIG. 5 is a perspective view showing a retaining device of the processing apparatus according to this embodiment of the present invention.

As shown in FIG. 5, the moving mechanism 320B includes a width direction moving mechanism 332B, a pair of up-down direction moving mechanisms 334B, and a front-rear direction moving mechanism 336B.

The width direction moving mechanism 332B moves the retaining mechanism 310B in the width direction (the direction of the arrow X). The up-down direction moving mechanisms 334B move the retaining mechanism 310B in an up-down direction (the direction of the arrow Z) together with the width direction moving mechanism 332B. Further, the front-rear moving mechanism 336B moves the up-down direction moving mechanisms 334B, the width direction moving mechanism 332B, and the retaining mechanism 310B in the front-rear direction (the direction of the arrow Y).

As described above, the width direction moving mechanism 332B is provided in order to move the retaining mechanism 310B in the width direction (the direction of the arrow X). The width direction moving mechanism 332B includes a width direction moving motor 338B serving as a driving force source, and a linear guide 340B.

The linear guide 340B is inserted into the width direction moving motor 338B. The linear guide 340B takes the shape of a round bar that is suspended between a right-left pair of up-down moving plates 344BR, 344BL of the up-down direction moving mechanism 334B. In other words, the linear guide 340B is disposed such that a lengthwise direction thereof extends in the width direction (the direction of the arrow X). When energized, the width direction moving motor 338B slides along the linear guide 340B. The rotary actuator 326B of the retaining mechanism 310B is fixed to the width direction moving motor 338B. When the width direction moving motor 338B moves in the width direction (the direction of the arrow X) along the linear guide 340B, the retaining mechanism 310B fixed to the width direction moving motor 338B moves in the width direction (the direction of the arrow X).

The up-down direction moving mechanism 334B moves the width direction moving mechanism 332B in the up-down direction (the direction of the arrow Z). The upper-down direction moving mechanism 334B includes the right-left pair of up-down moving plates 344BR, 344BL, and a right-left pair of elevating units 346BR, 346BL. In the following description, the up-down moving plates, the elevating units, and constituent elements thereof will be differentiated by attaching a suffix "R" to the up-down moving plates, elevating units and constituent elements thereof that are disposed on the right side when the processing apparatus 1 is seen from the front, and attaching a suffix "L" to the up-down moving plates, elevating units and constituent elements thereof that are disposed on the left side. Note that the up-down moving plate 344BL and the elevating unit 346BL are respectively configured basically identically to the up-down moving plate 344BR and the elevating unit 346BR, and can be described by replacing the reference symbol "R" of the up-down moving plate 344BR and the elevating unit 346BR with the reference symbol "L". Accordingly, description thereof has been omitted.

The width direction moving mechanism 332B, described above, is attached to the up-down moving plate 344BR. The up-down moving plate 344BR is attached to the elevating unit 346BR. The elevating unit 346BR is attached to a frame body 348BR, to be described below, of the front-rear direction moving mechanism 336B.

The elevating unit 346BR includes an up-down direction drive motor 350BR serving as a driving force source, a ball screw 352BR, and a nut 354BR. The up-down direction drive motor 350BR is capable of rotating normally and in reverse. The up-down direction drive motor 350BR is fixed to a lower portion of the frame body 348BR of the front-rear direction moving mechanism 336B. The ball screw 352BR is disposed to extend in a vertical direction (the direction of the arrow Z) so as to receive driving force from the up-down direction drive motor 350BR. The nut 354BR is screwed to the ball screw 352BR so as to move in the up-down direction (the direction of the arrow Z) as the ball screw 352BR rotates. Further, the up-down moving plate 344BR is fixed to the nut 354BR.

When the up-down direction drive motor 350BR of the elevating unit 346BR is driven, the ball screw 352BR rotates. Accordingly, the nut 354BR screwed to the ball screw 352BR moves in a rotary axis direction of the ball screw 352BR (the direction of the arrow Z), whereby the up-down moving plate 344BR attached to the nut 354BR moves in the rotary axis direction (the direction of the arrow Z). By operating the up-down direction drive motors 350BR, 350RL synchronously, the width direction moving mechanism 332B is moved in the up-down direction (the direction of the arrow Z).

The front-rear direction moving mechanism 336B is constituted by a left-right pair of mechanisms that move the up-down direction moving mechanism 334B, described above, in the front-rear direction (the direction of the arrow Y). The front-rear direction moving mechanisms 336B each include a frame body 348B, a plurality of slide guides 356B, a front-rear direction drive motor 358B, and a linear guide 360B. The up-down direction moving mechanism 334B, described above, is attached to the frame bodies 348B. In the following description, the front-rear direction moving mechanisms 336B and constituent elements thereof will be differentiated by attaching a suffix "R" to the front-rear direction moving mechanism 336B and constituent elements thereof that are disposed on the right side when the processing apparatus 1 is seen from the front, and attaching a suffix "L" to the left side front-rear direction moving mechanism 336B and constituent elements thereof. Note that the front-rear direction moving mechanism 336BL is configured basically identically to the front-rear direction moving mechanism 336BR, and can be described by replacing the reference symbol "R" of the front-rear direction moving mechanism 336BR with the reference symbol "L". Accordingly, description thereof has been omitted.

The slide guides 356BR guide front-rear movement of the front-rear direction moving mechanism 336BR. Two sets of the slide guide sets 356BR are used for the single front-rear direction moving mechanism 336BR. Each slide guide set 356BR includes an LM guide 362BR and a slider 364BR. The LM guides 362BR are disposed on an inner surface of the right side surface 106C such that respective lengthwise directions thereof are aligned with the front-rear direction (the direction of the arrow Y). The sliders 364BR are attached respectively to the frame body 348BR. Note that the LM guides 362BR are also used by the slide guides 356AR provided on the moving mechanism 320A of the retaining device 300A. In other words, LM guides 362AR and the LM guides 362BR are identical members.

The linear guide 360BR is inserted into the front-rear direction drive motor 358BR. Two sets of the front-rear direction drive motor 358BR and the linear guide 360BR are used for the single front-rear direction moving mechanism 336BR. One front-rear direction drive motor 358BR is attached to an upper end of the frame body 348BR. The other front-rear direction drive motor 358BR is attached to a lower end of the frame body 348BR. The linear guides 360BR are disposed on the inner surface of the right side surface 106C such that respective lengthwise directions thereof are aligned with the front-rear direction (the direction of the arrow Y). When the front-rear direction drive motor 358BR moves along the linear guide 360BR, the frame body 348BR moves together therewith. When the frame body 348BR moves, the width direction moving mechanism 332BR and the retaining mechanism 310B likewise move therewith. Note that the linear guide 360BR is also used by the moving mechanism 320A of the retaining device 300A. In other words, a linear guide 360AR and the linear guide 360BR are identical members.

[Carrying Device 400]

Figure 8:
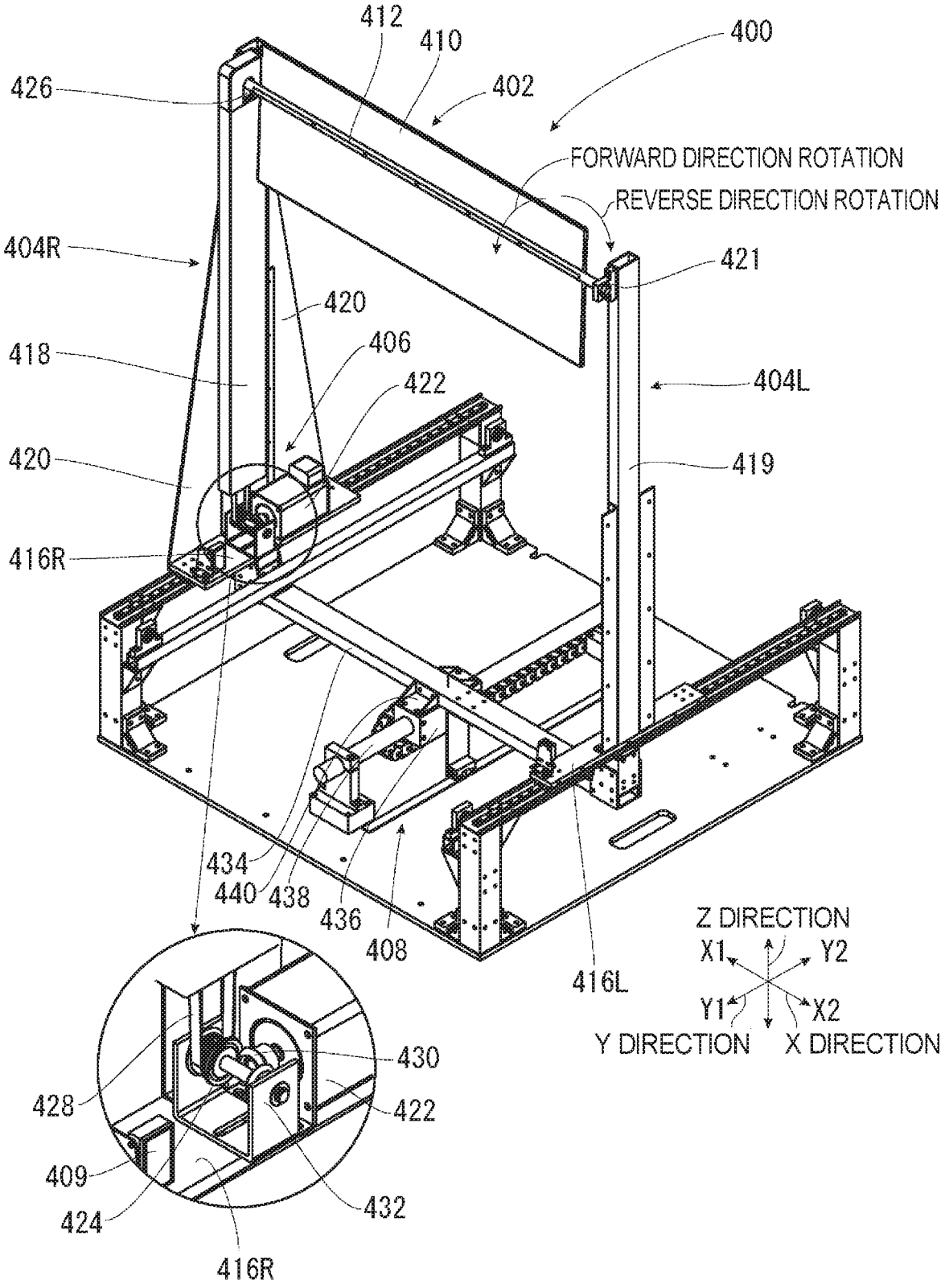
FIG. 8 is a perspective view showing a carrying device of the processing apparatus according to this embodiment of the present invention.

As shown in FIG. 8, the carrying device 400 rotates and moves the carrying plate 402 carrying the processing subject T during recognition processing and folding processing. The carrying device 400 mainly includes the carrying plate 402, a right-left pair of frame bodies 404R, 404L, a rotation mechanism 406, a front-rear direction moving mechanism 408, and a processing subject sensor 409.

The carrying plate 402 is constituted by a carrying plate main body 410 formed from a substantially rectangular plate, and a rotary shaft 412. The rotary shaft 412 is fixed to the carrying plate main body 410 so as to be offset from a width direction center of the carrying plate main body 410 toward one long side thereof. Since the carrying plate main body 410 is disposed at an offset relative to the rotary shaft 412, respective distances from the rotary shaft 412 to the long sides of the carrying plate main body 410 differ on each long side. Accordingly, by bringing the processing subject T into contact with the long side that is further from the rotary shaft 412, for example, the processing subject T can be lifted higher at an identical tilt angle (60 degrees, for example) than in a case where the carrying plate main body 410 is not offset, and as a result, the limited space within the processing apparatus 1 can be used more effectively.

Further, the rotary shaft 412 is formed to be longer than the carrying plate main body 410, and therefore projects from respective short sides of the carrying plate main body 410. A right end of the rotary shaft 412 (in the direction of an arrow X1) is connected to a rotary center of an upper side pulley 426 of the rotation mechanism 406, to be described below. The rotary shaft 412 is disposed such that a central axis thereof is aligned with the left-right direction (the direction of the arrow X). Further, rotation of the rotary shaft 412 in a counterclockwise direction, as seen from the left side surface 106D, will be referred to as "forward direction rotation", while rotation of the rotary shaft 412 in a clockwise direction will be referred to as "reverse direction rotation".

The right-left pair of frame bodies 404R, 404L are members for retaining the rotary shaft 412 rotatably at a predetermined height. The right side frame body 404R includes a rectangular parallelepiped-shaped hollow member 418 having an internal space, and a bracket 420 (for convenience, FIG. 8 shows a condition in which the bracket 420 on the left side (in the direction of an arrow X2) has been removed). The bracket 420 is a substantially rhomboid plate. The hollow member 418 is attached to the bracket 420 so as to extend along a long axis thereof. Further, a moving plate 416R is attached to the bracket 420 so as to extend along a short axis thereof. As a result, the hollow member 418 stands upright from the moving plate 416. Furthermore, a bearing 421 that retains a left end (in the direction of the arrow X2) of the rotary shaft 412 rotatably is provided on an upper end portion of a strut 419.

The rotation mechanism 406 rotates the carrying plate 402. The rotation mechanism 406 mainly includes a rotation motor 422, a lower side pulley 424, the upper side pulley 426, and a belt 428.

The rotation motor 422 generates driving force for rotating the carrying plate 402. The rotation motor 422 is fixed to the moving plate 416R. Further, a turntable 430 is attached to an output shaft end of the rotation motor 422.

The lower side pulley 424 receives the driving force from the rotation motor 422. The lower side pulley 424 is retained rotatably by a substantially U-shaped lower side pulley retaining member 432. The output shaft of the rotation motor 422 is set at a substantially orthogonal orientation to a rotary axis of the lower side pulley 424. The rotation motor 422 and the lower side pulley 424 are positioned so that an outer edge of the turntable 430 contacts a peripheral edge surface of the lower side pulley 424. As a result, the driving force from the rotation motor 422 is transmitted to the lower side pulley 424 at a 90° offset.

As described above, the tip end of the rotary shaft 412 of the carrying plate 402 is attached to the center of the upper side pulley 426. Further, the belt 428 is wound around the upper side pulley 426 and the lower side pulley 424. As a result, driving force received from the rotation motor 422 is transmitted from the lower side pulley 424 to the upper side pulley 426 via the belt 428. The upper side pulley 426 rotates upon reception of the driving force. When the upper side pulley 426 rotates, the carrying plate 402 also rotates.

The front-rear direction moving mechanism 408 includes the right-left pair of moving plates 416R, 416L, a connecting member 434 for connecting the right-left pair of frame bodies 404R, 404L to each other, a front-rear direction drive motor 436, and a linear guide 438. Further, the front-rear direction moving mechanism 408 is disposed below the transportation conveyor 204 of the reception transportation device 200.

The connecting member 434 connects lower ends of the two frame bodies 404R, 404L to each other on the lower side of the transportation conveyor 204. In other words, the connecting member 434 extends in the width direction (the direction of the arrow X).

The linear guide 438 is inserted into the front-rear direction drive motor 436. The front-rear direction drive motor 436 is attached to a lower side of the connecting member 434, described above, via a bracket 440. The linear guide 438 is disposed such that a lengthwise direction thereof is aligned with the front-rear direction (the direction of the arrow Y). Moreover, the front-rear direction drive motor 436 is attached to the lower side of a central portion of the connecting member 434.

When the front-rear direction drive motor 436 moves along the linear guide 438, the connecting member 434 moves in the same direction. When the connecting member 434 moves, the frame bodies 404R, 404L and the carrying plate 402 also move in the same direction.

The processing subject sensor 409 is attached to a surface of the moving plate 416R so as to be oriented toward the moving plate 416L. In other words, the processing subject sensor 409 is attached in a substantially orthogonal orientation relative to the conveyor belt 242 of the transportation conveyor 204. By attaching the processing subject sensor 409 to the moving plate 416R in this manner, when the carrying device 400 is moved in the front-rear direction by the front-rear direction moving mechanism 408, the processing subject sensor 409 moves in the front-rear direction simultaneously therewith.

The processing subject sensor 409 is an obstruction detection sensor that issues an obstruction detection signal after detecting an obstruction (the processing subject T, for example) in front of the processing subject sensor 409. In this embodiment, the obstruction detection signal issued by the processing subject sensor 409 is transmitted to the control device 900 over a signal line.

[Imaging Device 500]

The imaging device 500 detects an end point or the like of the processing subject T during the processing for receiving and transporting the processing subject T and the processing for recognizing and folding the processing subject T. As shown in FIG. 1, the imaging device 500 includes a first imaging unit 502 and a second imaging unit 504. Digital still cameras are used as the respective imaging units 502, 504. Note that wide angle lenses may be used as lenses of the digital still cameras used as the first imaging unit 502 and the second imaging unit 504. In this case, visual fields of the respective imaging units 502, 504 are widened, and as a result, a larger processing subject T can be photographed by a single imaging unit. In this embodiment, an imaging range of the imaging device 500 extends at least below the processing apparatus 1 including the barrier member 222 so that a first point P directly above the barrier member 222 can be detected (see FIG. 17(*f*)). Monochrome or color CODs, for example, can be used as image sensors of the digital still cameras. When color CODs are used, the "color" of the processing subject T can be used during the recognition process performed on the processing subject T as an element for determining whether or not the processing subject T has been recognized.

The first imaging unit 502 is attached to an inner wall surface of the processing apparatus 1 on a far side (in the direction of an arrow Y1) so as to be oriented toward an inner side of the door main body 210. Further, the second imaging unit 504 is attached to an inner wall surface of the processing apparatus 1 on one side face (in the direction of an arrow X1) thereof so as to be oriented toward the other side face (in the direction of the arrow X2). In other words, an imaging direction employed by the first imaging unit 502 and an imaging direction employed by the second imaging unit 504 are substantially orthogonal. Accordingly, the processing subject T can be recognized in three dimensions, and as a result, the processing subject T can be retained more accurately by the retaining mechanisms 310A, 310B. The first imaging unit 502 and the second imaging unit 504 may be attached in different height positions (in the Z direction).

In this case, a situation in which the first imaging unit 502 and the second imaging unit 504 enter blind spots simultaneously due to movement of structures (the retaining devices 300A, 300B, for example) in the processing apparatus 1 and so on can be avoided. Hence, the first imaging unit 502 and the second imaging unit 504 are preferably disposed in consideration of the structures in the processing apparatus 1, the movement loci thereof, and so on to ensure that the two imaging units do not enter blind spots simultaneously.

[Clamping Device 700]

The clamping device 700 receives the processing subject T from the carrying device 400 by clamping the processing subject T when the processing subject T is transported thereto while carried on the carrying plate 402 of the carrying device 400. As shown in FIGS. 2 and 4, the clamping device 700 mainly includes an upper side clamping plate 702, a lower side clamping plate 704, an upper side clamping plate rotary shaft 706, a lower side clamping plate rotary shaft 708, upper side bearings 710, lower side bearings 712, a clamping plate rotation motor 714, and driving force transmitting means 716.

The upper side clamping plate 702 is a rectangular plate disposed such that a lengthwise direction thereof is aligned with the width direction (the direction of the arrow X). The upper side clamping plate rotary shaft 706 is attached to a lower side edge portion of the upper side clamping plate 702. The upper side clamping plate rotary shaft 706 is disposed such that a rotary axis thereof is aligned with the width direction (the direction of the arrow X). The pair of upper side bearings 710 are attached to respective end portions of the upper side clamping plate rotary shaft 706. The upper side bearings 710 are attached to an inner side of the front surface 106A of the processing apparatus 1 on which the door main body 210 is provided.

The lower side clamping plate 704 is a rectangular plate having a larger surface area than the upper side clamping plate 702 described above. Further, the lower side clamping plate 704 is disposed such that a lengthwise direction thereof is aligned with the width direction (the direction of the arrow X). Furthermore, the lower side clamping plate 704 is disposed directly below the upper side clamping plate 702. The lower side clamping plate rotary shaft 708 is attached to an upper side edge portion of the lower side clamping plate 704. The lower side clamping plate rotary shaft 708 is disposed such that a rotary axis thereof is aligned with the width direction (the direction of the arrow X). The pair of lower side bearings 712 are attached to respective end portions of the lower side clamping plate rotary shaft 708. The lower side bearings 712 are attached to the front surface 106A. Further, the lower side clamping plate rotary shaft 708 is disposed such that the rotary axis thereof is aligned with the width direction (the direction of the arrow X) and so as to be parallel to the upper side clamping plate rotary shaft 706. Moreover, a plurality of rectilinear slits 730 are formed in the lower side clamping plate 704 so as to extend from the side of the long side to which the lower side clamping plate rotary shaft 708 is attached to the edge of the other long side. The slits 730 are formed to have a slightly larger width than support members 808 of the transportation device 800 so that the support members 808 can be inserted into the slits 730, as will be described below.

The clamping plate rotation motor 714 is capable of rotating normally and in reverse, and generates driving force for rotating the upper side clamping plate 702 and the lower side clamping plate 704. The clamping plate rotation motor 714 is attached to the inner side of the front surface 106A, similarly to the bearings 710, 712.

The driving force transmitting means 716 includes a drive side pulley 718, a driven side pulley 720, a belt 722, and interlocking means 724.

The drive side pulley 718 is attached to an output shaft end of the clamping plate rotation motor 714. The driven side pulley 720 is attached to the end of the lower side clamping plate rotary shaft 708 that is closer to the clamping plate rotation motor 714. The belt 722 is wound around the drive side pulley 718 and the driven side pulley 720.

The interlocking means 724 is constituted by a first gear 726 attached to the upper side clamping plate rotary shaft 706 and a second gear 728 attached to the lower side clamping plate rotary shaft 708.

As a result, the driving force from the clamping plate rotation motor 714 is transmitted to the lower side clamping plate rotary shaft 708 via the drive side pulley 718, the belt 722, and the driven side pulley 720. The lower side clamping plate rotary shaft 708 to which the driving force is transmitted rotates in a predetermined direction. Further, the driving force transmitted to the lower side clamping plate rotary shaft 708 is transmitted also to the upper side clamping plate rotary shaft 706 via the interlocking means 724. Since the gears 726, 728 are used as the interlocking means 724, the upper side clamping plate rotary shaft 706 rotates in an opposite rotation direction to the lower side clamping plate rotary shaft 708. For example, when the upper side clamping plate rotary shaft 706 rotates clockwise, the lower side clamping plate rotary shaft 708 rotates counterclockwise. The upper side clamping plate 702 and the lower side clamping plate 704 can thus be caused to approach and move away from each other, whereby the clamping device 700 can perform clamping and releasing operations.

[Transportation Device 800]

Figure 9:
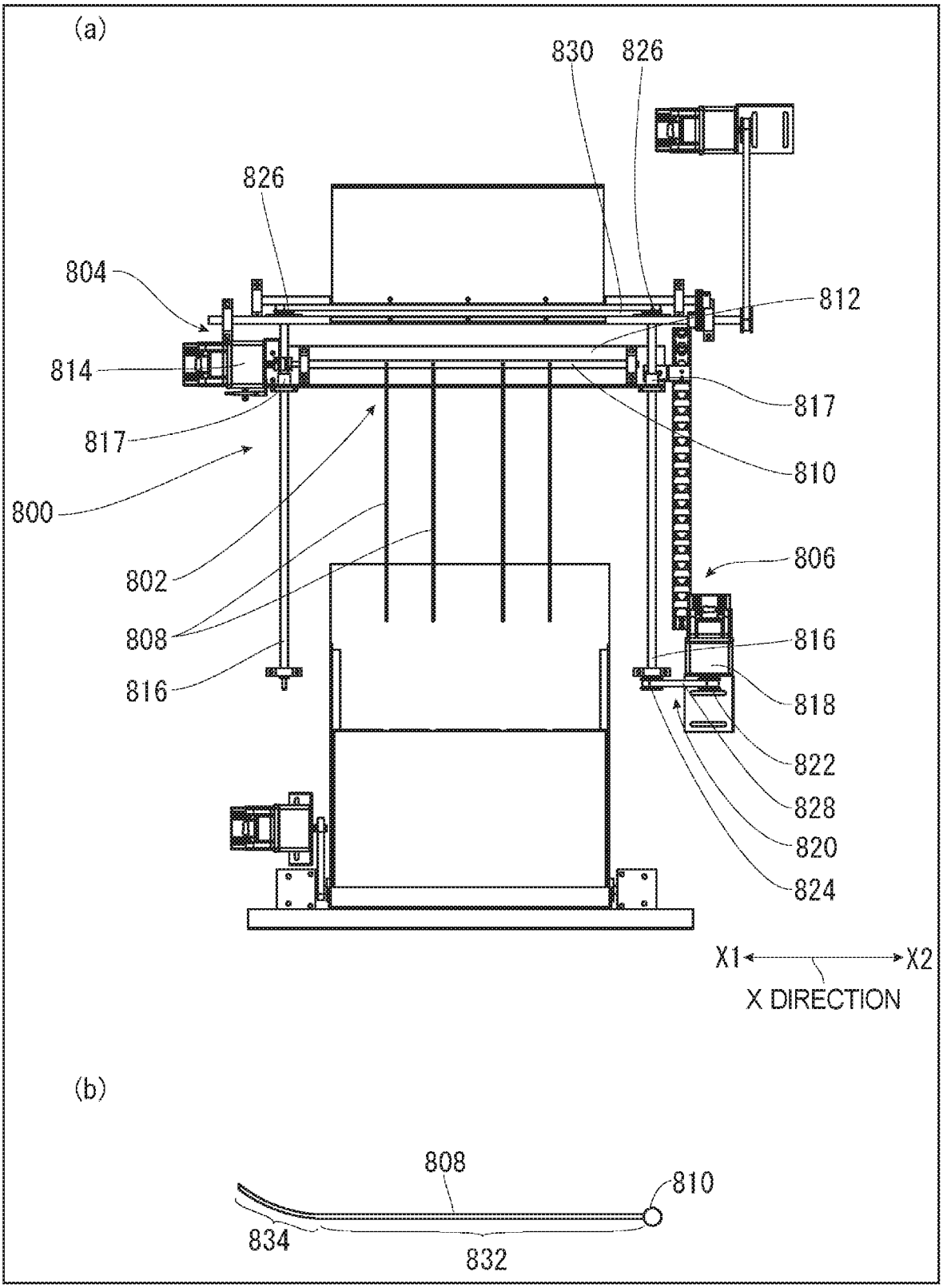
FIG. 9(*a*) is a view showing the front surface of the processing apparatus according to this embodiment of the present invention from the inside, and illustrating the transportation device of the processing apparatus, and FIG. 9(*b*) is a side view showing a support member.

The transportation device 800 receives the processed processing subject T from the clamping device 700, and transports the received processing subject T. The transportation device 800 is disposed on a downstream side of a processing subject processing device constituted by at least one of the devices from the reception transportation device 200 to the clamping device 700, and together with the processing subject processing device constitutes a processing subject processing system. As shown in FIG. 9(*a*), the transportation device 800 mainly includes a support 802, a support rotation mechanism (a rotation mechanism) 804, and a support up-down moving mechanism 806. Note that for convenience, FIG. 9 shows a condition in which the lower side clamping plate 704 of the clamping device 700 has been removed.

The support 802 supports the processing subject T received from the clamping device 700. The support 802 includes the plurality of (in this embodiment, four) support members 808, and a support shaft 810. One end of each support member 808 is attached to a lateral periphery of the support shaft 810 so that the respective support members 808 are arranged in a row with gaps therebetween. Further, the support members 808 are attached in an orthogonal orientation relative to a lengthwise direction of the support shaft 810. As a result, the support 802 is formed in a comb tooth shape.

As shown in FIG. 9(*b*), each support member 808 is constituted by a reception portion 832 and a curved portion 834. The reception portion 832 is a rectilinear portion attached at one end to the support shaft 810. Further, the curved portion 834 is an arc-shaped portion that extends upward at an incline from the other end of the reception portion 832 (the curved portion 834 is not limited to an arc shape, and may take any shape that extends upward at an incline).

The support rotation mechanism 804 includes a frame 812 and a rotation motor 814. The frame 812 is attached to the inner side of the front surface 106A (the wall surface in the direction of an arrow Y2) of the processing apparatus 1, on which the door main body 210 is provided, below the lower side clamping plate rotary shaft 708 of the clamping device 700. Further, the frame 812 is an elongated member that extends in the width direction (the direction of the arrow X) and supports the support shaft 810 rotatably.

The rotation motor 814 is capable of rotating normally and in reverse, and generates driving force for rotating the support shaft 810. The rotation motor 814 is fixed to a right side end (in the direction of the arrow X1) of the frame 812. An output shaft of the rotation motor 814 is connected to a right side end (in the direction of the arrow X1) of the support shaft 810. As a result, the support shaft 810 can be rotated by the driving force of the rotation motor 814. Using the support shaft 810, positions in which the support members 808 hang down, positions in which the support members 808 are substantially horizontal, and so on can be set as desired.

The support up-down moving mechanism 806 moves the support rotation mechanism 804 and the support 802 up and down. The support up-down moving mechanism 806 mainly includes a pair of ball screws 816, a pair of nuts 817, an up-down moving motor 818, and driving force transmitting means 820.

The pair of ball screws 816 are attached to the inner side of the front surface 106A. Further, the ball screws 816 are disposed in the up-down direction (the direction of the arrow Z) via a gap that is slightly narrower than a horizontal direction length of the frame 812. The nuts 817 are screwed respectively to the ball screws 816. The nuts 817 are attached to respective end portions of the frame 812.

The up-down moving motor 818 is capable of rotating normally and in reverse, and generates driving force for moving the support rotation mechanism 804 and the support 802 up and down. The up-down moving motor 818 is attached to the inner side of the front surface 106A. Further, an attachment height of the up-down moving motor 818 is set in the vicinity of a lowermost end to which the support 802 can be moved.

The driving force transmitting means 820 transmit the driving force of the up-down moving motor 818 to the pair of ball screws 816. The driving force transmitting means 820 includes a drive side pulley 822, a driven side pulley 824, a pair of interlocking pulleys 826, a drive belt 828, and an interlocking belt 830.

The drive side pulley 822 is attached to an output shaft end of the up-down moving motor 818. The driven side pulley 824 is attached to a lower end of the ball screw 816 that is closest to the up-down moving motor 818. The pair of interlocking pulleys 826 are attached to respective upper ends of the pair of ball screws 816. The drive belt 828 is wound around the drive side pulley 822 and the driven side pulley 824. The interlocking belt 830 is wound around the pair of interlocking pulleys 826.

Hence, the driving force of the up-down moving motor 818 is transmitted to the ball screw 816 that is closest to the up-down moving motor 818 via the drive side pulley 822 and the drive belt 828. The ball screw 816 to which the driving force is transmitted rotates in a predetermined direction. Resulting rotational force is transmitted to the other ball screw 816 via the pair of interlocking pulleys 826 and the interlocking belt 830. As a result, the pair of ball screws 816 receive the driving force of the up-down moving motor 818 so as to rotate in identical directions and at identical speeds. Accordingly, the pair of nuts 817 move up and down at identical speeds, whereby the frame 812 moves up and down while remaining horizontal. When the frame 812 moves up and down, the support 802 and the support rotation mechanism 804 also move up and down.

[Control Device 900]

The control device 900 controls the respective parts of the processing apparatus 1. The control device 900 is mainly constituted by a ROM, a CPU, a RAM, and an input/output interface. The ROM stores an operating system, control programs for controlling the respective parts of the processing apparatus 1, and data required to execute the control program. Further, the CPU is provided to load the control programs stored in the ROM to the RAM or execute the control programs directly from the ROM. In other words, the CPU can control the processing apparatus 1 by executing the control programs. Data processed by the CPU are transmitted to respective parts (the reception transportation device 200, the retaining devices 300A, 300B, and so on) of the processing apparatus 1 via the input/output interface, while data required by the CPU to execute the processing are received from respective parts (the imaging device 500 and so on) of the processing apparatus 1 via the input/output interface.

As shown in the function block diagram of FIG. 10, the control device 900 mainly includes a reception transportation device control unit 902, a retaining device control unit 904, a carrying device control unit 906, an imaging device control unit 908, a clamping device control unit 910, a transportation device control unit 912, a type recognition unit 914, a length detection unit 915, a hanging length detection unit 916, a first point detection unit 920, a first end point detection unit 922, a second end point detection unit 924, a third end point detection unit 926, a fourth end point detection unit 928, a fifth end point detection unit 930, a sixth end point detection unit 932, a seventh end point detection unit 934, and an eighth end point detection unit 936.

[Reception Transportation Device Control Unit 902]

The reception transportation device control unit 902 controls operations of the reception transportation device 200. In other words, the reception transportation device control unit 902 controls operations of the door 202 and the transportation conveyor 204.

When the reception transportation device control unit 902 controls the operation of the door 202, the door main body 210 opens and closes. As a result, the user can insert the processing subject T into the processing apparatus 1 or remove the processed processing subject T from the processing apparatus 1. Further, by having the reception transportation device control unit 902 control the operation of the transportation conveyor 204, the transportation conveyor 204 can be rotated in either the forward direction or the reverse direction.

[Retaining Device Control Unit 904]

The retaining device control unit 904 controls operations of the retaining mechanisms 310A, 310B and moving mechanisms 320A, 320B of the retaining devices 300A, 300B.

When the retaining device control unit 904 controls the operations of the linear actuators 324A, 324B of the retaining mechanisms 310A, 310B, the respective pairs of finger members 322A, 322B approach or move away from each other, whereby the processing subject T is gripped or released by the gripping members 328A, 328B attached to the respective finger members 322A, 322B.

Further, when the retaining device control unit 904 controls the operations of the rotary actuators 326A, 326B of the retaining mechanisms 310A, 310B, the linear actuators 324A, 324B rotate about the respective rotary axes of the rotary actuators 326A, 326B via the connecting plates 330A, 330B.

Furthermore, when the retaining device control unit 904 controls the operations of the width direction moving mechanisms 332A, 332B of the moving mechanisms 320A, 320B, the retaining mechanisms 310A, 310B move in the width direction (the direction of the arrow X).

Moreover, when the retaining device control unit 904 controls the operations of the up-down direction moving mechanisms 334A, 334B of the moving mechanisms 320A, 320B, the retaining mechanisms 310A, 310B move in the up-down direction (the direction of the arrow Z).

Furthermore, when the retaining device control unit 904 controls the operations of the front-rear direction moving mechanisms 336A, 336B of the moving mechanisms 320A, 320B, the retaining mechanisms 310A, 310B move in the front-rear direction (the direction of the arrow Y).

[Carrying Device Control Unit 906]

The carrying device control unit 906 controls operations of the rotation mechanism 406 and the front-rear direction moving mechanism 408 of the carrying device 400.

When the carrying device control unit 906 controls the operation of the rotation mechanism 406, the carrying plate 402 rotates while maintaining a predetermined angle.

When the carrying device control unit 906 controls the operation of the front-rear direction moving mechanism 408, the carrying plate 402 moves in the front-rear direction (the direction of the arrow Y).

[Imaging Device Control Unit 908]

The imaging device control unit 908 controls operations of the first imaging unit 502 and the second imaging unit 504 of the imaging device 500. By controlling the first imaging unit 502 and the second imaging unit 504, digital images can be obtained at desired timings.

[Clamping Device Control Unit 910]

The clamping device control unit 910 controls an operation of the clamping plate rotation motor 714 of the clamping device 700. When the clamping device control unit 910 causes the clamping plate rotation motor 714 to rotate normally, the upper side clamping plate 702 and the lower side clamping plate 704 rotate in an approaching direction (in other words, a closing direction of the clamping device 700). When the clamping plate rotation motor 714 is rotated in reverse, on the other hand, the upper side clamping plate 702 and the lower side clamping plate 704 rotate in a separating direction (in other words, an opening direction of the clamping device 700). As a result, the open/closed condition of the clamping device 700 can be controlled.

[Transportation Device Control Unit 912]

The transportation device control unit 912 controls operations of the support rotation mechanism 804 and the support up-down moving mechanism 806 of the transportation device 800.

When the transportation device control unit 912 controls the support rotation mechanism 804 of the transportation device 800, a rotation angle of the support 802 is varied or maintained at a predetermined angle.

When the transportation device control unit 912 controls the support up-down moving mechanism 806 of the transportation device 800, the support 802 moves in the up-down direction (the direction of the arrow Z).

[Type Recognition Unit 914]

The type recognition unit 914 recognizes the type of the processing subject T on the basis of image data obtained by the first imaging unit 502 and the second imaging unit 504 of the imaging device 500. To describe this type recognition operation, the type recognition unit 914 performs learning in advance using a randomized forest recognition device on the basis of feature amounts extracted from image data (learning image data) relating to many different types of processing subjects T, such as a T-shirt, a running shirt, a skirt, a towel, a handkerchief, a film, a piece of paper, or a sheet. A randomized forest is a mechanical learning algorithm used to perform recognition and the like by constructing a forest from a plurality of decision trees. Further, the term "feature amount" as used herein is not limited to the outer shape of the processing subject T (for example, the presence or absence of a "collar portion"), and includes all elements of the outer appearance of the processing subject T. For example, when the processing subject T is a T-shirt, a character design printed on the T-shirt also serves as an element used to calculate the "feature amount". Note that the learning image data may be added by the user via a tablet PC having a camera function, a digital camera having a data transmission function, or the like.

A method employing a "pixel value", a method employing an "HOG (Histogram Oriented Gradients) feature amount", or a method employing an existing technique used to recognize a human face, such as a "Haar-like feature amount", may be used as a method of calculating the feature amount from the learning image data.

Using the method described above, the type recognition unit 914 calculates the feature amounts of the processing subject T currently being processed, which appears on the image data obtained by the first imaging unit 502 and the second imaging unit 504. The type recognition unit 914 then uses a randomized forest recognition device to calculate probabilities by which the processing subject T corresponds to each of certain types (a T-shirt, a running shirt, a skirt, a towel, and so on, for example) as percentages for each calculated feature amount, and then recognizes the highest probability (i.e. the highest percentage) as the type of the processing subject T.

Figure 11:
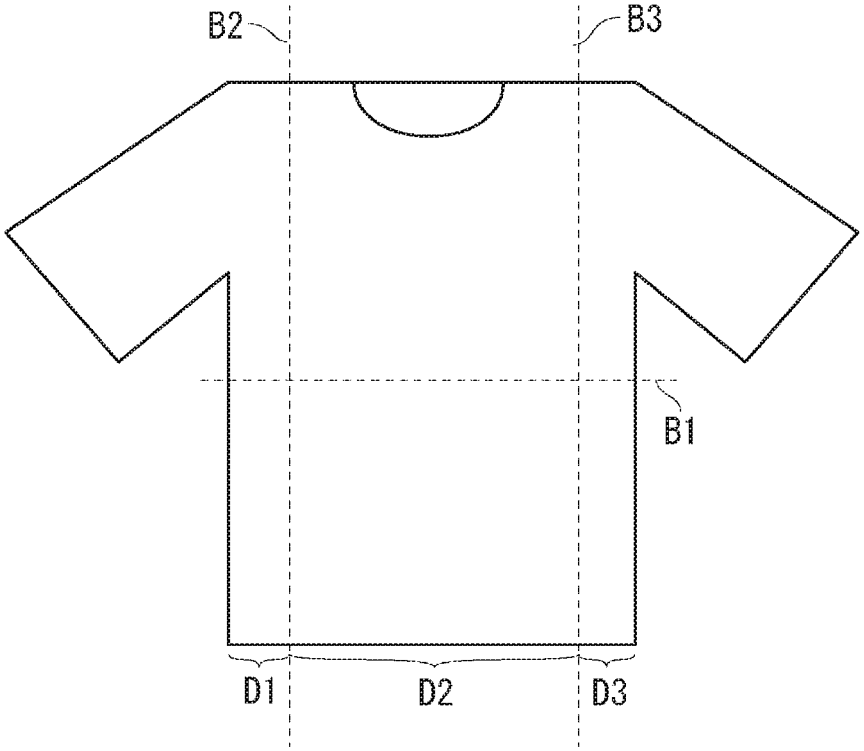
FIG. 11 is a view illustrating "folding information" relating to a T-shirt that serves as an example of a processing subject.
Figure 12:
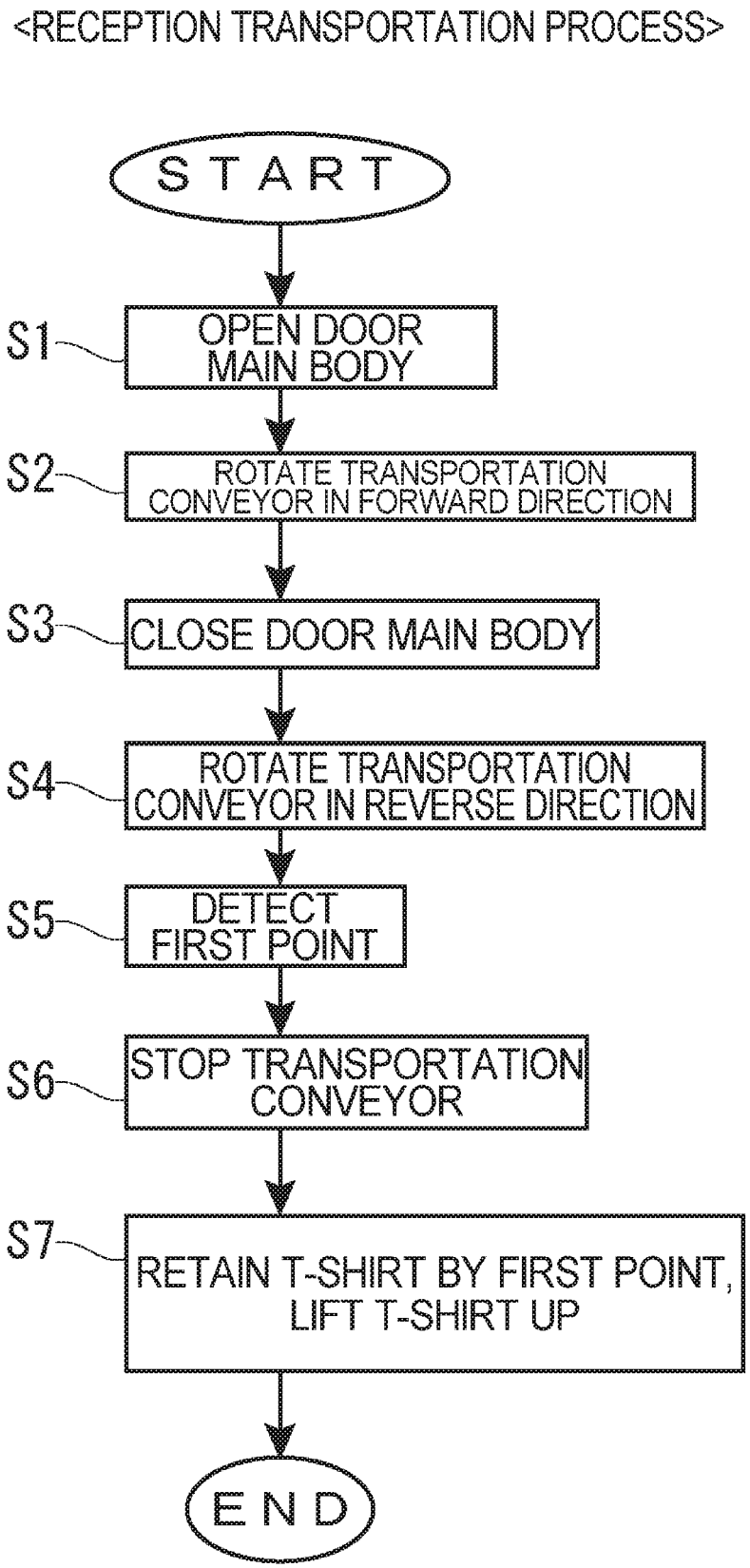
FIG. 12 is a flowchart showing a T-shirt reception transportation process performed by the processing apparatus shown in FIG. 1.
Figure 13:
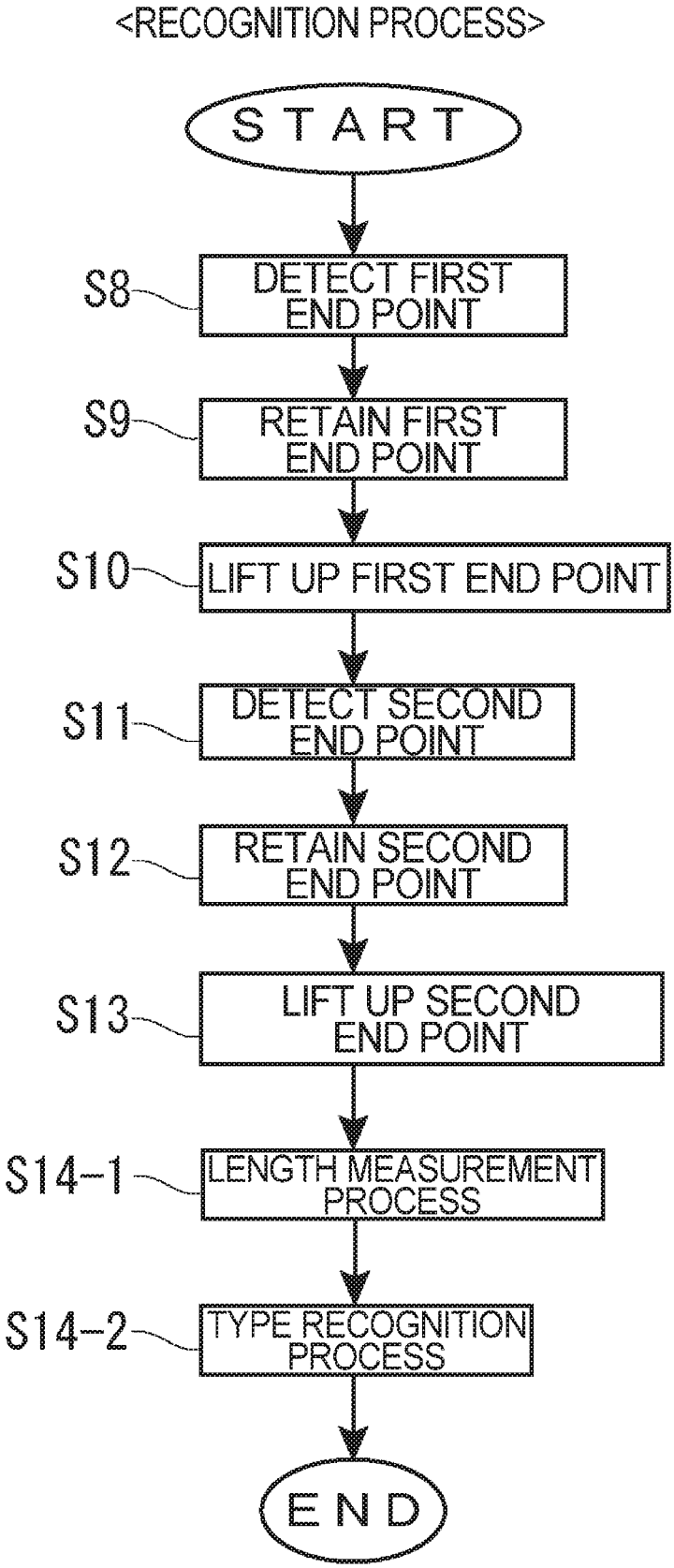
FIG. 13 is a flowchart showing a T-shirt recognition process performed by the processing apparatus shown in FIG. 1.

Further, a folding method is determined in the type recognition unit 914 in advance for each type of processing subject T, and the folding method for each type is stored as "folding information". The "folding information" includes information indicating positions in which to make folds when folding a processing subject T of a certain type. For example, when the processing subject T is a T-shirt and the T-shirt is to be folded in two in a length direction and in three in a width direction, the "folding information" for the T-shirt includes "position information indicating a lateral fold line B1" required to fold the T-shirt in two in the length direction, and "position information indicating a first fold line B2" and "position information indicating a second fold line B3", required to fold the T-shirt in three in the width direction, as shown in FIG. 11. Note that the "lateral fold line B1" does not have to be specific "position information", and may be determined as a proportion of the overall length of the T-shirt, for example "a halfway position of the overall length". Furthermore, an end side of the T-shirt further toward the end than the first fold line B2 will be referred to as a first end part D1, an end side of the T-shirt further toward the opposite end than the second fold line B3 will be referred to as a second end part D3, and a central portion sandwiched between the first end part D1 and the second end part D3 will be referred to as a central part D2.

[Length Detection Unit 915]

The length detection unit 915 obtains a vertical direction length and a horizontal direction length of the processing subject T (when the processing subject T is a T-shirt, the vertical direction length and the horizontal direction length correspond respectively to a length dimension and a width dimension of the T-shirt) on the basis of the image data obtained by the first imaging unit 502 and the second imaging unit 504 of the imaging device 500.

[Hanging Length Detection Unit 916]

The hanging length detection unit 916 detects a lower end of the processing subject T hanging from an edge line (a first edge line) of the carrying plate 402 on the basis of the image data obtained by the first imaging unit 502 and the second imaging unit 504 of the imaging device 500, thereby obtaining a hanging length from the first edge line to the lower end.

[First Point Detection Unit 920]

The first point detection unit 920 detects the first point P, which denotes the highest position of the processing subject T carried on the upper surface of the transportation conveyor 204 of the reception transportation device 200. More specifically, on the basis of the image data from the first imaging unit 502 and the second imaging unit 504, the first point detection unit 920 detects a part of the processing subject T located at least a predetermined height from the upper surface of the transportation conveyor 204 either directly above or in the vicinity of the barrier member 222 of the reception transportation device 200 (when a plurality of parts are located at least the predetermined height from the upper surface of the transportation conveyor 204, the highest part, for example, is detected) as the first point P (see FIG. 17(*f*)).

[First End Point Detection Unit 922]

The first end point detection unit 922 detects a first end point P1 located furthest away from the first point P when the retaining mechanism 310A retains the processing subject T by the first point P. More specifically, on the basis of the image data from the first imaging unit 502 and the second imaging unit 504, the first end point detection unit 922 detects a lowermost point (the point in the lowest position) of the processing subject T when the retaining mechanism 310A retains and lifts up the processing subject T by the first point P, and sets this lowermost point as the first end point P1 (see FIG. 18(*h*)).

[Second End Point Detection Unit 924]

The second end point detection unit 924 detects a second end point P2 located furthest away from a straight line L1 linking the first point P to the first end point P1. More specifically, on the basis of the image data from the first imaging unit 502 and the second imaging unit 504, the second end point detection unit 924 detects the lowermost point of the processing subject T when the retaining mechanisms 310A, 3106 retain the processing subject T at equal heights by the first point P and the first end point P1, respectively, and sets this lowermost point as the second end point P2 (see FIG. 18(*i*)).

[Third End Point Detection Unit 926]

The third end point detection unit 926 detects a corner portion of the processing subject T as a third end point P3. More specifically, on the basis of the image data from the first imaging unit 502 and the second imaging unit 504, the third end point detection unit 926 detects a lower corner portion of the processing subject T hanging down from the carrying plate 402, and sets this corner portion as the third end point P3 (see FIG. 19(*l*)).

[Fourth End Point Detection Unit 928]

The fourth end point detection unit 928 detects an opposite corner portion of the processing subject T to the third end point P3 as a fourth end point P4. More specifically, on the basis of the image data from the first imaging unit 502 and the second imaging unit 504, the fourth end point detection unit 928 detects the corner portion opposite the corner portion of the processing subject T set as the third end point P3, and sets this corner portion as the fourth end point P4 (see FIG. 19(*l*)).

[Fifth End Point Detection Unit 930]

The fifth end point detection unit 930 detects one end of the lateral fold line B1 used when the processing subject T is folded in two in an orthogonal direction to the lengthwise direction thereof (i.e. in a lateral direction) as a fifth end point P5. More specifically, on the basis of the image data from the first imaging unit 502 and the second imaging unit 504, the fifth end point detection unit 930 detects an upper corner portion of the processing subject T in a condition where the carrying plate 402 is set at a predetermined angle from a horizontal condition and the processing subject T hangs down over the carrying plate 402 such that the lateral fold line B1 of the processing subject T extends along an upper side edge line (a first edge line C1) of the carrying plate 402, and sets this corner portion as the fifth end point P5 (see FIG. 21(*p*)).

[Sixth End Point Detection Unit 932]

The sixth end point detection unit 932 detects the other end of the lateral fold line B1 used when the processing subject T is folded in two in an orthogonal direction to the lengthwise direction thereof (i.e. in the lateral direction) as a sixth end point P6. More specifically, when the fifth end point P5 is detected by the fifth end point detection unit 930, the sixth end point detection unit 932 detects a corner portion opposite the corner portion of the processing subject T set as the fifth end point P5 on the basis of the image data from the first imaging unit 502 and the second imaging unit 504, and sets this corner portion as the sixth end point P6 (see FIG. 21(*p*)).

[Seventh End Point Detection Unit 934]

The seventh end point detection unit 934 detects one end of the first fold line B2 used when the processing subject T is folded in the lengthwise direction (the vertical direction) thereof as a seventh end point P7. More specifically, on the basis of the image data from the first imaging unit 502 and the second imaging unit 504, the seventh end point detection unit 934 detects an upper corner portion of the processing subject T in a condition where the carrying plate 402 is set at a predetermined angle from a horizontal condition and the processing subject T hangs down over the carrying plate 402 such that the first fold line B2 of the processing subject T extends along the upper side edge line (the first edge line C1) of the carrying plate 402, and sets this corner portion as the seventh end point P7 (see FIG. 22(*s*)).

[Eighth End Point Detection Unit 936]

The eighth end point detection unit 936 detects the other end of the first fold line B2 used when the processing subject T is folded in the lengthwise direction (the vertical direction) thereof as an eighth end point P8. More specifically, when the seventh end point P7 is detected by the seventh end point detection unit 934, the eighth end point detection unit 936 detects a corner portion opposite the corner portion of the processing subject T set as the seventh end point P7 on the basis of the image data from the first imaging unit 502 and the second imaging unit 504, and sets this corner portion as the eighth end point P8 (see FIG. 22(*s*)).

[Control Executed by Reception Transportation Device Control Unit 902]

The reception transportation device control unit 902 controls the operations of the door 202 and the transportation conveyor 204 to perform first control to fifth control, described below, in order to receive the processing subject T in the processing apparatus 1 in a crumpled condition and arrange the processing subject T so that the retaining device 300A can lift up the processing subject T more easily.

The reception transportation device control unit 902 controls the door opening/closing motor 216 to open the door main body 210 (first control).

Further, following the first control, the reception transportation device control unit 902 controls the conveyor drive motor 244 to rotate the transportation conveyor 204 in the forward direction (second control).

After the user inserts the crumpled processing subject T into the processing apparatus 1, the reception transportation device control unit 902 controls the door opening/closing motor 216 to close the door main body 210 (third control). Note that the front-rear direction moving mechanism 408 of the carrying device 400 is positioned in advance so that the processing subject sensor 409 is positioned in the position of the barrier member 222 when the door main body 210 is closed.

Further, following the third control, the reception transportation device control unit 902 controls the conveyor drive motor 244 to rotate the transportation conveyor 204 in the reverse direction (fourth control).

Further, when the reception transportation device control unit 902 determines that the processing subject T has been lifted onto the barrier member 222 following the fourth control, or in other words when the control device 900 receives the obstruction detection signal from the processing subject sensor 409, the reception transportation device control unit 902 controls the conveyor drive motor 244 to stop the transportation conveyor 204 (fifth control).

[Control Executed Cooperatively by Retaining Device Control Unit 904 and Carrying Device Control Unit 906]

The retaining device control unit 904 and the carrying device control unit 906 execute sixth control to twenty-first control, described below, in order to lift up the processing subject T from the transportation conveyor 204, recognize the processing subject T, and then fold the processing subject T.

After the retaining mechanism 310A retains the processing subject T on the transportation conveyor 204 by the first point P, the retaining device control unit 904 controls the retaining device 300A to lift up the processing subject T (sixth control).

Following the sixth control, the retaining device control unit 904 controls the retaining device 300B such that the retaining mechanism 310B retains the first end point of the processing subject T (seventh control).

Following the seventh control, the retaining device control unit 904 controls the retaining device 300B such that the retaining mechanism 310A moves horizontally in a rightward direction (the direction of the arrow X1) while retaining the first point P, and the retaining mechanism 310B lifts up the first end point P1 to the same height as the first point P (eighth control).

Following the eighth control, the retaining device control unit 904 controls the retaining device 300B such that the retaining mechanism 310B releases the first end point P1 and then retains the second end point P2 (ninth control).

Following the ninth control, the retaining device control unit 904 and the carrying device control unit 906 control the retaining device 300B and the carrying device 400 such that the retaining mechanism 310B lifts up the second end point P2 to the same height as the first point P, and the carrying plate 402 rotates in the forward direction (tenth control).

Following the tenth control, the retaining device control unit 904 controls the retaining devices 300A, 300B to cause the retaining mechanism 310A and the retaining mechanism 310B to hang the processing subject T over the carrying plate 402 such that the lateral fold line B1 of the processing subject T is aligned with the upper side edge line (the first edge line C1) of the carrying plate 402, whereupon the retaining mechanism 310A releases the first point P and the retaining mechanism 310B releases the second end point P2 (eleventh control).

Following the eleventh control, the retaining device control unit 904 controls the retaining device 300A such that the retaining mechanism 310A retains the third end point P3 (twelfth control).

Following the twelfth control, the retaining device control unit 904 controls the retaining device 300A such that the retaining mechanism 310A moves the third end point P3 directly above the fourth end point P4 (thirteenth control).

Following the thirteenth control, the retaining device control unit 904 controls the retaining device 300B such that the retaining mechanism 310B retains the fourth end point P4 (fourteenth control).

Following the fourteenth control, the retaining device control unit 904 and the carrying device control unit 906 control the retaining device 300B and the carrying device 400 such that the retaining mechanism 310B lifts up the fourth end point P4 to an equal height to the third end point P3 on the right side (the direction of the arrow X1) of the third end point, whereupon the carrying plate 402 rotates in the forward direction (the rotary shaft 412 rotates counterclockwise when seen from the left side surface 102D) such that the front and back of the processing subject T are reversed, and then the processing subject T is hung over the carrying plate 402 with the lateral fold line B1 of the processing subject T in alignment with the upper side edge line (the first edge line C1) of the carrying plate 402 (fifteenth control).

Following the fifteenth control, the retaining device control unit 904 and the carrying device control unit 906 control the retaining devices 300A, 300B and the carrying device 400 such that the carrying plate 402 is held in a vertical condition, the retaining mechanism 310A retains the fifth end point, and the retaining mechanism 310B retains the sixth end point (sixteenth control).

Following the sixteenth control, the retaining device control unit 904 and the carrying device control unit 906 control the retaining devices 300A, 300B and the carrying device 400 such that the processing subject T is lifted above the carrying plate 402 while the respective retaining mechanisms 310A, 310B retain the fifth end point P5 and the sixth end point P6, whereupon the carrying plate 402 is held in a horizontal condition. The retaining mechanism 310A and the retaining mechanism 310B then line up the fifth end point P5 and the sixth end point P6 in the front-rear direction on the outer sides of the carrying plate 402, whereupon the retaining mechanism 310A and the retaining mechanism 310B place the lower end portion of the processing subject T on the upper surface of the carrying plate 402 (seventeenth control).

Following the seventeenth control, the retaining device control unit 904 [controls the retaining devices 300A, 300B such that] the retaining mechanism 310A and the retaining mechanism 310B respectively release the fifth end point P5 and the sixth end point P6 (eighteenth control).

Following the eighteenth control, the carrying device control unit 906 controls the carrying device 400 such that the carrying plate 402 rotates in the reverse direction (the rotary shaft 412 rotates clockwise when seen from the left side surface 102D) to a vertical orientation (nineteenth control).

Following the nineteenth control, the retaining device control unit 904 and the carrying device control unit 906 control the retaining devices 300A, 300B and the carrying device 400 such that the retaining mechanism 310A and the retaining mechanism 3106 retain and lift up the processing subject T by the seventh end point P7 and the eighth end point P8, respectively, whereupon the carrying plate 402 is set in the horizontal condition (twentieth control).

Following the twentieth control, the retaining device control unit 904 controls the retaining devices 300A, 300B such that the respective retaining mechanisms 310A, 310B place the processing subject T on the horizontal carrying plate 402 while retaining the seventh end point P7 and the eighth end point P8 (twenty-first control).

[Control Executed Cooperatively by Carrying Device Control Unit 906 and Clamping Device Control Unit 910]

The carrying device control unit 906 and the clamping device control unit 910 execute twenty-second to twenty-third control, described below, in order to fold the processing subject T and retain the folded processing subject T in a folded condition.

Following the twenty-first control, the carrying device control unit 906 and the clamping device control unit 910 control the carrying device 400 and the clamping device 700 such that the carrying plate 402 carrying the processing subject T approaches the clamping device 700 and the approaching processing subject T is clamped between the upper side clamping plate 702 and the lower side clamping plate 704 together with the carrying plate 402 (twenty-second control).

Following the twenty-second control, the carrying device control unit 906 controls the carrying device 400 such that the carrying plate 402 moves away from the clamping device 700 (twenty-third control).

[Control Executed Cooperatively by Clamping Device Control Unit 910 and Transportation Device Control Unit 912]

The clamping device control unit 910 and the transportation device control unit 912 execute twenty-fourth to twenty-sixth control, described below, in order to store the folded processing subject T in the processing subject reception member 220 while preventing the processing subject T from losing its shape.

Following the twenty-third control, the clamping device control unit 910 and the transportation device control unit 912 control the transportation device 800 and the clamping device 700 to rotate the support shaft 810 until the support 802 is elevated to an upper limit and the support members 808 are horizontal, and then to release the processing subject T (twenty-fourth control).

Following the twenty-fourth control, the transportation device control unit 912 controls the transportation device 800 to lower the support 802 while keeping the support members 808 horizontal (twenty-fifth control).

Following the twenty-fifth control, the clamping device control unit 910 and the transportation device control unit 912 control the transportation device 800 to stop lowering the support 802 and then to rotate the support members 808 to a vertically downward orientation (twenty-sixth control).

[T-Shirt Processing Operation Performed by Processing Apparatus 1]

Next, referring to flowcharts shown in FIGS. 12 to 15 and also to FIGS. 16 to 24, a processing operation performed by the processing apparatus 1 on a T-shirt T serving as an example of the processing subject T will be described.

[Reception Transportation Process (FIG. 12)]

Figure 16:
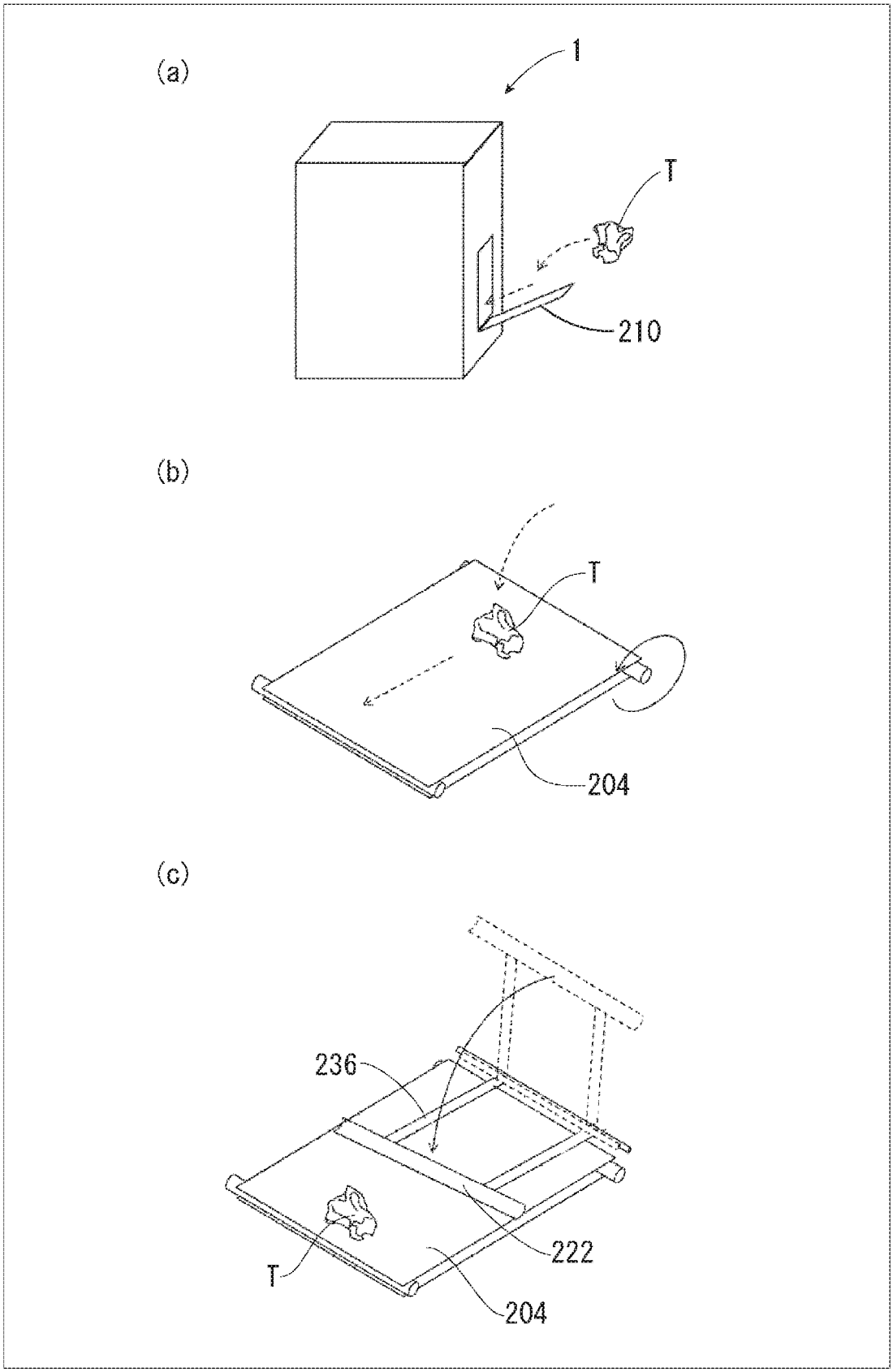
FIG. 16 is a view illustrating a T-shirt processing operation performed by the processing apparatus shown in FIG. 1.
Figure 25:
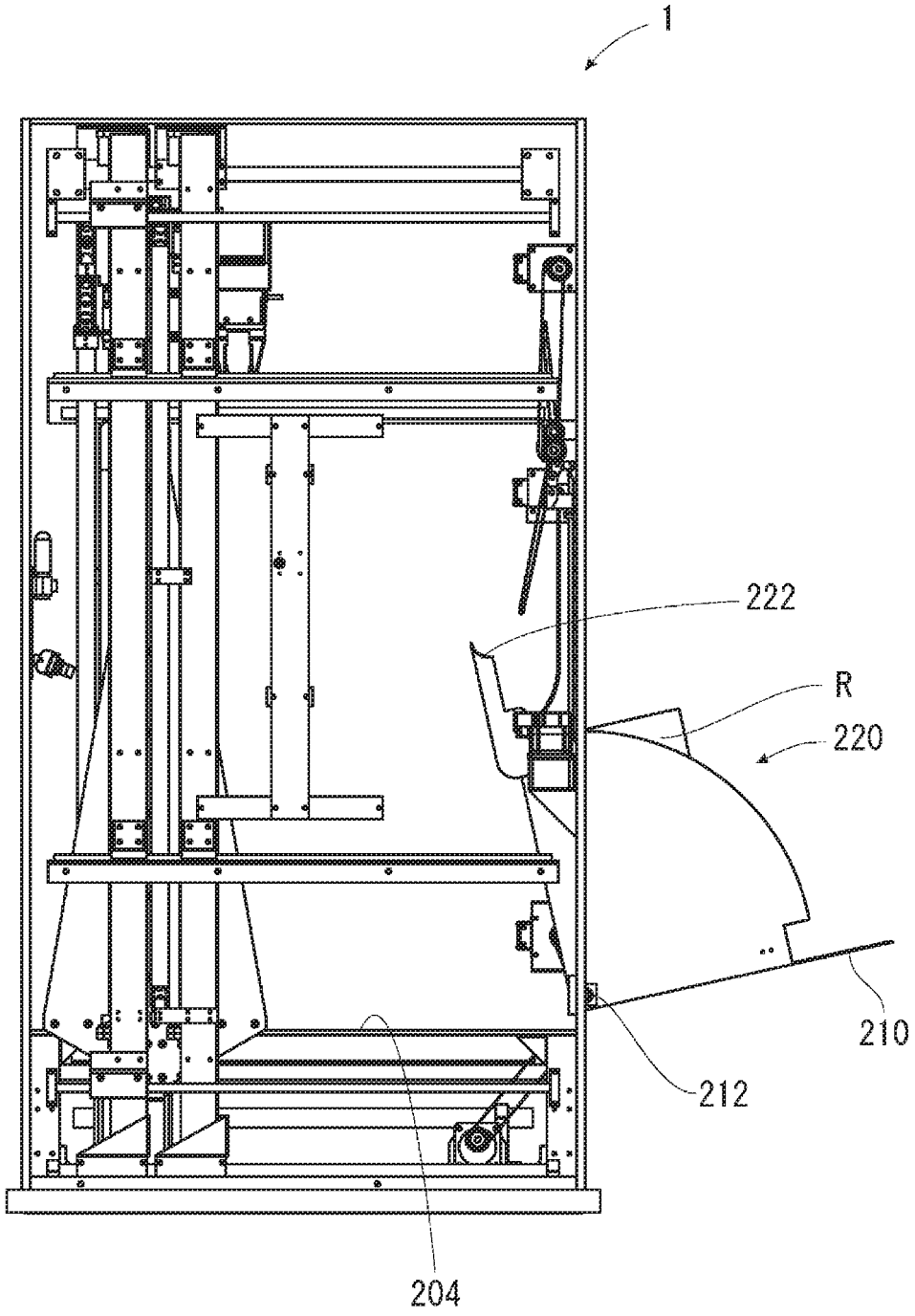
FIG. 25 is a left side view showing a condition in which a door of the processing apparatus according to this embodiment of the present invention is open.

First, as shown in FIG. 16(*a*), when the processing operation performed on the T-shirt T by the processing apparatus 1 starts, the door main body 210 is opened (the first control, step S1). Next, as shown in FIG. 16(*b*), the transportation conveyor 204 is rotated in the forward direction (a direction in which the T-shirt T moves away from the door main body 210) (the second control, step S2). In this condition, the crumpled T-shirt T, which has been washed and dried, is inserted into the processing apparatus 1. Note that when the door main body 210 is open, as shown in FIG. 25, the door main body 210 rotates about the door shaft 212. Further, the processing subject reception member 220 and barrier member 222 attached to the door main body 210 likewise rotate about the door shaft 212. In other words, the processing subject reception member 220 and the barrier member 222 are separated from the upper surface of the transportation conveyor 204.

Next, the inserted T-shirt T is transported by the transportation conveyor 204 rotating in the forward direction (the direction in which the T-shirt T moves away from the door main body 210), and once the T-shirt T has been transported to the far side (the side to which the T-shirt T moves away from the door main body 210) of the position in which the barrier member 222 is disposed when the door main body 210 is closed, as shown in FIG. 16(*c*), the door main body 210 is closed (the third control, step S3). Note that the processing subject sensor 409 attached to the moving plate 416R of the front-rear direction moving mechanism 408 provided in the transportation device 400 is used to confirm that the T-shirt T has been transported to the far side of the position of the barrier member 222. Further, the processing subject sensor 409 is attached to the moving plate 416R so as to be capable of moving in the front-rear direction, and therefore, by adjusting a front-rear position of the processing subject sensor 409, the processing subject sensor 409 can estimate a volume of the processing subject T. Alternatively, it may be determined that the T-shirt has been transported to the far side when the transportation conveyor 204 has been rotated in the forward direction continuously for a predetermined time (timer control). When the door main body 210 is closed, the barrier member 222 is disposed directly above (in the vicinity of the surface of) the transportation conveyor 204.

Figure 17:
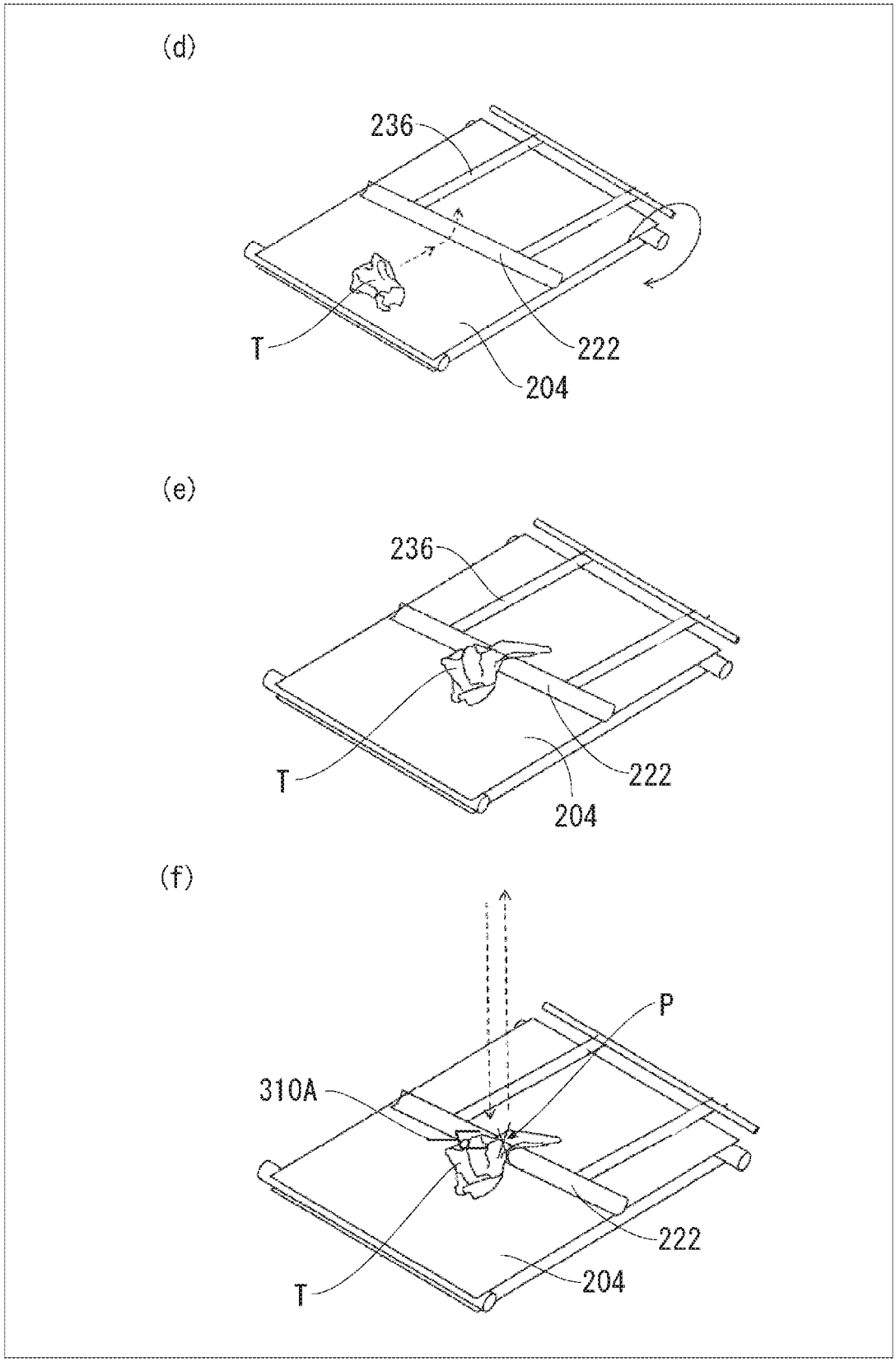
FIG. 17 is a view illustrating the T-shirt processing operation performed by the processing apparatus shown in FIG. 1.

Next, as shown in FIG. 17(*d*), the transportation conveyor 204 is rotated in the reverse direction (a direction in which the T-shirt T approaches the door main body 210) (the fourth control, step S4). Accordingly, the T-shirt T moves toward the concave surface of the barrier member 222. As a result, the T-shirt T moved by the transportation conveyor 204 is lifted onto the barrier member 222 (for example, the processing subject sensor 409 or the imaging device 500, which are oriented toward the upper side of the barrier member 222, can be used to determine that the T-shirt T has been lifted onto the barrier member 222). When the T-shirt T is lifted onto the barrier member 222, the first point detection unit 920 detects the part of the T-shirt T directly above the barrier member 222 as the first point P (first point detection process, step S5). When the first point P is detected, as shown in FIG. 17(*e*), the transportation conveyor 204 is stopped (the fifth control, step S6). Note that the transportation conveyor 204 may be stopped as soon as the T-shirt T is determined to have crossed a top portion of the barrier member 222. In so doing, the T-shirt T can be set in a condition extending upward at an incline from the top portion of the barrier member 222 more easily, and as a result, the first point P can be retained by the retaining mechanisms 310A, 310B more easily than after the T-shirt T has passed over the barrier member entirely.

Next, as shown in FIG. 17(*f*), the retaining mechanism 310A retains the detected first point P. More specifically, the pair of finger members 322A approach each other in response to an operation of the linear actuator 324 provided in the retaining mechanism 310A (at this time, the rotary actuator 326A holds the finger members 322A in a substantially horizontal orientation). When the pair of finger members 322A approach each other, the gripping members 328A attached to the respective tip end portions of the two finger members 322A approach each other so as to retain (grip) the first point P of the T-shirt T. After retaining the first point P, the retaining mechanism 310A lifts up the T-shirt T until the first point P reaches a higher position than the carrying plate 402, which is slightly tilted from the horizontal condition, whereby a condition shown in FIG. 18(*g*) is obtained (the sixth control, step S7). The reason why the carrying plate 402 is slightly tilted from the horizontal condition is to prevent the T-shirt T from sliding off. The incline of the carrying plate 402 is preferably set between 0 and 80 degrees relative to the vertical direction, for example, and more preferably between 30 and 80 degrees relative to the vertical direction so that the retaining mechanisms (310A, 310B) and the carrying plate 402 do not interfere with each other when the lowermost point of the T-shirt T is retained. At a point during the process for lifting up the T-shirt T, the rotary actuator 326A orients the finger members 322A vertically downward. Note that when a plurality of processing subjects T are inserted into the processing apparatus 1 simultaneously, one of the processing subjects T is lifted up, whereupon the transportation conveyor 204 is rotated in the forward direction again in order to transport the remaining processing subject T in the forward direction. When folding of the lifted processing subject T is complete, the routine returns to step S4 in order to lift up the next processing subject T to be folded, whereby the transportation conveyor 204 is rotated in the reverse direction and the processing subject T is moved toward the concave surface of the barrier member 222.

[Recognition Process (FIG. 13)]

Next, the recognition process will be described. At this stage, the control device 900 has not yet recognized the processing subject as a T-shirt. In a type recognition process (FIG. 13, step S14-2) to be described below, the type recognition unit 914 recognizes the type of the processing subject on the basis of the feature amounts that can be determined from the outer appearance of the T-shirt T (whereby the T-shirt T is recognized as a "T-shirt", and not as "slacks", a "towel", or a "skirt", for example). To enable the imaging device 500 to photograph distinguishing sites of the T-shirt T during the type recognition process, and also to facilitate the subsequent folding process, it is necessary to unfurl (deploy) the lifted T-shirt T (FIG. 19(*g*)). In this embodiment, the processing subject is recognized as the T-shirt T only when the processing subject is unfurled while the ends of respective sleeve openings of the T-shirt T are retained by the retaining mechanisms 310A, 3106, as shown in FIG. 19(*j*). This unfurling operation will now be described using FIGS. 18(*h*) to 19(*j*).

Figure 18:
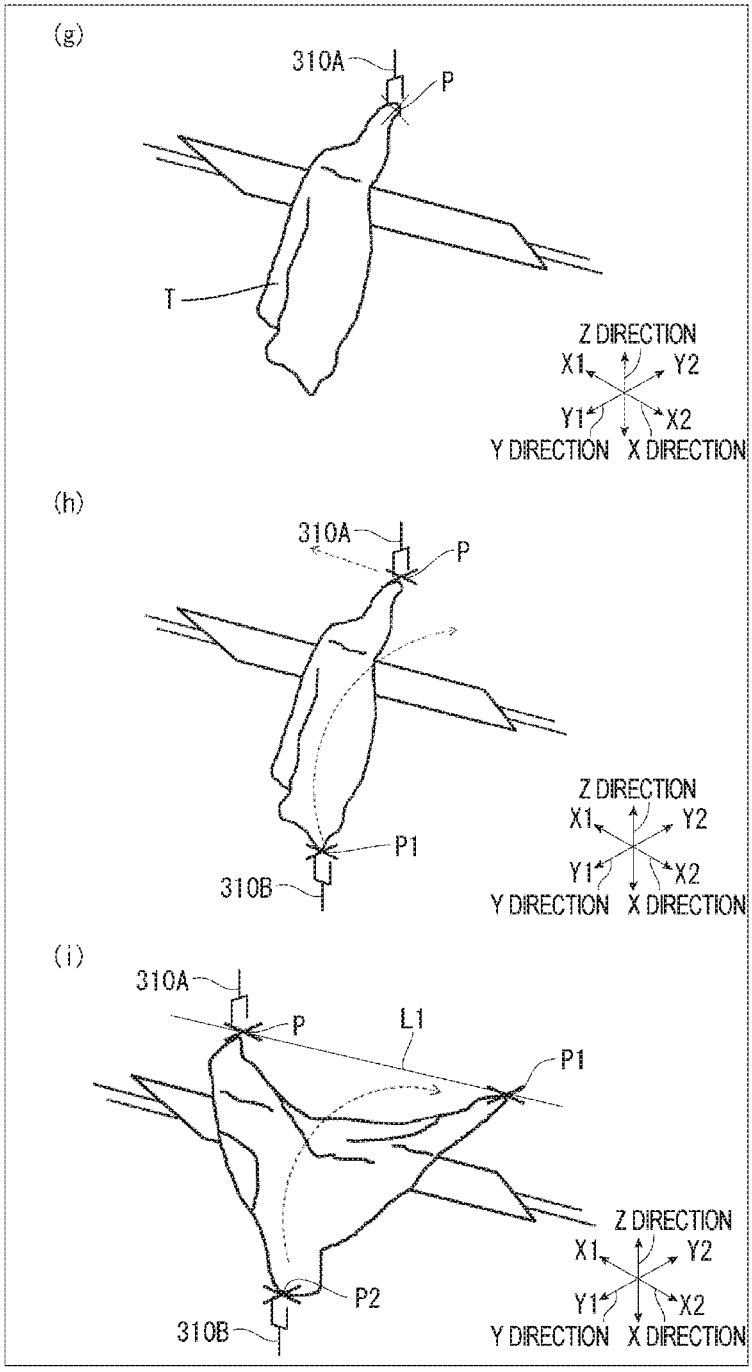
FIG. 18 is a view illustrating the T-shirt processing operation performed by the processing apparatus shown in FIG. 1.
Figure 19:
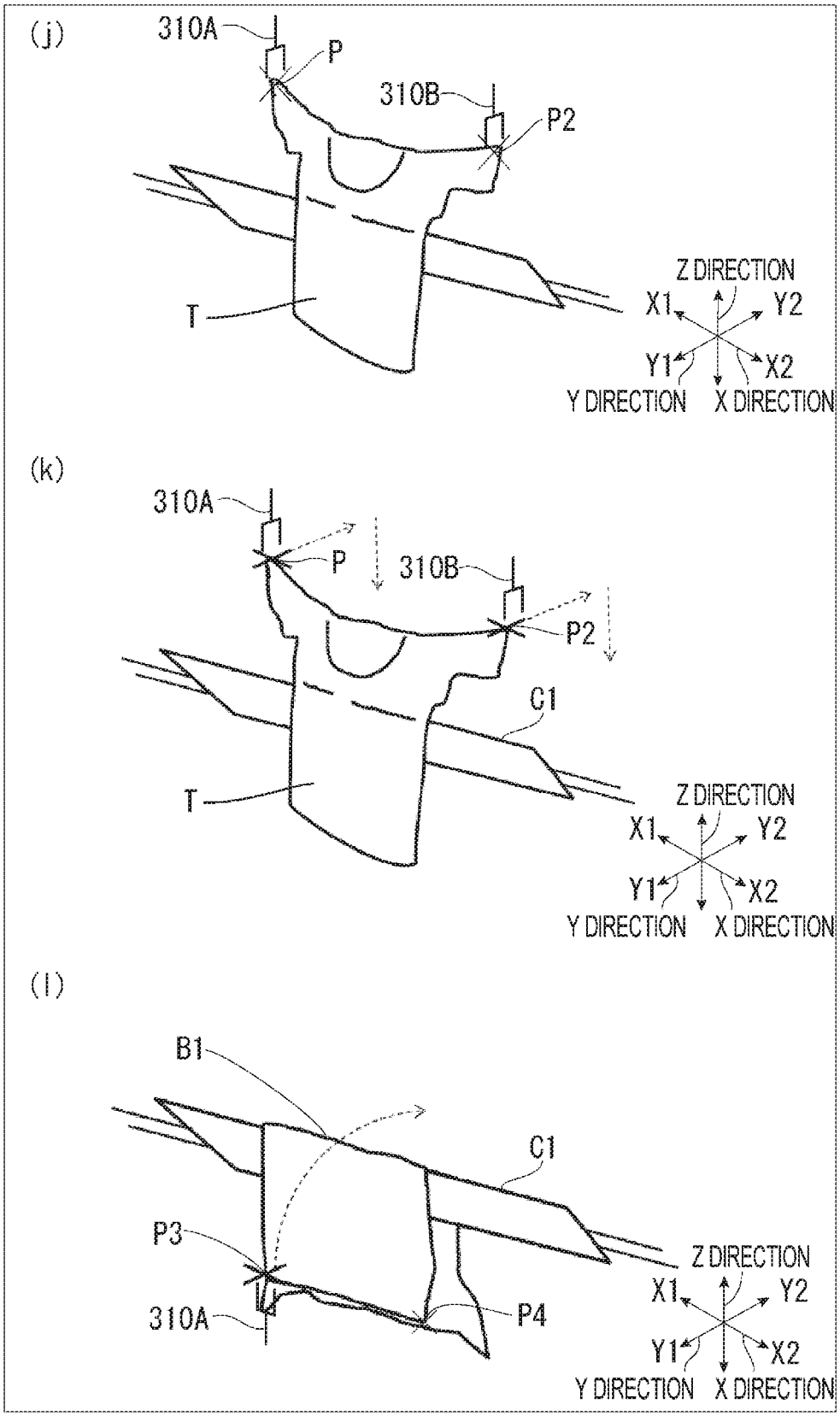
FIG. 19 is a view illustrating the T-shirt processing operation performed by the processing apparatus shown in FIG. 1.

First, as shown in FIG. 18(*h*), the imaging device 500 obtains image data showing the T-shirt T lifted up by the first point P, and transmits the image data to the control device 900. The first end point detection unit 922 detects the first end point P1 on the basis of the image data transmitted to the control device 900 (first end point detection process, step S8). More specifically, the first end point detection unit 922 detects the lowermost point (the point in the lowest position) of the T-shirt T lifted up by the first point P, and sets the lowermost point as the first end point P1. Here, when the T-shirt T is long, the position of the lowermost point may be so low that the lowermost point is not included in the image data. Therefore, when the first end point detection unit 922 determines that the lowermost point does not appear in the image data, the retaining device control unit 904 moves the retaining mechanism 310A retaining the first point P horizontally in the direction approaching the door 202 (the direction of the arrow Y2). When the retaining mechanism 310A is moved in this manner, the length by which the T-shirt T hangs from the carrying plate 402 is reduced. As a result, the lowermost point of the T-shirt T can be included in the image data even when the T-shirt T is long.

Next, the retaining mechanism 310B retains the detected first end point P1 (the seventh control, step S9). At this time, the rotary actuator B holds the finger members 322B of the retaining mechanism 310B vertically upward. Next, the retaining mechanism 310A moves horizontally in the rightward direction (the direction of the arrow X1) while retaining the first point P, and the retaining mechanism 310B lowers the first end point P1 to the same height as the first point P (the eighth control, step S10). At a point during the process by which the retaining mechanism 310B lifts up the first end point P1, the rotary actuator 326B orients the finger members 322B vertically downward.

Next, as shown in FIG. 18(*i*), the imaging device 500 obtains image data showing the T-shirt T with the first end point P1 and the first point P lifted up to the same height, and transmits the image data to the control device 900. The second end point detection unit 924 detects the second end point P2 on the basis of the image data transmitted to the control device 900 (second end point detection process, step S11). More specifically, the second end point detection unit 924 sets the lowermost point of the processing subject T in a condition where the first point P and the first end point P1 are retained at equal heights by the respective retaining mechanisms 310A, 310B as the second end point P2. In other words, the point furthest away from the straight line L1 linking the first point P to the first end point P1 is detected as the second end point P2. Here, when the T-shirt T is wide, the position of the lowermost point may be so low that the lowermost point is not included in the image data. Therefore, when the second end point detection unit 924 determines that the lowermost point does not appear in the image data, the retaining device control unit 904 moves the retaining mechanism 310A retaining the first point P and the retaining mechanism 310B retaining the first end point P1 horizontally in the direction approaching the door 202 (the direction of the arrow Y2). When the two retaining mechanisms 310A, 310B are moved in this manner, the length by which the T-shirt T hangs from the carrying plate 402 is reduced. As a result, the lowermost point of the T-shirt T can be included in the image data even when the T-shirt T is wide. Once the second end point P2 has been detected by the second end point detection unit 924, the retaining mechanism 310B retaining the first end point P1 releases the first end point P1 and then retains the second end point P2 (the ninth control, step S12). Note that at this time, the rotary actuator B holds the finger members 322B of the retaining mechanism 310B vertically upward.

Next, as shown in FIG. 19(*j*), the retaining mechanism 310B retaining the second end point P2 lifts up the second end point P2 to the same height as the first point P. At a point during the process by which the retaining mechanism 310B lifts up the first end point P1, the rotary actuator 326B orients the finger members 322B vertically downward. Further, the carrying plate 402 is rotated in the forward direction (the tenth control, step S13). As a result, the T-shirt T hangs down on the far side of the carrying plate 402 (in the direction of the arrow Y1) so that the length of the T-shirt T extends in the vertical direction. In other words, the retaining mechanism 310A and the retaining mechanism 310B respectively retain the sleeves of the T-shirt T.

Next, in this condition, the length detection unit 915 measures a longitudinal direction length (the length) and a lateral direction length (the width) of the T-shirt T on the basis of the image data obtained from the imaging device 500, and stores the measurement results temporarily in the RAM or the like of the control device 900 (length measuring process, step S14-1).

Next, the type recognition unit 914 recognizes the type of the T-shirt T on the basis of the image data obtained from the imaging device 500 (type recognition process, step S14-2). More specifically, the feature amounts of the T-shirt T are calculated from the image data. The feature amounts include all elements that can be grasped from the outer appearance of the T-shirt T, such as the shape and overall length of the T-shirt T, and patterns, colors, and the like on the surface thereof. After calculating the feature amounts of the T-shirt T, the type recognition unit 914 recognizes the type of the processing subject T using a randomized forest recognition device created in advance for each feature amount. When the type recognition process is complete, the type recognition unit 914 obtains the "folding information" corresponding to the type (in this embodiment, a T-shirt). The "folding information" for the T-shirt T includes the "position information indicating the horizontal fold line B1", which is required to fold the T-shirt T in two in the length direction, and the "position information indicating the first fold line B2" and the "position information indicating the second fold line B3", which are required to fold the T-shirt T in three in the width direction.

Note that in the case described in this embodiment, the first point P is located on the sleeve portion of the T-shirt T, and therefore the T-shirt T is unfurled to a condition in which the retaining mechanisms 310A, 310B retain the respective ends of the sleeve openings of the T-shirt T in a minimum amount of time. However, the first point P may be any part of the T-shirt T. Depending on the initial position of the first point P and the condition in which the T-shirt T is carried, the respective ends of the sleeve openings of the T-shirt T may not be retained by the retaining mechanisms 310A, 310B at the stage where the second end point is retained. According to this embodiment, the type recognition unit 914 cannot recognize the T-shirt T as a "T-shirt" in such a case (a case where the respective ends of the sleeve openings of the T-shirt T are not retained by the retaining mechanisms 310A, 310B). Therefore, the processing apparatus 1 switches the lowermost point of the T-shirt T using the retaining mechanisms 310A, 310B several more times until the respective ends of the sleeve openings of the T-shirt T are retained by the retaining mechanisms 310A, 310B (until the type recognition unit 914 recognizes the T-shirt T as a "T-shirt").

[Folding Process (FIG. 14)]

Next, as shown in FIG. 19(*k*), the retaining mechanism 310A retaining the first point P and the retaining mechanism 310B retaining the second end point P2 are moved horizontally in the door direction (the direction of the arrow Y2). The retaining mechanism 310A then releases the first point P. Further, the retaining mechanism 310B releases the second end point P2 (the eleventh control, hanging length detection process, step S15). More specifically, the previously obtained information relating to the T-shirt T includes the position of the lateral fold line B1 of the T-shirt T. In the case of the T-shirt T, the lateral fold line B1 is set in a position exactly halfway along the length direction. In the eleventh control, the two retaining mechanisms 310A, 310B are moved horizontally in the door direction (the direction of the arrow Y2) until the lateral fold line B1 is aligned with the upper side edge line (the first edge line C1) of the carrying plate 402, which is set at an angle from the horizontal condition. As a result, a lower edge side (a lower portion) of the T-shirt T is oriented toward the side of the first imaging unit 502 attached to the inner surface of the back surface 106B of the processing apparatus 1. The hanging length detection unit 916 of the control device 900 determines whether or not the lateral fold line B1 is aligned with the first edge line C1. More specifically, having received the image data captured continuously by the first imaging unit 502 of the imaging device 500, the hanging length detection unit 916 successively checks the hanging length from the first edge line C1 of the carrying plate 402 to the lower end (the lower edge) of the T-shirt T. As described above, the lateral fold line B1 of the T-shirt T is set in a position exactly halfway along the length of the T-shirt T, and therefore the retaining device control unit 904 stops the horizontal movement of the retaining mechanisms 310A, 310B upon reception of a signal from the hanging length detection unit 916 indicating that the hanging length has reached a length corresponding to half the length of the T-shirt T.

Next, as shown in FIG. 19(*l*), the imaging device 500 obtains image data showing the T-shirt T hanging down from the carrying plate 402, and transmits the image data to the control device 900. The third end point detection unit 926 then detects the third end point P3 on the basis of the image data transmitted to the control device 900 (third end point detection process, step S16). Further, the fourth end point detection unit 928 detects the fourth end point P4 on the basis of the same image data transmitted to the control device 900 (fourth end point detection process, step S17). Note that the fourth end point detection process may be implemented during the thirteenth control performed in step S19, to be described below. To describe the third end point detection process more specifically, the third end point detection unit 926 detects the lower corner portion on the right side (the direction of the arrow X1) of the lower edge side of the T-shirt T while the T-shirt T hangs down from the carrying plate 402, and sets this corner portion as the third end point P3. Further, to describe the fourth end point detection process more specifically, the fourth end point detection unit 928 detects the lower corner portion on the left side (the direction of the arrow X2) of the lower edge side of the T-shirt T while the T-shirt T hangs down from the carrying plate 402 on the basis of the image data, and sets this corner portion as the fourth end point P4. Once at least the third end point P3 has been detected, the retaining mechanism 310A retains the third end point P3 (the twelfth control, step S18). Note that at this time, the rotary actuator 326A holds the finger members 322A of the retaining mechanism 310A vertically upward.

Figure 20:
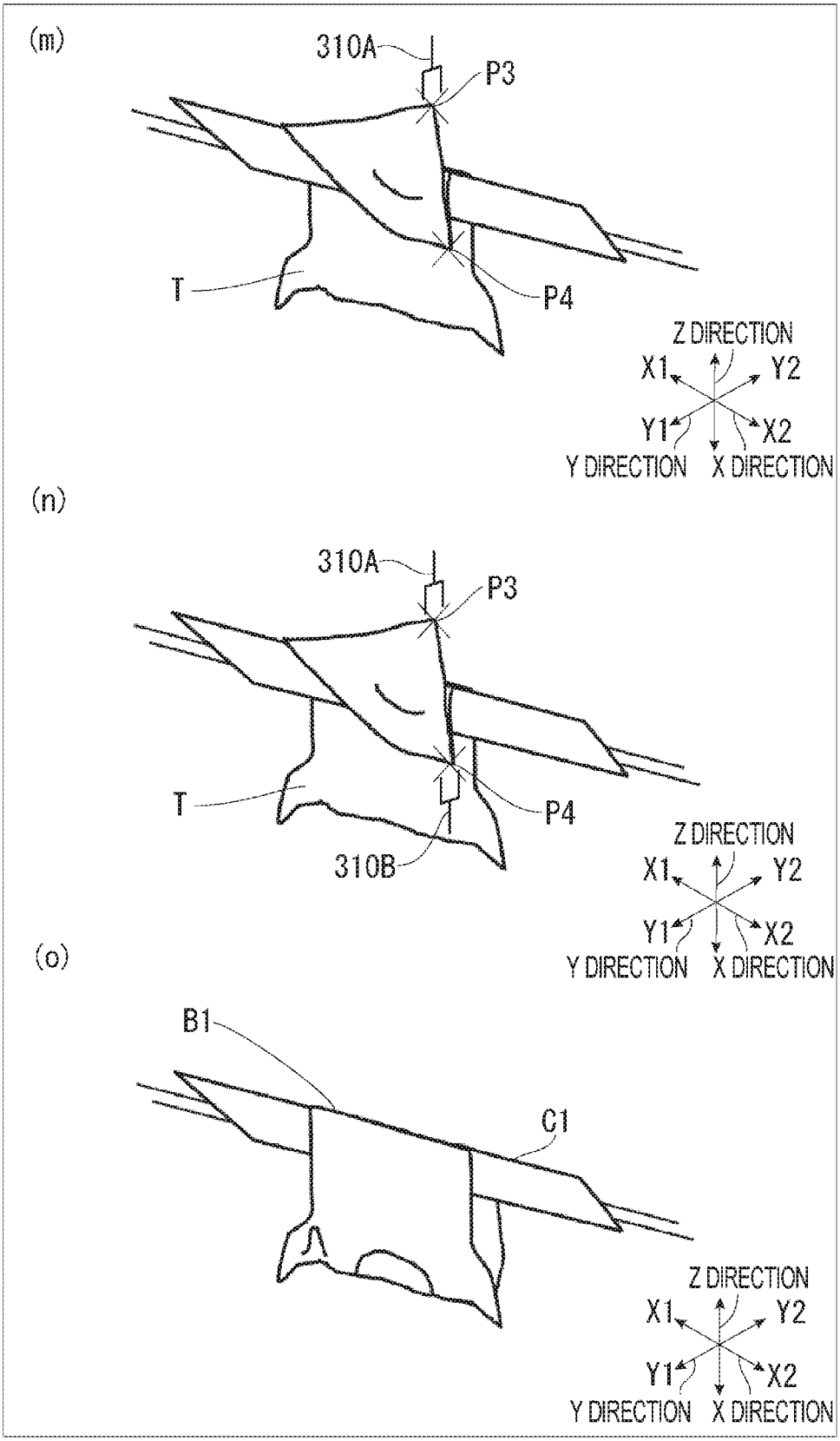
FIG. 20 is a view illustrating the T-shirt processing operation performed by the processing apparatus shown in FIG. 1.

Next, as shown in FIG. 20(*m*), the retaining mechanism 310A retaining the third end point P3 moves the third end point P3 directly above the fourth end point P4 (the thirteenth control, step S19). More specifically, the retaining mechanism 310A moves upward and to the left (in the direction of the arrow X2) while retaining the third end point P3. As a result, the third end point P3 is moved directly above the fourth end point P4. Note that at a point during the process by which the retaining mechanism 310A lifts up the third end point P3, the rotary actuator 326A orients the finger members 322A vertically downward.

Next, as shown in FIG. 20(*n*), the retaining mechanism 310B retains the fourth end point P4 (the fourteenth control, step S20). More specifically, the rotary actuator 326B of the retaining mechanism 310B orients the finger members 322B upward. With the finger members 322B oriented upward, the retaining mechanism 310B retains the fourth end point P4 from the lower edge of the T-shirt T.

Next, as shown in FIG. 20(*o*), the retaining mechanism 310B lifts up the fourth end point P4 to the same height as the third end point on the right side (the direction of the arrow X1) of the third end point P3. At this time, the rotary actuator 326 of the retaining mechanism 310B is operated to orient the finger members 322 downward. Next, the carrying plate 402 is rotated in the forward direction (the rotary shaft 412 rotates counterclockwise when seen from the left side surface 102D). As a result, the front and back of the T-shirt T are reversed. More specifically, upon completion of step S20, the back surface of the T-shirt T opposes the first imaging unit 502, whereas in the preceding operations, the front surface of the T-shirt T opposed the first imaging unit 502. After reversing the front and back of the T-shirt T, the retaining mechanism 310A retaining the third end point P3 and the retaining mechanism 310B retaining the fourth end point P4 are moved horizontally in the door direction (the direction of the arrow Y2). Next, the retaining mechanism 310A releases the third end point P3. Further, the retaining mechanism 310B releases the fourth end point P4 (the fifteenth control, the hanging length detection process, step S21). More specifically, similarly to step S15, the two retaining mechanisms 310A, 310B are moved horizontally in the door direction (the direction of the arrow Y2) until the lateral fold line B1 is aligned with the upper side edge line (the first edge line C1) of the carrying plate 402, which is set at an angle from the horizontal condition. As a result, a collar side (an upper portion) of the T-shirt T is oriented toward the side of the first imaging unit 502 attached to the inner surface of the back surface 106B of the processing apparatus 1. The hanging length detection unit 916 of the control device 900 determines whether or not the lateral fold line B1 is aligned with the first edge line C1. More specifically, having received the image data captured continuously by the first imaging unit 502 of the imaging device 500, the hanging length detection unit 916 successively checks the hanging length from the first edge line of the carrying plate 402 to the lower end (the collar) of the T-shirt T. As described above, the lateral fold line B1 of the T-shirt T is set in a position exactly halfway along the length of the T-shirt T, and therefore the hanging length detection unit 916 stops the horizontal movement of the two retaining mechanisms 310A, 310B after detecting that the hanging length has reached a length corresponding to half the length of the T-shirt T.

Figure 21:
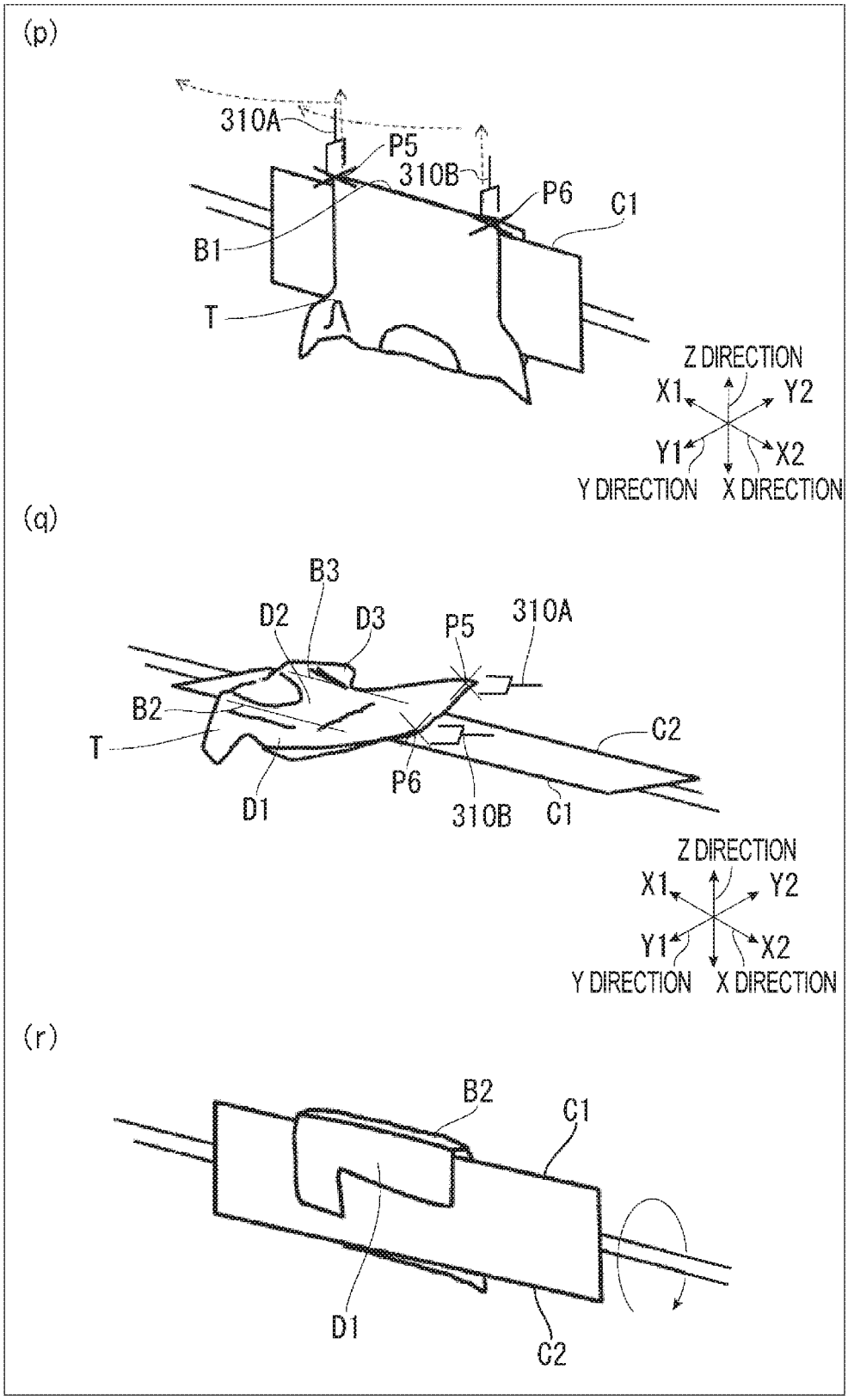
FIG. 21 is a view illustrating the T-shirt processing operation performed by the processing apparatus shown in FIG. 1.

Next, as shown in FIG. 21(*p*), the imaging device 500 obtains image data showing the T-shirt T hanging down from the carrying plate 402, and transmits the image data to the control device 900. The fifth end point detection unit 930 then detects the fifth end point P5 on the basis of the image data transmitted to the control device 900 (fifth end point detection process, step S22). Further, the sixth end point detection unit 932 detects the sixth end point P6 on the basis of the same image data transmitted to the control device 900 (sixth end point detection process, step S23). More specifically, on the basis of the image data from the first imaging unit 502 and the second imaging unit 504, the fifth end point detection unit 930 detects the upper corner portion on the right side (the direction of the arrow X1) of the T-shirt T in a condition where the carrying plate 402 is set at a predetermined angle from the horizontal condition and the T-shirt T hangs down over the carrying plate 402 such that the lateral fold line B1 is aligned with the upper side edge line (the first edge line C1) of the carrying plate 402, and sets the right side upper corner portion as the fifth end point P5. Further, the sixth end point detection unit 932 detects the upper corner portion on the left side (the direction of the arrow X2) of the T-shirt T on the basis of the image data from the first imaging unit 502 and the second imaging unit 504, and sets the left side upper corner portion as the sixth end point P6.

Furthermore, the carrying plate 402 is rotated to the vertical condition, whereupon the retaining mechanism 310A retains the fifth end point P5. Further, the retaining mechanism 310B retains the sixth end point P6 (the sixteenth control, step S24). More specifically, the rotary actuator 326A of the retaining mechanism 310A is operated to cause the finger members 322A to retain the fifth end point P5 while oriented downward. Further, the rotary actuator 326B of the retaining mechanism 310B is operated to cause the finger members 322B to retain the sixth end point P6 while oriented downward.

Next, as shown in FIG. 21(*q*), the respective retaining mechanisms 310A, 310B lift the T-shirt T above the carrying plate 402 while retaining the fifth end point P5 and the sixth end point P6. The carrying plate 402 is then rotated so as to be held horizontally. Next, the respective retaining mechanisms 310A, 310B move the fifth end point P5 and the sixth end point P6 to the right (in the direction of the arrow X1) of the carrying plate 402. Further, the respective retaining mechanisms 310A, 310B move so that the fifth end point P5 and the sixth end point P6 are arranged side by side in the front-rear direction (the direction of the arrow Y) on the right of the carrying plate 402. Here, the edge line on the far side (the direction of the arrow Y1) of the horizontal carrying plate 402 will be referred to as the first edge line C1, while the edge line on the door side (the direction of the arrow Y2) of the carrying plate 402 will be referred to as a second edge line C2. When the fifth end point P5 and the sixth end point P6 are arranged side by side in the front-rear direction (the direction of the arrow Y), the retaining mechanisms 310A, 310B set the positions of the fifth end point P5 and the sixth end point P6 such that an imaginary vertical plane including the first edge line C1 of the carrying plate 402 includes the first fold line B2 of the T-shirt T. Note that the during the movements performed up to this point, the retaining mechanisms 310A, 310B move such that a distance between the fifth end point P5 and the sixth end point P6 remains constant at all times.

Next, the respective retaining mechanisms 310A, 310B move downward while moving in a leftward direction (the direction of the arrow X2). As a result, the lower end portion (the collar side) of the T-shirt T is placed on the upper surface of the horizontal carrying plate 402 (the seventeenth control, step S25). Note that at this time, the finger members 322A, 322B of the respective retaining mechanisms 310A, 310B are held in a horizontal lateral orientation by the rotary actuators 326A, 326B. As described above, the length and width of the T-shirt T are measured by the length detection unit 915, and therefore the T-shirt T can be positioned such that the first fold line B2 of the T-shirt T is included in the vertical plane including the first edge line C1 of the carrying plate 402. Hence, when the T-shirt T is placed on the upper surface of the carrying plate 402, the first fold line B2 of the T-shirt T is aligned with the first edge line C1 of the carrying plate 402.

Next, the retaining mechanism 310A releases the fifth end point P5. Further, the retaining mechanism 310B releases the sixth end point P6 (the eighteenth control, step S26).

Next, as shown in FIG. 21(*r*), the carrying plate 402 is rotated in the reverse direction (the rotary shaft 412 is rotated clockwise when seen from the left side surface 102D) until oriented vertically (the nineteenth control, step S27). As a result, the T-shirt T is hung over the carrying plate 402 such that the first fold line B2 is aligned with the first edge line C1 of the carrying plate 402. In this condition, the first end part D1 of the T-shirt T hangs down on the far side (the direction of the arrow Y1) of the carrying plate 402. Further, the central part D2 and the second end part D3 of the T-shirt T hang down on the door side (the direction of the arrow Y2) of the carrying plate 402.

Figure 22:
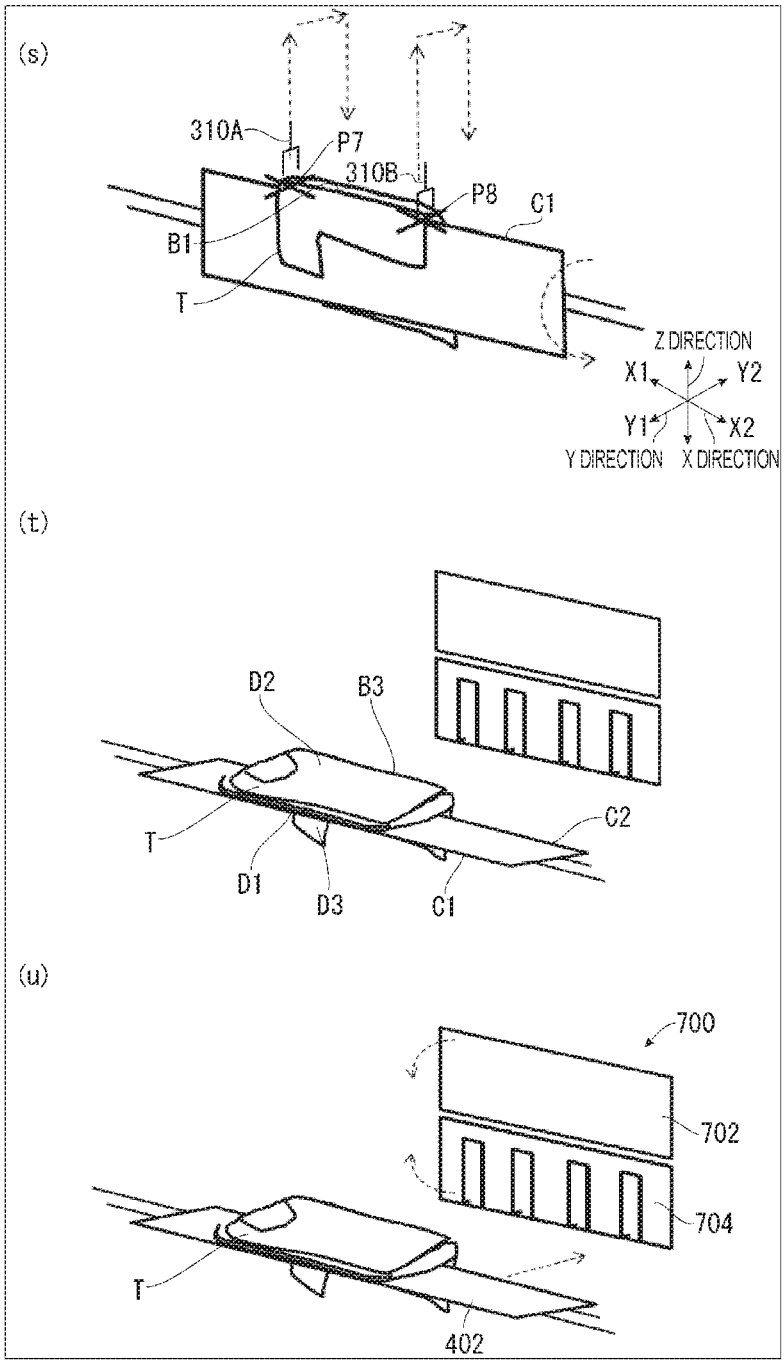
FIG. 22 is a view illustrating the T-shirt processing operation performed by the processing apparatus shown in FIG. 1.

Next, as shown in FIG. 22(*s*), the imaging device 500 obtains image data showing the T-shirt T hung over the carrying plate 402, and transmits the image data to the control device 900. The seventh end point detection unit 934 then detects the seventh end point P7 on the basis of the image data transmitted to the control device 900 (seventh end point detection process, step S28). Further, the eighth end point detection unit 936 detects the eighth end point P8 on the basis of the same image data transmitted to the control device 900 (eighth end point detection process, step S29). More specifically, on the basis of the image data from the first imaging unit 502 and the second imaging unit 504, the seventh end point detection unit 934 detects the upper corner portion on the right side (the direction of the arrow X1) of the T-shirt T in a condition where the T-shirt T is hung over the vertical carrying plate 402 such that the first fold line B2 of the processing subject T is aligned with the upper side edge line (the first edge line C1) of the carrying plate 402, and sets this corner portion as the seventh end point P7. Further, the eighth end point detection unit 936 detects the upper corner portion on the left side (the direction of the arrow X2) of the T-shirt T on the basis of the image data from the first imaging unit 502 and the second imaging unit 504, and sets this corner portion as the eighth end point P8.

Next, the retaining mechanism 310A retains the seventh end point P7. Further, the retaining mechanism 310B retains the eighth end point P8. More specifically, the rotary actuator 326A of the retaining mechanism 310A is operated to cause the finger members 322A to retain the seventh end point P7 while oriented downward. Further, the rotary actuator 326B of the retaining mechanism 310B is operated to cause the finger members 322B to retain the eighth end point P8 while oriented downward.

Next, the respective retaining mechanisms 310A, 310B lift the T-shirt T away from the carrying plate 402 while retaining the seventh end point P7 and the eighth end point P8. The carrying plate 402 is then rotated in the forward direction until horizontal (the twentieth control, step S30).

Next, as shown in FIG. 22(*t*), the respective retaining mechanisms 310A, 310B place the T-shirt T on the horizontal carrying plate 402 (the twenty-first control, step S31). More specifically, the retaining mechanisms 310A, 310B move horizontally in the door direction (the direction of the arrow Y2) so as to position the T-shirt T on the door side of the carrying plate 402. Next, the retaining mechanisms 310A, 310B move in the far side direction (the direction of the arrow Y1) while lowering the T-shirt T. As a result, the T-shirt T is placed on the carrying plate 402 such that the central part D2 thereof overlaps the first end part D1. A fold between the first end part D1 and the central part D2 matches the first fold line B2 of the T-shirt T. Further, as described above, the length and width of the T-shirt T are measured by the length detection unit 915, and therefore the retaining mechanisms 310A, 310B can place the T-shirt T such that the second fold line B3 of the T-shirt T is aligned with the second edge line C2 serving as the edge line of the carrying plate 402 in the door direction (the direction of the arrow Y2) on the basis of positional relationships thereof relative to the carrying plate 402. At this time, the second edge line C2 hangs down from the carrying plate 402.

Next, as shown in FIG. 22(*u*), the carrying plate 402 is moved horizontally to the vicinity of the clamping device 700 while carrying the T-shirt T such that the second edge line C2 of the carrying plate 402 is aligned with the second fold line B3. When the carrying plate 402 carrying the T-shirt T approaches, the upper side clamping plate 702 and the lower side clamping plate 704 are rotated in a mutually approaching direction. More specifically, the upper side clamping plate 702 rotates from a vertically upward orientation to a horizontal orientation, while the lower side clamping plate 704 rotates from a vertically downward orientation to a horizontal orientation. Eventually, the T-shirt T and the carrying plate 402 are clamped between the rotated upper and lower side clamping plates 702, 704 (the twenty-second control, step S32). The second end part D3 of the T-shirt T, which hangs down from the carrying plate 402, is lifted up by the lower side clamping plate 704. As a result, the second end part D3 is folded along the second fold line B3. In this condition, the carrying plate 402 is interposed between the central part D2 (the first end part D1) and the second end part D3 of the T-shirt T.

Figure 23:
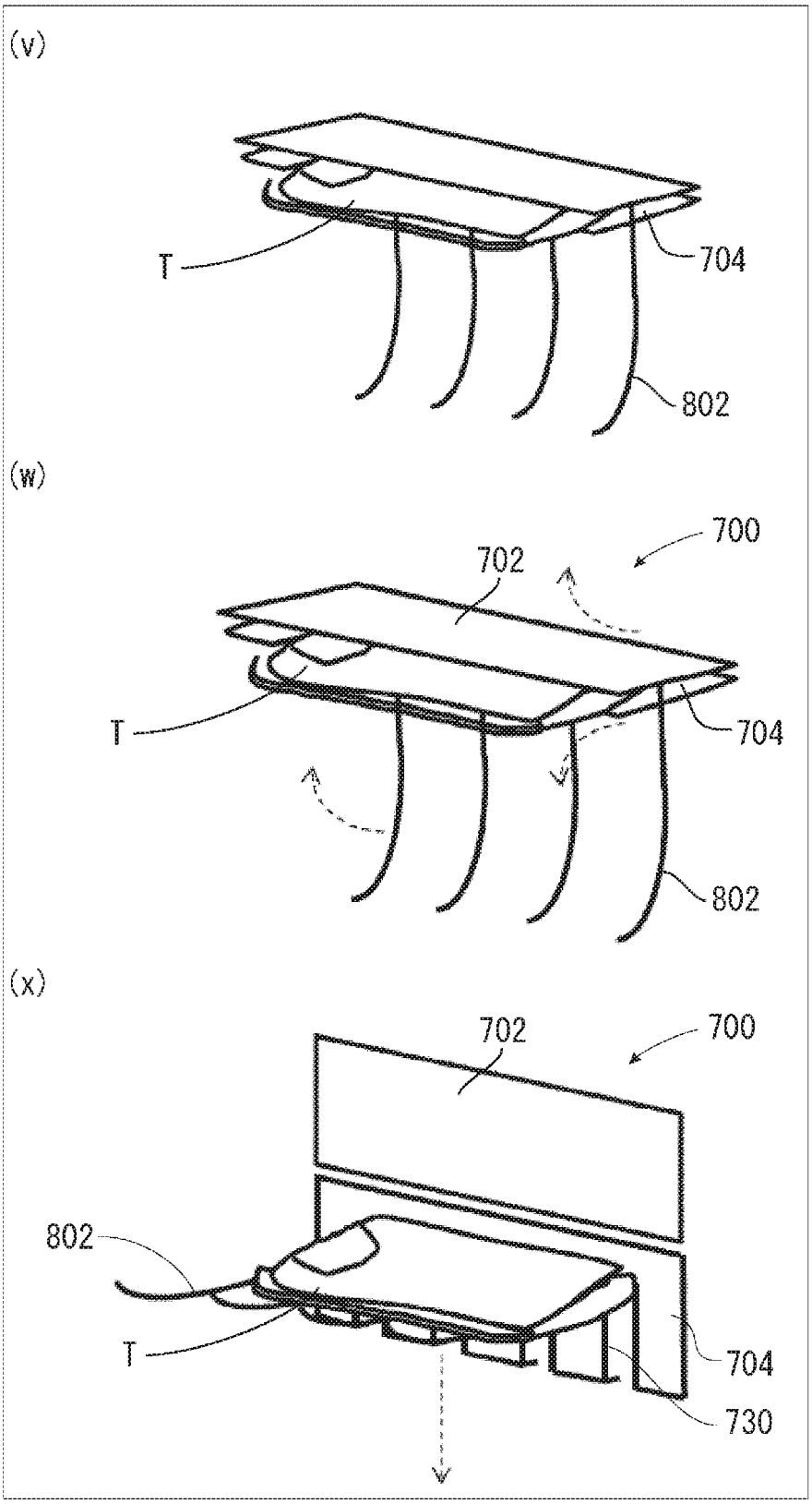
FIG. 23 is a view illustrating the T-shirt processing operation performed by the processing apparatus shown in FIG. 1.
Figure 24:
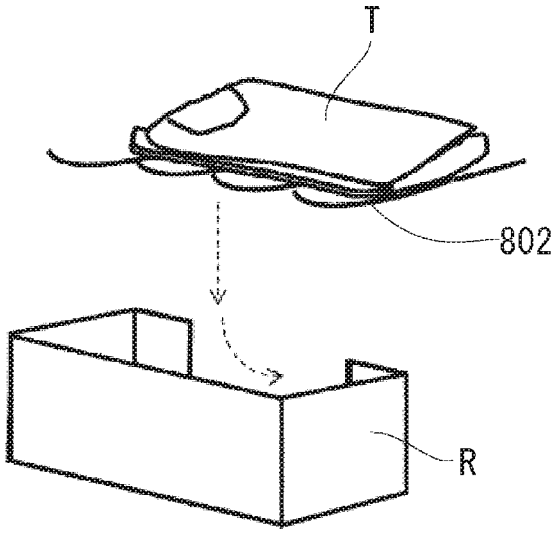
FIG. 24 is a view illustrating the T-shirt processing operation performed by the processing apparatus shown in FIG. 1.

Next, as shown in FIG. 23(*v*), the carrying plate 402 is moved away from the clamping device 700 (the twenty-third control, step S33). As a result, only the T-shirt T is clamped by the clamping device 700. Further, the clamped T-shirt T is folded in two in the length direction along the lateral fold line B1, and folded in three in the width direction along the first fold line B2 and the second fold line B3.

[Transportation Process (FIG. 15)]

Next, as shown in FIG. 23(*w*), the support 802 is elevated to its upper limit. Further, the support shaft 810 is rotated such that the support members 808 shift from a vertically downward orientation to a horizontal orientation. As the support shaft 810 rotates, the upper side clamping plate 702 and lower side clamping plate 704 of the clamping device 700 rotate so as to release the T-shirt T. In other words, the upper side clamping plate 702 rotates to a vertically upward orientation, while the lower side clamping plate 704 rotates to a vertically downward orientation (the twenty-fourth control, step S34). As a result, the released T-shirt T is placed on the support members 808 below the clamping device 700. Note that the support members 808 are inserted into the slits 730 provided in the lower side clamping plate 704, and therefore the support members 808 and the lower side clamping plate 704 do not interfere with each other even when the transportation device 800 is provided directly below the clamping device 700. Hence, the T-shirt T can be placed on the support members 808 after being released from the clamping device 700 without losing its shape.

Next, as shown in FIG. 23(*x*), the support 802 is lowered while maintaining the support members 808 in a horizontal condition (the twenty-fifth control, step S35). Once the support 802 has been lowered to the vicinity of the processing subject reception box R provided on the door 202, lowering of the support 802 is stopped and the support members 808 are rotated to a vertically downward orientation (the twenty-sixth control, step S36). As a result, the T-shirt T slides down from the support member 808 and is stored in the processing subject reception box R without losing its shape (see FIG. 24(*y*)).

By repeating steps S1 to S36, folded T-shirts T can be stacked in the processing subject reception box R.

[Features of Processing Apparatus 1]

(1) In the processing apparatus 1 according to this embodiment, the retaining devices 300A, 300B for retaining the processing subject T and the carrying plate 402 provided to be capable of rotating and carrying the processing subject T are controlled in combination with each other (the tenth control and the fifteenth control, for example). Therefore, when the processing subject T is moved from a first side (the door side, for example) to a second side (the far side, for example) of the carrying plate 402, there is no need to lift the entire processing subject T above the carrying plate 402 or move the entire processing subject T by a large amount in the front-rear direction (the direction of the arrow Y). In other words, when the upper portion of the processing subject T has been moved to the first side of the carrying plate 402 but the lower portion of the processing subject T is still on the second side of the carrying plate 402, the lower portion of the processing subject T remaining on the second side can be hoisted up and moved to the first side by rotating the carrying plate 402 toward the first side. As a result, the processing apparatus 1 can be made more compact in terms of both a height direction dimension and a front-rear direction dimension even when the processing subject T is long.

(2) In the processing apparatus 1 according to this embodiment, when the lowermost point of the processing subject T is not included in the image data during the processing for detecting the first end point P1 and the second end point P2 (the seventh control and the ninth control), the processing subject T is pulled horizontally over the carrying plate 402 to the opposite side rather than lifting up the processing subject T even further. In so doing, the position of the lowermost point of the processing subject T can be elevated. Moreover, in so doing, space for lifting up the processing subject T even further is not required, and therefore the height dimension of the processing apparatus 1 can be made more compact.

(3) In the processing apparatus 1 according to this embodiment, the processing subject T is folded using the two edge lines (the first edge line C1 and the second edge line C2) of the carrying plate 402, and therefore the processing subject T can be folded neatly in two or in three. Note that the method of folding the processing subject T is not limited to that described above, and the processing subject T may be folded in four, or folds may be formed in specific positions in accordance with the shape of the processing subject T.

(4) In the processing apparatus 1 according to this embodiment, by providing the carrying plate 402, operations can be performed with the processing subject T hung over the carrying plate 402. Therefore, when the retaining mechanism 310B retains the second end point P2 after retaining the first end point P1 (the ninth control), for example, the retaining mechanism 310B can be moved in order to retain the second end point P2 after releasing the first end point P1. The reason for this is that while the retaining mechanism 310B moves, the retaining mechanism 310A retains the first point P and the carrying plate 402 supports the processing subject T. Hence, there is no need to retain three points, namely the first point P, the first end point P1, and the second end point P2, simultaneously, and only two points (either the first point P and the first end point P1 or the first point P and the second end point P2) need be retained simultaneously. Accordingly, an increase in the number of retaining mechanisms 310 can be prevented, and as a result, the configuration of the retaining devices 300A, 300B can be simplified.

Moreover, by performing the operations with the processing subject T hung over the carrying plate 402, swinging and other movement of the processing subject T can be reduced. As shown in FIG. 18(*g*), for example, after retaining the first point P, the retaining mechanism 310A lifts up the T-shirt T until the first point P reaches a higher position than the carrying plate 402, which is slightly tilted from the horizontal condition, but instead, the carrying plate 402 may be moved in the horizontal direction or rotated such that the T-shirt T comes into contact with the carrying plate 402 at the stage where the retaining mechanism 310A has moved above the carrying plate 402. In this case, swinging of the T-shirt T when the T-shirt T is lifted up by one point (the first point P) can be reduced. As a result, the following image data acquisition operation (FIG. 18(*h*)) can be performed by the imaging device 500 more accurately and more quickly.

(5) In the processing apparatus 1 according to this embodiment, the carrying plate 402 is capable of moving in the front-rear direction, and therefore no floor space is required to recognize and fold the processing subject T. As a result, a floor area required to dispose the processing apparatus 1 can be made more compact.

(6) In the processing apparatus 1 according to this embodiment, the clamping device 700 is constituted by "plates", namely the upper side clamping plate 702 and the lower side clamping plate 704, and these "plates" clamp the entire folded processing subject T. Therefore, the likelihood of the folded processing subject T losing its shape can be greatly reduced in comparison with a case where the folded processing subject T is transported while gripping the corner portions thereof or the like.

(7) In the processing apparatus 1 according to this embodiment, the support 802 of the transportation device 800 includes the plurality of support members 808, and the respective support members 808 are disposed with gaps therebetween so as to form a comb tooth-shaped surface for receiving the folded processing subject T. Hence, by forming the slits 730 in the lower side clamping plate 704 of the clamping device 700 at equal intervals to the gaps between the support members 808, interference between the lower side clamping plate 704 and the support 802 can be avoided. Further, by forming slits S (see FIG. 4) in a side face of the processing subject reception box R at equal intervals to the gaps between the support members 808, interference between the processing subject reception box R and the support 802 can be avoided, and therefore the processing subject T can be stored gently in the processing subject reception box R from a lower position. As a result, the processing subject T is less likely to lose its shape. Furthermore, by increasing the number of support members 808, the number of contact points between the support members 808 and the folded processing subject T can be increased, and as a result, the processing subject T is even less likely to lose its shape.

(8) In the processing apparatus 1 according to this embodiment, the support 802 of the transportation device 800 is capable of moving in the up-down direction. Therefore, even when a difference exists between the height of the clamping device 700 and the height of the processing subject reception box R, the folded processing subject T can be lowered to a predetermined position corresponding to the height of the processing subject reception box R and stored gently in the processing subject reception box R. As a result, the processing subject T is even less likely to lose its shape (the shape of the processing subject T is even less likely to be spoiled). Conversely, the processing subject reception box R may be elevated to the height of the support 802 instead of moving the support 802. In other words, the support 802 and the processing subject reception box R are configured to be capable of moving relative to each other.

Further, the processing subject reception box R may be provided in a plurality, and in this case, the processing subject reception boxes R and the support 802 may be moved relative to each other such that the processing subject reception box R corresponding to the type of the processing subject T is disposed under the support 802. For example, T-shirts may be stored in a first processing subject reception box R1, slacks may be stored in a second processing subject reception box R2, towels may be stored in a third processing subject reception box R3, and so on. In so doing, the processing subject T is less likely to lose its shape and so on than in a case where processing subjects T of different types are stacked in the same reception box R, and the processing subjects T do not have to be sorted after being removed from the processing apparatus 1.

Note that in the processing apparatus 1 according to this embodiment, the type of the processing subject T is recognized in the type recognition process (FIG. 13, S14-2), but at this time, an additional property (an owner/user, for example) of the processing subject T may also be recognized. More specifically, the features (the color, size, and so on, for example) and the additional property (the owner/user, for example) of the processing subject T may be associated with each other and input into the type recognition unit in advance, and during the type recognition process, the additional property (the owner/user, for example) of the processing subject T may also be recognized. In this case, the plurality of processing subject reception boxes R and the support 802 may be moved relative to each other such that the processing subject reception box R corresponding to the additional property (the owner/user, for example) of the processing subject T is disposed under the support 802. For example, the processing subjects T belonging to a father may be stored in the first processing subject reception box R1, the processing subjects T belonging to a mother may be stored in the second processing subject reception box R2, the processing subjects T belonging to a child may be stored in the third processing subject reception box R3, and so on. In so doing, the processing subjects T do not have to be sorted after being removed from the processing apparatus 1.

(9) In the processing apparatus 1 according to this embodiment, the support 802 of the transportation device 800 can be rotated to a vertically downward orientation. Hence, when the folded processing subject T carried on the support 802 is to be stored in the processing subject reception box R, the processing subject T can slide over the support member 808 so as to be stored in the processing subject reception box R gently. As a result, the processing subject T is less likely to lose its shape.

(10) In the processing apparatus 1 according to this embodiment, the transportation device 800 is disposed on the downstream side of the clamping device 700. Hence, the operation performed by the transportation device 800 to transport the folded processing subject T and the operation to fold the processing subject T, which is implemented before reaching the clamping device 700, can be undertaken simultaneously. As a result, the operating efficiency of the processing apparatus 1 can be improved.

(11) In the processing apparatus 1 according to this embodiment, the barrier member 222 is disposed on the upper surface of the transportation conveyor 204 so that the processing subject T transported by the transportation conveyor 204 is lifted onto the barrier member 222. As a result, even when a thin processing subject T (a handkerchief, for example) is carried on the transportation conveyor 204 in a flat, unfurled condition, the processing subject T can be retained by the finger members 322 of the retaining mechanisms 310A, 310B easily. Here, as shown in FIG. 4, the barrier member 222 is formed from an elongated member that extends in the width direction (the direction of the arrow X), and therefore the processing subject T can be lifted thereon in all positions in the width direction (the direction of the arrow X). As a result, the likelihood of gripping the end point of the processing subject T initially as the first point P can be increased (the barrier member 222 may be provided only in a specific position in the width direction (for example, only in the center or in a plurality of discrete locations), but in this case, the end point of the processing subject T cannot be gripped initially as the first point P unless the end point of the processing subject T is in this specific location).

(12) In the processing apparatus 1 according to this embodiment, the processing subject T inserted onto the upper surface of the transportation conveyor 204 is moved temporarily to the far side of the processing apparatus 1, whereupon the barrier member 222 is disposed on the upper surface of the transportation conveyor 204 and the transportation conveyor 204 is rotated in reverse so as to return the processing subject T to the door side. In so doing, the amount of floor space required to lift the processing subject T onto the barrier member 222 and form a first point P that can be retained by the retaining mechanism 310A easily can be reduced. As a result, the floor area required to dispose the processing apparatus 1 can be made more compact.

(13) In the processing apparatus 1 according to this embodiment, the transportation conveyor 204 is disposed beneath the retaining devices 300A, 300B and the carrying device 400. Therefore, even when the processing subject T falls onto the upper surface of the transportation conveyor 204 while being recognized and folded by the retaining devices 300A, 300B and the carrying device 400, the reception transportation process can be performed again from the beginning using the reception transportation device 200.

(14) In the processing apparatus 1 according to this embodiment, the gripping members 328 are attached to the tip end portions of the pair of finger members 322 provided on each retaining mechanism 310. The gripping members 328 are attached so as to be free to rotate relative to the finger members 322. Therefore, when a part of the processing subject T is retained by the finger members 322 while the finger members 322 are oriented upward and then the finger members 322 are oriented downward by rotating the rotary actuator 326 while continuing to retain the part of the processing subject T, for example, the positions of the gripping members 328 relative to the processing subject T do not vary as the finger members 322 rotate, but the angles of the gripping members 328 relative to the finger members 322 vary. In other words, when the finger members 322 are oriented downward, the gripping members 328 are rotated by the weight of the processing subject T so that the processing subject T hangs down from the finger members 322. As a result, the processing subject T is less likely to become entangled on the tip end portions of the finger members 322. When the gripping members 328 are not provided, the processing subject T can only be disentangled by executing control to place the processing subject T back on the carrying plate 402 or the like temporarily, or by providing a more complicated mechanism than the finger members 322.

(15) In the processing apparatus 1 according to this embodiment, the respective imaging directions of the two imaging units 502, 504 of the imaging device 500 are set to be substantially orthogonal to each other. In so doing, the position of the end point to be detected can be detected in three dimensions.

An embodiment of the present invention was described above on the basis of the drawings, but the specific configurations of the present invention should not be considered limited to those of the above embodiment. The scope of the present invention is indicated by the claims as well as the description of the above embodiment, and further includes all modifications equivalent in meaning and scope to the claims, respective modified examples described below, and combinations of these modified examples.

MODIFIED EXAMPLES (A) In the processing apparatus 1 according to the above embodiment, an example in which digital still cameras are used as the imaging units 502, 504 of the imaging device 500 was described, but the present invention is not limited to this configuration, and an infrared light source and an infrared filter with which infrared rays are emitted onto the processing subject may be used instead of or in addition to the digital still cameras. When an attempt is made by the type recognition unit 914 of the control device 900 to recognize a processing subject T having black parts on the surface thereof (a striped sweatshirt having black stripes), for example, in a case where only digital still cameras are used, the black parts may merge with the background such that the processing subject T is recognized erroneously as being divided into separate pieces by the black parts, despite being an integral processing subject T. When the digital still cameras are used in combination with an infrared filter, however, image data on which the entire processing subject T, including the black parts on the surface thereof, appears whitish can be obtained. Note that the background remains black. As a result, the black parts of the processing subject T do not merge with the background, and therefore a processing subject T having black parts on the surface thereof can be recognized correctly. Note that a dedicated infrared camera having 1432778475476_0 or 1432778475476_1 may also be used as the imaging device 500.

Further, depending on the shape of a housing of the processing apparatus 1 and the location in which the processing apparatus 1 is disposed, external light may not reach the interior of the housing of the processing apparatus 1. Hence, the processing apparatus 1 may include a lighting device (an LED, for example) for assisting the imaging device 500 in image recognition. Lighting of the lighting device is controlled in accordance with instructions from the control device 900 so that the lighting device is lit in order to illuminate an imaging range of the imaging device 500 immediately before the imaging device 500 performs an imaging operation, when the image captured by the imaging device 500 is recognized as being insufficiently bright, and so on, for example. Here, from the viewpoint of assisting the imaging device 500 during image recognition, the inner surfaces of the housing of the processing apparatus 1 may be colored black (for example, formed from a black material or painted black). The processing subject T is closer to the lighting device than the background (the inner surfaces of the housing), and is therefore brighter than the background when irradiated with light. Hence, even when the processing subject T is black, the processing subject T is brighter than the black background (the inner surfaces of the housing), and therefore the imaging device 500 can recognize the processing subject T as being distinct from the background. When a processing subject T having a dark color (dark blue, for example) is disposed in the processing apparatus 1 in a case where the inner surfaces of the housing are not black (when the inner surfaces are blue, for example), the brightness of the processing subject T may be increased by the emitted light such that the apparent color of the processing subject T (dark blue appears close to blue) and the apparent color of the background (blue) become substantially identical, causing the processing subject T to blend into the background (the inner surfaces of the housing). For this reason, black, with which such a situation cannot occur, is preferably used as the color of the inner surfaces of the housing of the processing apparatus 1. Note that the ability of the imaging device 500 to recognize the processing subject T may be improved by making the inner surfaces of the housing of the processing apparatus 1 matte so as to increase the proportion of the light from the lighting device that is diffusely reflected.

(B) In the processing apparatus 1 according to the above embodiment, an example in which the respective moving mechanisms are realized by ball screw mechanisms and linear motor mechanisms was described, but the present invention is not limited to this configuration, and the moving mechanisms may also be realized by mechanisms such as air cylinder mechanisms, motor cylinder mechanisms, belt slider mechanisms, electric slider mechanisms, and rack and pinion mechanisms.

(C) Further, in the processing apparatus 1 according to the above embodiment, an example in which the end points and so on are detected and the processing subject T is recognized by the two imaging units 502, 504 was described, but the present invention is not limited to this configuration, and one imaging unit or three or more imaging units may be provided instead. For example, an additional imaging unit 500 may be mounted on the moving plate 416R (FIG. 8) such that the lens thereof is oriented toward the moving plate 416L, and used as the obstruction detecting means in place of the processing subject sensor 409. In a further example, additional imaging units 500 may be provided on the retaining mechanisms 310A, 310B in order to photograph the condition in which the processing subject T is retained.

(D) Furthermore, when the first end point P1 of the processing subject T is to be retained by the retaining mechanism 310B (the seventh control, step S9), for example, the retaining device control unit 904 performs control such that the retaining mechanism 310B retains the detected first end point P1, but since an error or the like may exist in the detected position of the first end point P1, it is impossible to determine whether or not the retaining mechanism 310B has actually retained the processing subject T. If the retaining mechanism 310B has not been able to retain the processing subject T, the subsequent control processes/steps cannot be performed. Hence, a retaining determination process described below may be applied when the processing subject T is retained by the retaining mechanisms 310A, 310B.

[Retaining Determination Process]

In this modified example, the control device 900 includes a retaining determination unit 918. When the processing subject T is retained by the retaining mechanisms 310A, 310B, the imaging device 500 obtains image data showing a peripheral area including the retained positions (the first end point P1 and the second end point P2, for example) continuously from the start of the retaining control executed by the retaining device control unit 904 to a point at which the retaining mechanisms 310A, 3106 are moved by a small amount after retaining the processing subject T. The retaining determination unit 918 receives the image data from the imaging device 500, and obtains a difference in the outer shape of the processing subject T between the start of the retaining control executed by the retaining device control unit 904 to the point at which the retaining mechanisms 310A, 310B are move by a small amount after retaining the processing subject T.

When the difference is zero, or in other words when the processing subject T is unchanged, the retaining determination unit 918 determines that the retaining mechanisms 310A, 310B have not been able to retain the processing subject T, and therefore prompts the control device 900 to re-implement the immediately preceding control process/step. At this time, the shape and position of the processing subject T may be slightly altered to make the processing subject T easier to grab. For example, the shape and position of the processing subject T are altered by moving the transportation conveyor 204 slightly in the front-rear direction when the processing subject T cannot be lifted up in the reception transportation process (FIG. 12), and moving the retaining mechanism 310A or the carrying plate 402 when the first end point P1 of the processing subject T cannot be retained by the retaining mechanism 310B.

When a significant difference exists in the outer shape of the processing subject T, on the other hand, or in other words when the processing subject T has changed, the retaining determination unit 918 determines that the retaining mechanisms 310A, 310B have been able to retain the processing subject T, and therefore prompts the control device 900 to advance to the next control process/step.

Note that the retaining determination unit 918 performs the retaining determination after receiving the image data from the imaging device 500, but depending on the position of the processing subject T (i.e. whether the processing subject T is on the transportation conveyor 204 or the like, for example), the frames of the retaining mechanisms 310A, 310B or the moving mechanisms 320A, 320B may obstruct the imaging device 500 so that the imaging device 500 cannot photograph the processing subject T clearly. To deal with a case such as this, a method such as (1) obtaining the difference in the outer shape of the processing subject T after moving the retaining mechanisms 310A, 310B to a location where the frames thereof do not cause an obstruction (for example, elevating the retaining mechanisms 310A, 3106 to the vicinity of the carrying plate 402), (2) forming the frames of the retaining mechanisms 310A, 310B and the moving mechanisms 320A, 320B from a transparent material, or (3) providing small digital still cameras additionally on the retaining mechanisms 310A, 310B as the imaging device 500 and obtaining the image data using these additional cameras, for example, may be employed.

Furthermore, in another example of the retaining determination process, weight sensors may be provided on the retaining mechanisms 310A, 310B, for example, and the retaining determination unit 918 may determine whether or not the processing subject T has been retained from a difference in weight following the start of the retaining control performed by the retaining device control unit 904.

By providing the retaining determination unit 918 and performing the retaining determination process when the processing subject T is retained by the retaining mechanisms 310A, 310B, the control processes/steps executed by the processing apparatus 1 can be advanced reliably.

Note that when the processing apparatus 1 vibrates or the like, the imaging position of the imaging device 500 may shift. When, in this case, image processing is performed on the basis of the position of the imaging device 500 prior to the shift, a positional deviation may occur such that the retaining mechanisms 310A, 310B repeatedly fail to retain the processing subject T. In this case (for example, when retaining fails a predetermine number of times or more even though the processing subject T has been photographed by the imaging device 500), the retaining determination unit 900 may determine that the position of the imaging device 500 has shifted and perform calibration between the imaging device 500 and the retaining mechanisms 310A, 310B. The retaining mechanisms 310A, 310B each have a set physical movable limit (coordinate position), and therefore calibration is performed by moving the retaining mechanisms 310A, 310B to their movable limits, and then comparing coordinate positions obtained from the image data generated by the imaging device 500 at that time with the coordinate positions of the movable limits.

(E) In the processing apparatus 1 according to the above embodiment, the barrier member 222 of the reception transportation device 200 is supported by the door main body 210 so as to rotate in conjunction with the rotation of the door main body 210. The present invention is not limited to this configuration, however, and a barrier member up-down direction moving mechanism (not shown) that allows the barrier member 222 to approach and move away from the upper surface of the transportation conveyor 204, for example, may also be provided. By providing this barrier member up-down direction moving mechanism, the control for disposing the barrier member 222 on the upper surface of the transportation conveyor 204 can be executed independently of the control for opening and closing the door main body 210. As a result, the door main body 210 can be closed as soon as the processing subject T is inserted into the processing apparatus 1, for example, instead of waiting for the transportation conveyor 204 to move the processing subject T to the far side of the processing apparatus 1.

(F) When detecting the lowermost point of the processing subject T (during the first end point detection process, for example), the position of the lowermost point detected on the basis of the image data from the first imaging unit 502 may not match the position of the lowermost point detected on the basis of the image data from the second imaging unit 504. When detecting the lowermost point of the processing subject T, therefore, a locus of the position of the lowermost point detected on the basis of the image data from the first imaging unit 502 may be projected onto the image data obtained by the second imaging unit 504.

(G) Further, the smallest unit of the image data obtained from the imaging device 500 is a pixel, but by calculating a position within the pixel using the gradation of the image data, an improvement in detection precision can be achieved.

(H) Furthermore, respective origin positions of the retaining mechanisms 310A, 310B may be set in the retaining device control unit 904. In so doing, the retaining mechanisms 310A, 310B can be returned to their respective origins as required from any control process/step. The retaining device control unit 904 may also set a maximum distance between the finger members 322A of the retaining mechanism 310A and the finger members 322B of the retaining mechanism 310B during a specific step, and control the movement of the retaining mechanisms 310A, 3106 so that the distance between the finger members 322A and the finger members 322B does not exceed this distance. For example, when the retaining mechanism 310A retains the first point P and the retaining mechanism 310B retains the first end point P1 during the recognition process (FIG. 18(*h*)), the distance between the first point P and the first end point P1 is calculated and set in the retaining device control unit 904 as the maximum distance. Then, during the following operations up to the point at which the second end point P is retained (i.e. during the operations for moving the retaining mechanisms 310A, 310B while the retaining mechanism 310A retains the first point P and the retaining mechanism 310*b* [retains the first end point P1]), control is implemented to ensure that the retaining mechanisms 310A, 310B are not moved beyond the maximum distance. Accordingly, a situation in which the finger members 322A and the finger members 322B pull the processing subject T apart by a distance exceeding the length thereof (the length by which the processing subject T extends under its own weight) can be prevented from occurring, and as a result, damage to and stretching of the processing subject T can be suppressed.

Note that in order to prevent the retaining mechanisms 310A, 310B from stretching and damaging the processing subject T, a damping member such as a spring may be provided on a part of the retaining mechanism 310A and/or the retaining mechanism 310B (between the linear actuator 324 and the connecting member 330 or the like, for example). Thus, when the retaining mechanisms 310A and 310B move away from each other while retaining the processing subject T, tensile force exerted on the processing subject T can be reduced by the damping member provided on the retaining mechanisms 310A, 310B, and as a result, damage to and stretching of the processing subject T can be suppressed. In another example, a tension sensor may be provided on the retaining mechanism 310A and/or the retaining mechanism 310B in order to monitor the force exerted on the retaining mechanisms 310A, 310B, and the distance between the retaining mechanisms 310A and 310B may be controlled such that excessive force is not exerted on the processing subject T.

(I) In the processing apparatus 1 according to the above embodiment, a case in which the two retaining devices 300A, 300B are used, each retaining device being capable of moving in the front-rear, up-down, and left-right directions, and each retaining device including the finger members 322 that are capable of gripping the processing subject T, was described. The present invention is not limited to this configuration, however, and one retaining device 300A may be configured to be capable of moving only in the left-right direction, for example. In so doing, the configuration of the processing apparatus 1 can be simplified. An example in which the retaining device 300A is capable of moving only in the left-right direction will be described below.

Figure 26:
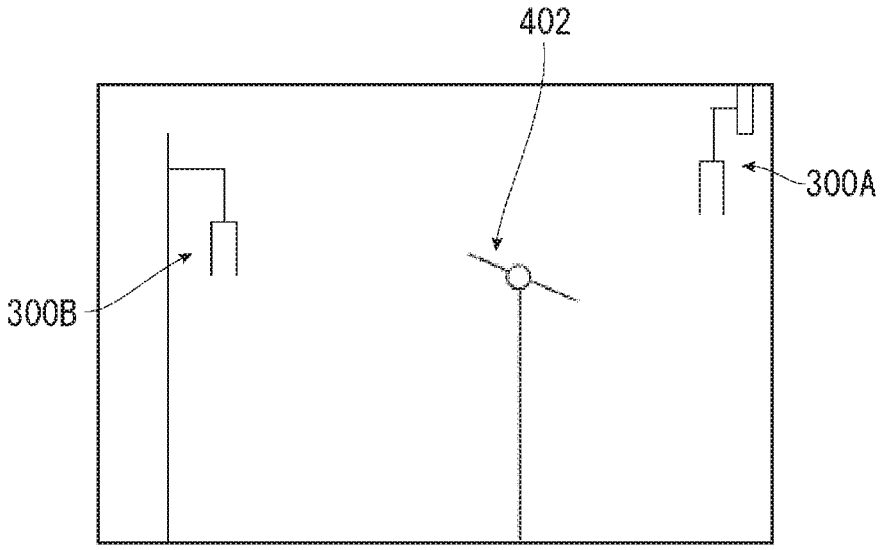
FIG. 26 is a view showing another example of the retaining device according to modified example (I).

In the processing apparatus 1 in which the retaining device 300A is capable of moving only in the left-right direction, as shown in FIG. 26, the retaining device 300A is provided in an upper portion of the processing apparatus 1 close to the front surface 106A. The moving mechanism 320A of the retaining device 300A includes only the width direction moving mechanism 332A described in the above embodiment, and the up-down direction moving mechanism and front-rear direction moving mechanism are omitted.

Next, operations performed to recognize and fold the processing subject T in a case where the retaining device 300A is capable of moving only in the left-right direction will be described briefly. In the recognition and folding operations performed using the processing apparatus 1 according to the above embodiment, the operations of the retaining devices 300A, 300B can be broadly divided into (1) a case in which the retaining mechanism 310A of the retaining device 300A retains the processing subject T alone (for example, the sixth control/step S7, in which the retaining mechanism 310A retains the first point P) and (2) a case in which the retaining mechanism 310A of the retaining device 300A and the retaining mechanism 3106 of the retaining device 300B retain the processing subject T simultaneously (for example, the eighth control/step S10, in which the retaining mechanism 310A retains the first point P and the retaining mechanism 310B retains the first end point P1).

In an embodiment where the retaining device 300A is capable of moving only in the left-right direction, in case (1), first, the retaining mechanism 310B of the retaining device 300B that is capable of moving in the front-rear, up-down, and left-right directions retains a predetermined position of the processing subject T, whereupon the retaining mechanism 310B moves to the vicinity of the retaining mechanism 310A and causes the retaining mechanism 310A to retain the predetermined position. Further, in case (2), the retaining mechanism 310B initially retains the position to be retained by the retaining mechanism 310A, whereupon the retaining mechanism 310A is caused to retain the predetermined position, similarly to case (1). The retaining mechanism 310B then retains the position to be held by the retaining mechanism 310B.

Figure 27:
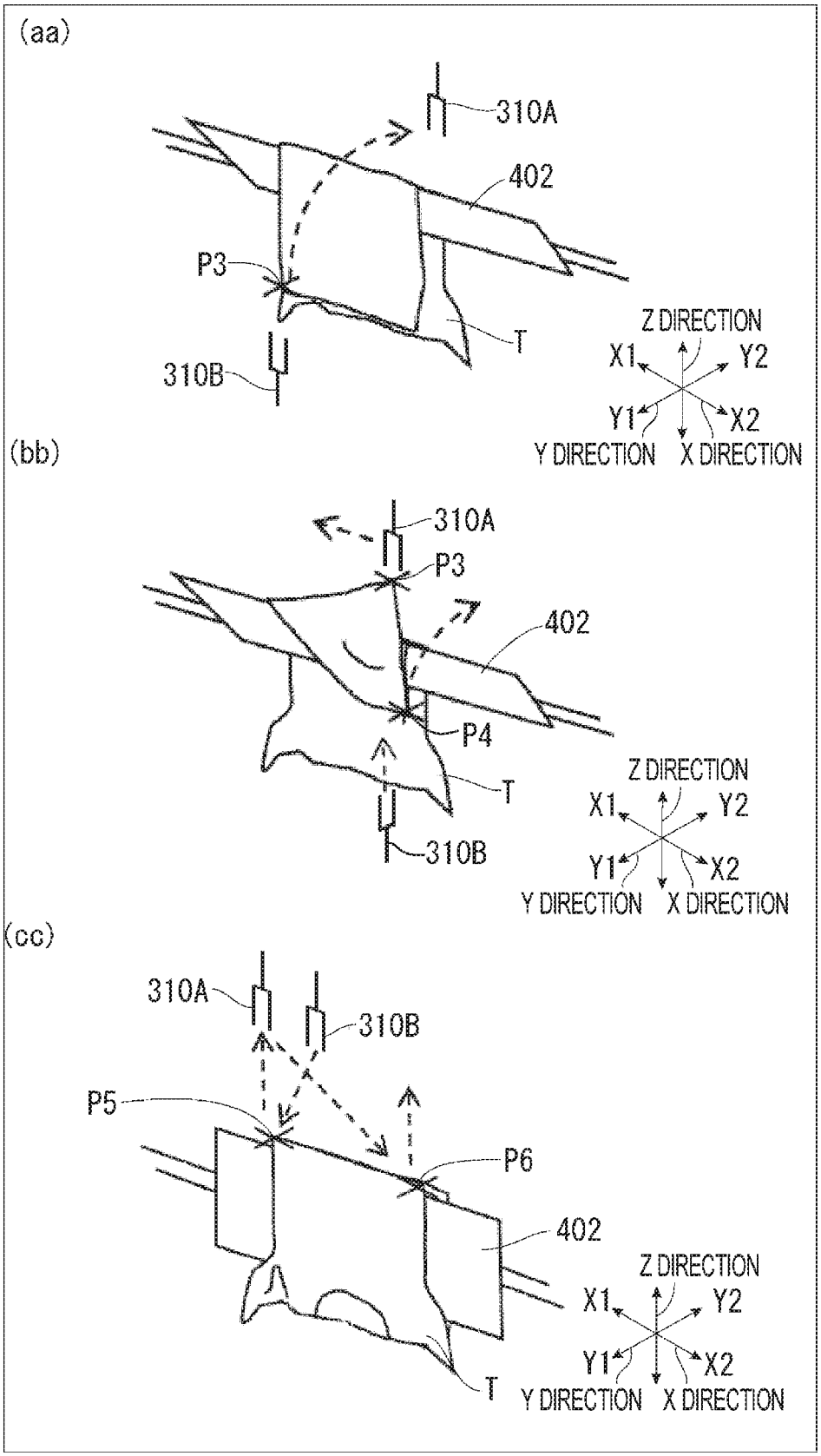
FIG. 27 is a view illustrating a T-shirt processing operation according to modified example (I).

As regards the operations of the respective retaining devices 300A, 300B in an embodiment where the retaining device 300A is capable of moving only in the left-right direction, several control processes/steps may be cited as examples. First, the twelfth to fifteenth control/steps S18 to S21 will be described. As shown in FIG. 27(*aa*), the third end point P3 detected in step S16 is retained by the retaining mechanism 310B. Next, the retaining mechanism 310B moves to the vicinity of the retaining mechanism 310A, which is waiting directly above the fourth end point P4, and causes the retaining mechanism 310A to retain the third end point P3. Next, as shown in FIG. 27(*bb*), the retaining mechanism 310B retains the fourth end point P4 (the fourteenth control, step S20) and lifts up the fourth end point P4 to the same height as the third end point P3 on the right side (the direction of the arrow X1) of the third end point (the fifteenth control, step S21).

Next, the sixteenth and seventeenth control/steps S24 and S25 will be described. As shown in FIG. 27(*cc*), first, the retaining mechanism 310B retains the fifth end point P5. Next, the retaining mechanism 310B moves to the vicinity of the retaining mechanism 310A and causes the retaining mechanism 310A to retain the fifth end point P5. The retaining mechanism 310B then retains the sixth end point P6 (the sixteenth control, step S24). Next, the respective retaining mechanisms 310A, 3106 move the fifth end point P5 and the sixth end point P6 to the right (the direction of the arrow X1) of the carrying plate 402. Further, the retaining mechanisms 310A, 310B move such that the fifth end point P5 and the sixth end point P6 are arranged side by side in the front-rear direction (the direction of the arrow Y) on the right of the carrying plate 402. Next, the retaining mechanism 310A moves in the leftward direction (the direction of the arrow X2) while the retaining mechanism 310B descends while moving in the leftward direction (the direction of the arrow X2). Further, as the two retaining mechanisms 310A, 310B move, the carrying plate 402 is rotated in the forward direction from the horizontal condition (the rotary shaft 412 rotates counterclockwise when seen from the left side surface 102D). Hence, the door side (the arrow Y2 side) edge portion of the carrying plate 402 approaches the retaining mechanism 310A as the retaining mechanism 310A moves, whereby the T-shirt T can be placed on the upper surface of the carrying plate 402 in a similar manner to a case such as that of the above embodiment, in which the retaining mechanism 310A is lowered so as to approach the carrying plate 402 waiting in the horizontal condition (the seventeenth control, step S25). Note that the far side (the arrow Y1 side) edge portion of the carrying plate 402, to which the retaining mechanism 310B corresponds, moves downward, and therefore the retaining mechanism 310B must be lowered by a greater distance than in the above embodiment.

Figure 28:
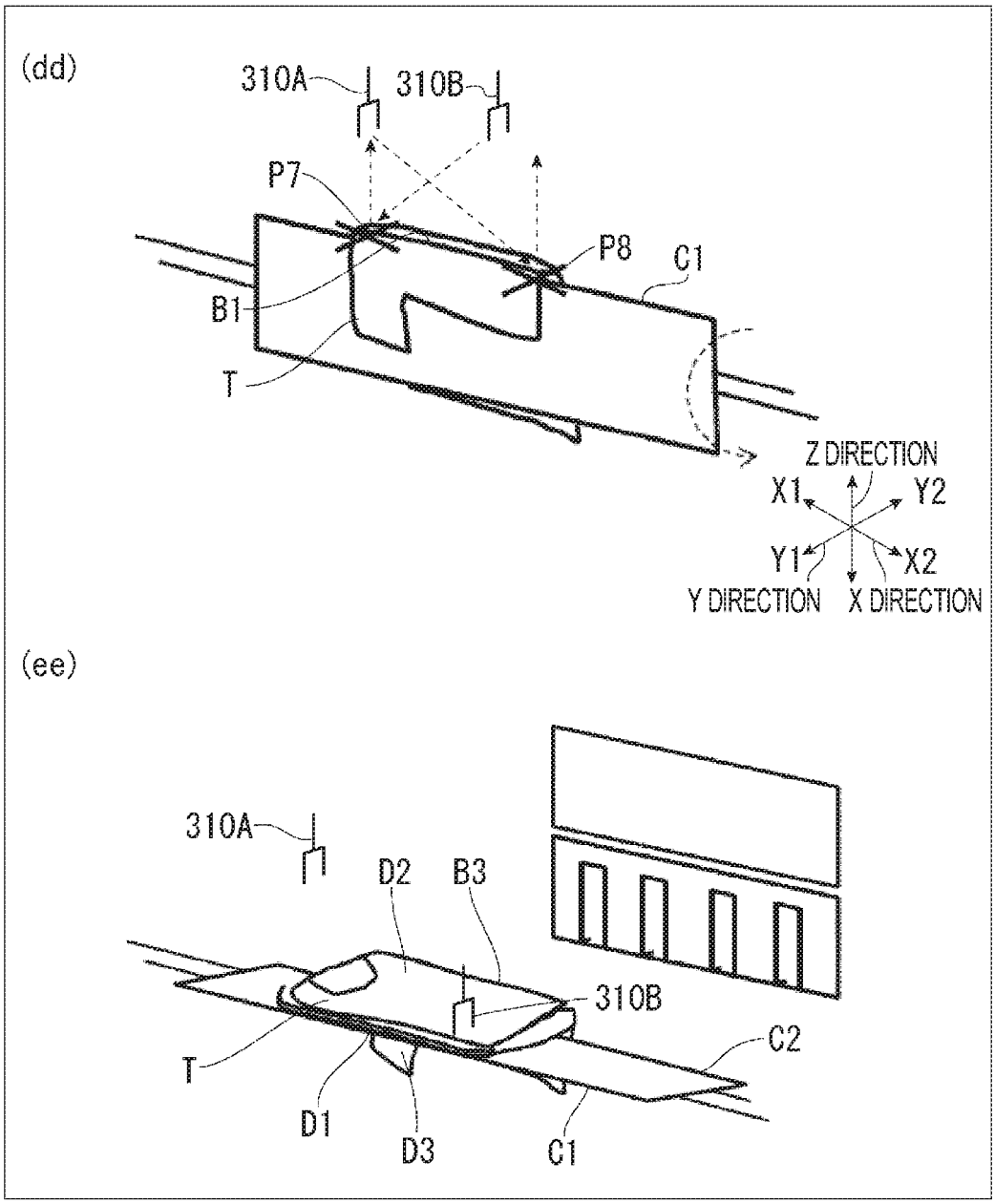
FIG. 28 is a view illustrating the T-shirt processing operation according to modified example (I).

Next, the twentieth and twenty-first control/steps S30 and S31 will be described. As shown in FIG. 28(*dd*), first, the retaining mechanism 310B retains the seventh end point P7. Next, the retaining mechanism 310B moves to the vicinity of the retaining mechanism 310A and causes the retaining mechanism 310A to retain the seventh end point P7. The retaining mechanism 310B then retains the eighth end point P8 and lifts up the eighth end point P8 (the twentieth control, step S30).

Figure 29:
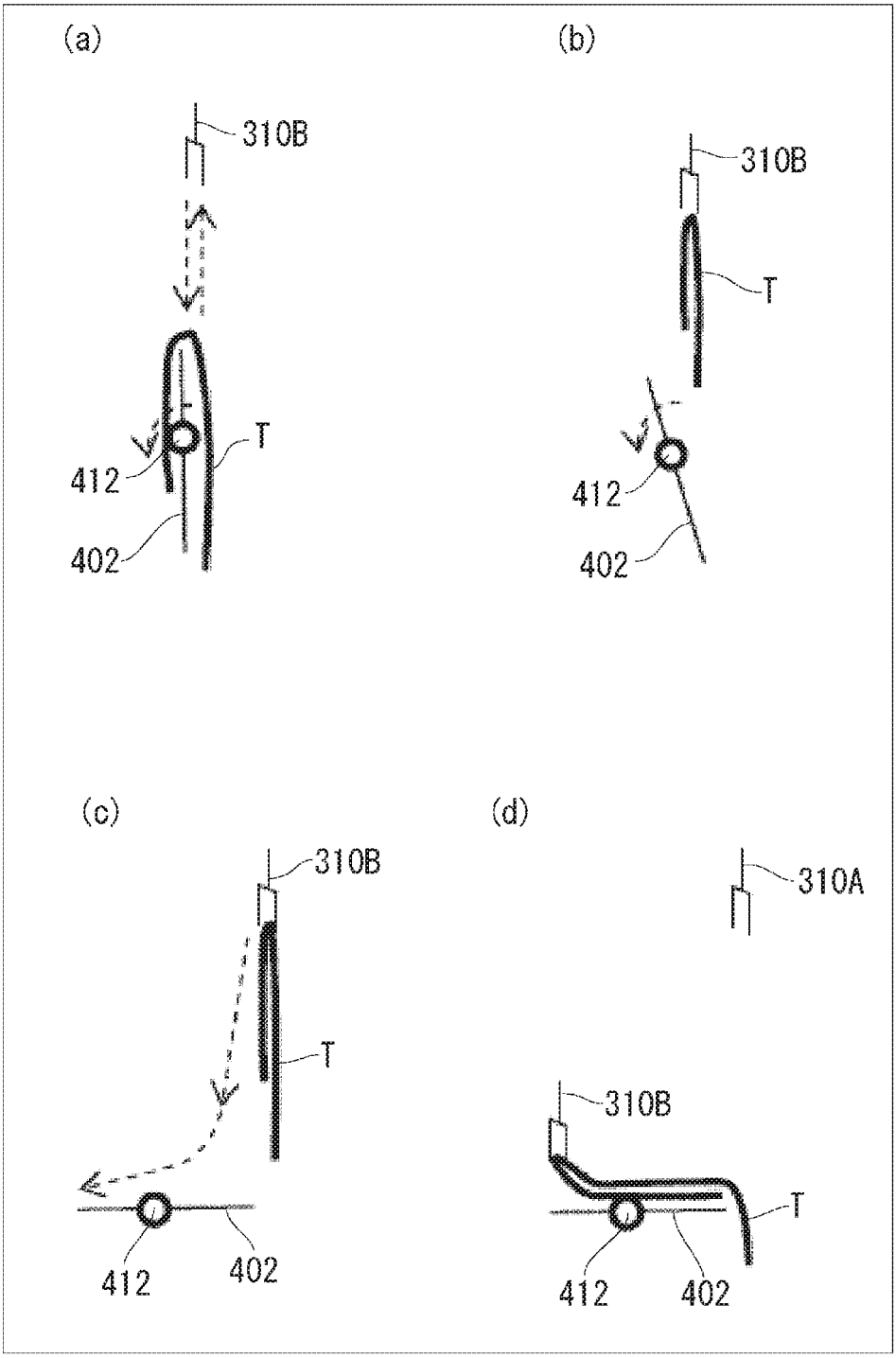
FIG. 29 is a view illustrating the T-shirt processing operation according to modified example (I).

Next, as shown in FIG. 28(*ee*), the respective retaining mechanisms 310A, 3106 place the T-shirt T on the carrying plate 402 (the twenty-first control, step S31). More specifically, in a condition where the respective retaining mechanisms 310A, 3106 lift up the T-shirt T by the seventh end point P7 and the eighth end point P8 (FIG. 29(*a*)), the carrying plate 402 is rotated slightly in the forward direction (FIG. 29(*b*)) from the vertical orientation (the rotary shaft 412 rotates counterclockwise when seen from the left side surface 102D). Next, the retaining mechanism 310A releases the seventh end point P7 and the retaining mechanism 310B is lowered while retaining the eighth end point P8 (FIG. 29(*c*)). Further, as the retaining mechanism 310B is lowered, the carrying plate 402 is rotated further in the forward direction. As a result, the T-shirt T can be placed on the carrying plate 402 while maintaining the folded shape of the T-shirt T (FIG. 29(*d*)).

(J) Furthermore, the moving mechanisms 320A may all be omitted from the retaining device 300A, and the retaining device 300A may be constituted by only a fixed hook that does not perform opening/closing operations instead of the finger members 322A that perform opening/closing operations. In so doing, the configuration of the processing apparatus 1 can be simplified even further. Note that in this case, many of the movements of the retaining mechanism 310A are restricted, and therefore the folded shape of the processing subject T placed on the carrying plate 402 may be slightly disheveled. However, by correcting this dishevelment using the freely moving retaining mechanism 310B, the processing subject T can be recognized and folded.

(K) In the processing apparatus 1 according to the above embodiment, the retaining mechanisms 310A, 310B rotate in the direction of the arrow R1, as shown in FIG. 6, and the finger members 322A, 322B open and close so as to approach and move away from each other in a widthwise direction. The present invention is not limited to this configuration, however, and instead, for example, additional rotary actuators may be provided between the connecting member 330 and the respective linear actuators 324A, 324B shown in FIG. 6 so that the finger members 322A, 322B also rotate about the lengthwise direction. Hence, when the end portions of the processing subject T retained by the finger members 322A, 322B become twisted, for example, the end portions can be untwisted by rotating the finger members 322A, 322B in either the forward direction or the reverse direction about the lengthwise direction (when the end portions are not untwisted, an opposite rotation direction is required, and therefore the finger members 322A, 322B are rotated in reverse). Note that twisting/untwisting of the processing subject T retained by the finger members 322A, 322B can be recognized by having the imaging device 500 photograph the processing subject T in the vicinity of the finger members 322A, 322B and performing edge detection.

(L) Rotating the finger members 322A, 322B in the manner described in (K) is effective when the end portion of the processing subject T retained by the finger members 322A or 322B becomes twisted, but the processing subject T may also become entangled or overlapped between the finger members 322A and 322B. To disentangle the processing subject T or prevent the processing subject T from becoming entangled and so on, the retaining device control unit 904 may perform a following disentangling operation by controlling the movement of the retaining mechanisms 310A, 310B during the recognition process (as the processing subject T is unfurled).

Here, a case in which the disentangling operation is performed during the recognition process between the point at which the first end point P1 is retained (FIG. 18(*h*)) and the point at which the second end point P2 is retained (FIG. 18(*i*)) will be described as an example.

Figure 30:
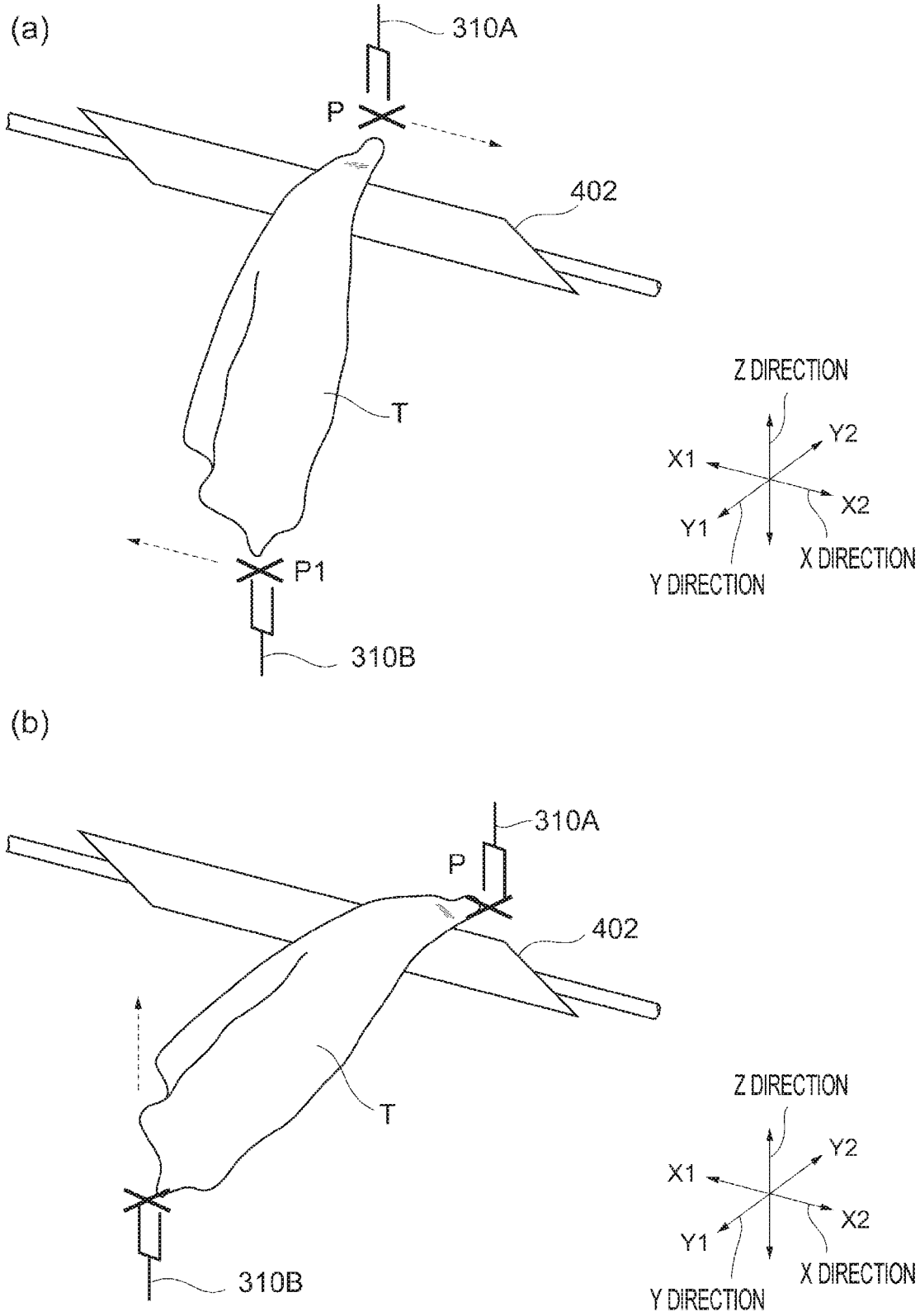
FIG. 30 is a view illustrating a T-shirt processing operation according to modified example (L).

First, as shown in FIG. 30(*a*), the processing subject T is spread out in the width direction (the direction of the arrow X) by moving the retaining mechanism 310A horizontally in the leftward direction (the direction of the arrow X2) and moving the retaining mechanism 310B horizontally in the rightward direction (the direction of the arrow X1) while the retaining mechanism 310A retains the first point P and the retaining mechanism 310B retains the first end point P1. When a part of the processing subject T is entangled or overlapped between the retaining mechanisms 310A, 310B, the entanglement or overlap can be eliminated or ameliorated by this operation. Next, the retaining mechanism 310B lifts up the first end point P1 to the same height as the first point P (FIGS. 30(*b*) and 31(*c*)). At a point during the process by which the retaining mechanism 310B lifts up the first end point P1, the rotary actuator 326B orients the finger members 322B vertically downward.

Figure 31:
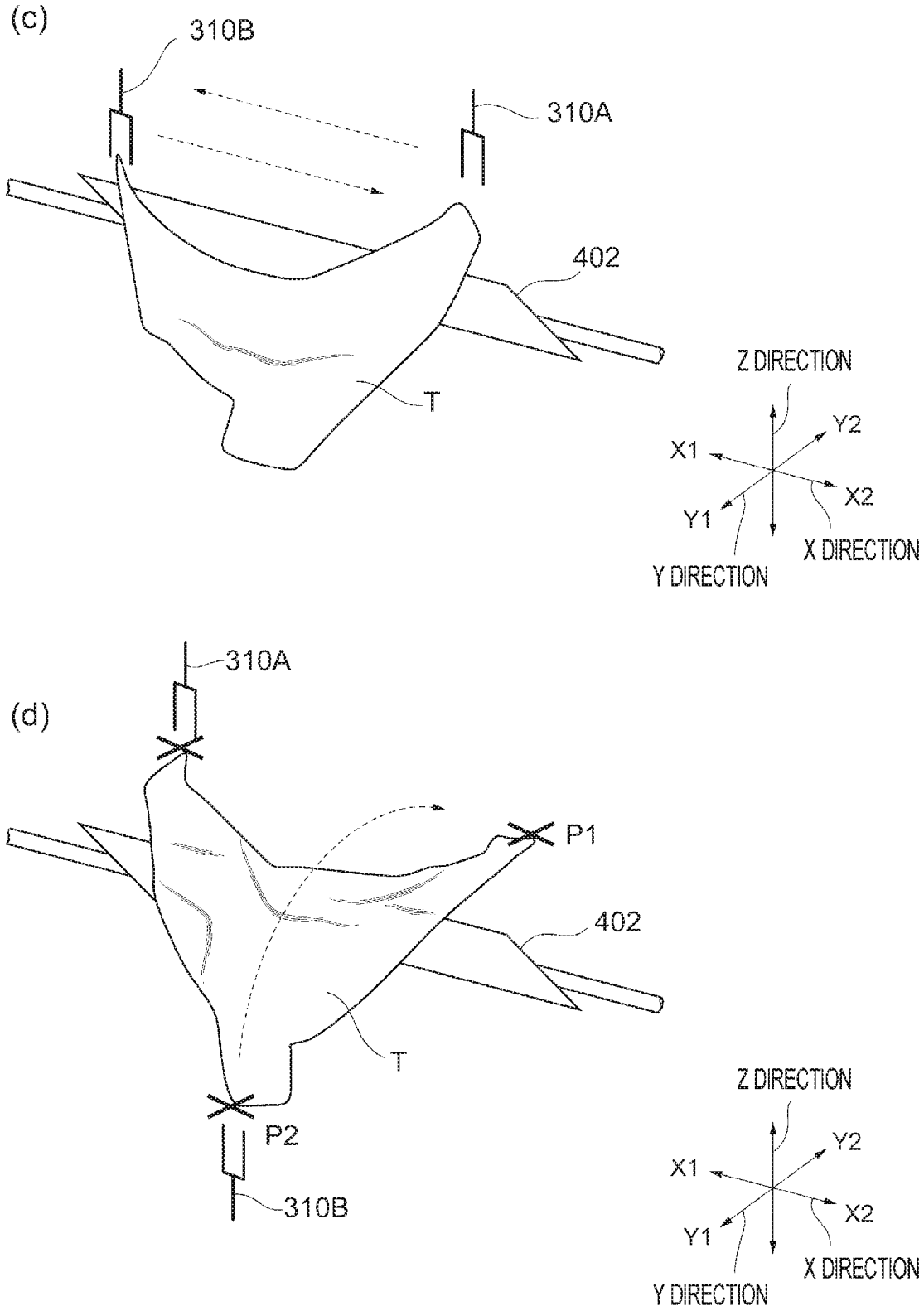
FIG. 31 is a view illustrating the T-shirt processing operation according to modified example (L).

Next, as shown in FIG. 31(*c*), respective width direction (arrow X1/X2 direction) positions of the retaining mechanisms 310A, 310B are interchanged by moving the retaining mechanism 310A horizontally in the rightward direction (the direction of the arrow X1) and moving the retaining mechanism 310B horizontally in the leftward direction (the direction of the arrow X2) while the retaining mechanism 310A retains the first point P and the retaining mechanism 310B retains the first end point P1. As a result, the processing subject T is reversed in the width direction (the direction of the arrow X), and therefore the entanglement or overlap of the processing subject T can be eliminated. Subsequent operations are identical to those of the above embodiment. More specifically, the second end point detection unit 924 detects the second end point P2 furthest from the straight line L1 linking the first point P to the first end point P1, and when the second end point P2 is detected, the retaining mechanism 310B retaining the first end point P1 releases the first end point P1 and retains the second end point P2 (FIG. 31(*d*)).

By widening the gap between the retaining mechanisms 310A, 310B in the width direction and interchanging the width direction positions thereof in this manner before beginning the operation to retain the next lowermost point from a condition in which the processing subject T is retained by the retaining mechanisms 310A, 310B, entanglement and overlap of the processing subject T can be eliminated or ameliorated.

(M) In the processing apparatus 1 according to the above embodiment, the processing subject sensor 409 used to determine that the processing subject T has been lifted onto the barrier member 222 is attached to the moving plate 416 of the front-rear direction moving mechanism 408 provided in the carrying device 400. The present invention is not limited to this configuration, however, and the processing subject sensor 409 may be fixed in the position of the barrier member 222 when the door main body 210 is closed.

(N) In the processing apparatus 1 according to the above embodiment, the barrier member 222 is an elongated member that extends in the width direction (the direction of the arrow X), as shown in FIG. 4, but the present invention is not limited to this configuration, and instead, for example, the barrier member 222 may be provided in only a specific position in the width direction (for example, only in the center or in a plurality of discrete locations). Further, in the processing apparatus 1 according to the above embodiment, the barrier member 222 is connected to the side surface plate 230 of the processing subject reception member 220, but the barrier member 222 may be provided independently of the processing subject reception member 220.

(O) Furthermore, to ensure that the processing subject T can be retained by the finger members 322 of the retaining mechanisms 310A, 310B easily even when a thin processing subject T (a handkerchief, for example) is carried on the transportation conveyor 204 in a flat, unfurled condition, the following configuration, for example, may be employed in place of the barrier member 222.

For example, one or a plurality of thread-like members (threads, wires, or the like, for example) may be suspended over the upper surface of the transportation conveyor 204 so as to extend over the entire width direction (the direction of the arrow X) and configured to be capable of moving up and down (in the direction of the arrow Z), and this thread-like member may be used as a barrier member instead of the barrier member 222 shown in FIG. 4. When the transportation conveyor 204 rotates in the forward direction (such that the processing subject T moves away from the door main body 210), the thread-like member is moved to substantially identical height positions to the transportation conveyor 204. Therefore, the movement of the processing subject T on the transportation conveyor 204 is not impeded by the thread-like member. When the transportation conveyor 204 starts to rotate in the reverse direction (such that the processing subject T approaches the door main body 210), on the other hand, the thread-like member is moved in the upward direction so as to move away from the transportation conveyor 204 (when a plurality of thread-like members are provided, the respective height positions thereof may be set to increase gradually in a direction approaching the door main body 210 (the direction of the arrow Y2)). The processing subject T transported to the thread-like member is lifted onto the thread-like member, and therefore the thread-like member functions as a barrier member. Note that the thread-like member may be moved in the upward direction after the processing subject T has been lifted thereon. When the thread-like member is then moved in the upward direction, the processing subject T is lifted up by the thread-like member, and therefore the thread-like member function as a barrier member likewise in this case.

In another example, the conveyor 204 (see FIG. 4) forms a horizontal plane (an XY plane) in the processing apparatus 1 according to the above embodiment, but instead, a fixed or movable structure may be provided on a lower surface of the conveyor 204 such that a part of the surface of the conveyor 204 projects in the vertical direction (the Z direction) either permanently or temporarily, and this part may be used as the barrier member.

Figure 32:
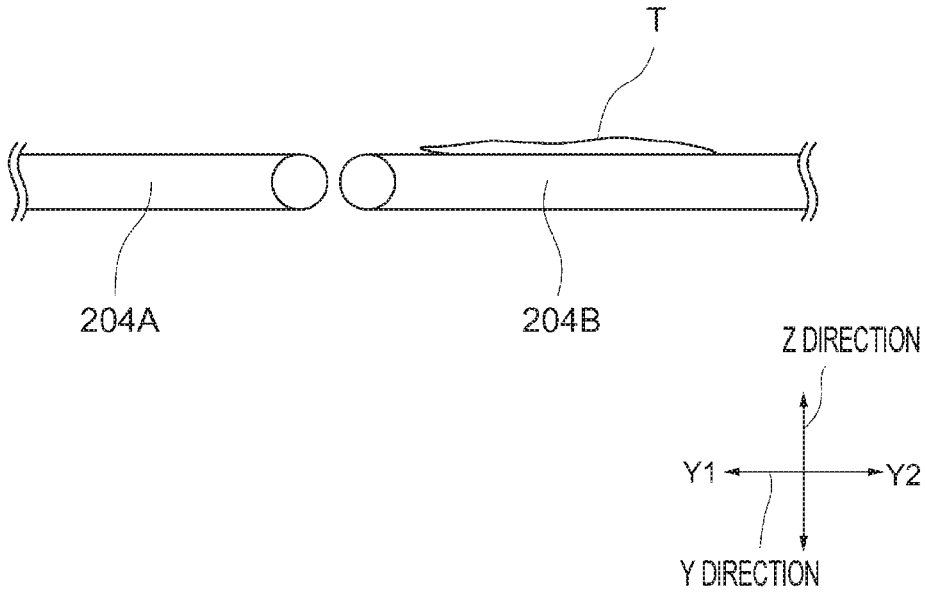
FIG. 32 is a view illustrating first and second conveyors according to modified example (O).
Figure 32:
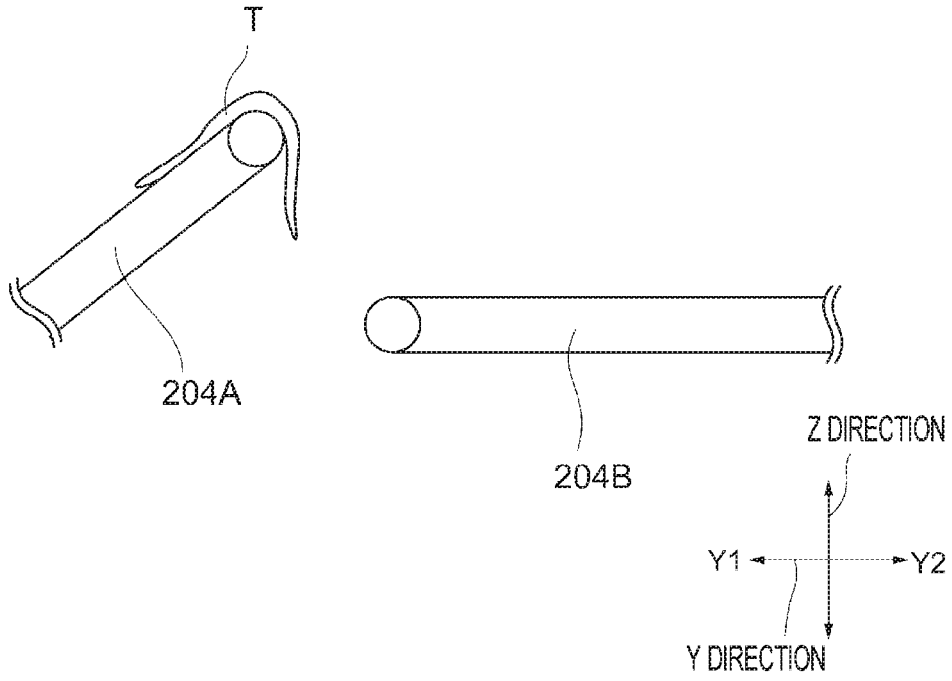

In a further example, as shown in FIG. 32(*a*), a first conveyor 204A and a second conveyor 204B divided in two in an advancement direction of the processing subject T may be used, and by tilting the first conveyor 204A as shown in FIG. 32(*b*), after determining that the processing subject T has been lifted onto the conveyor 204A, the processing subject T can essentially be lifted higher than the initial carrying surface (the horizontal surface of the second conveyor 204B). As a result, the processing subject T is lifted up by the first conveyor 204A, and therefore the processing subject T can be retained by the finger members 322 of the retaining mechanisms 310A, 310B easily even when a thin processing subject T (a handkerchief, for example) is carried on the second conveyor 204B in a flat condition.

Figure 33:
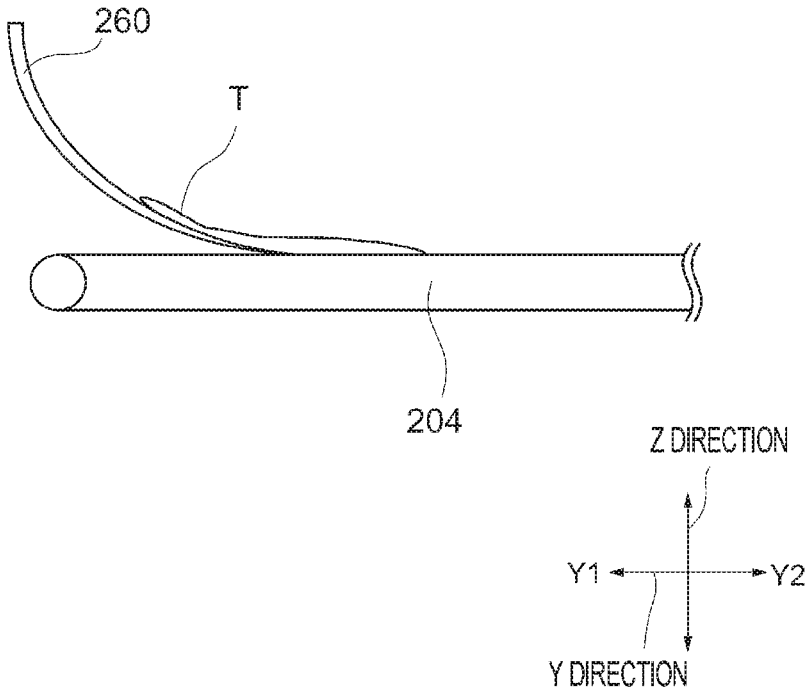
FIG. 33 is a view illustrating an auxiliary reception member according to modified example (P).

(P) In the processing apparatus 1 according to the above embodiment, the processing subject T inserted into the processing apparatus 1 in the reception transportation process (FIG. 12) is carried on the transportation conveyor 204, but instead, as shown in FIG. 33, for example, an auxiliary reception member 260 may be provided on the far side (the direction of the arrow Y1) of the transportation conveyor 204 at a slight remove from the transportation conveyor 204 so that when the processing subject T is transported to the far side by rotating the transportation conveyor 204 in the forward direction, a part of the processing subject T is lifted onto the auxiliary reception member 260. The auxiliary reception member 260 is an elongated plate having a substantially identical width to the width direction (the direction of the arrow X in FIG. 3) of the transportation conveyor 204, and as shown in FIG. 33, has an arc-shaped cross-section with an incline that increases gradually upward (in the direction of the arrow Z). The processing subject T, having been lifted onto the auxiliary member 206 in response to the forward direction rotation of the transportation conveyor 204, receives a rotation action and so on, and is then moved toward the barrier member 222 by rotating the transportation conveyor 204 in the reverse direction. In other words, the condition/shape in which the processing subject T is carried on the transportation conveyor 204 can be varied every time the transportation conveyor 204 is moved (in the direction of the arrows Y1 and Y2). For example, when a plurality of processing subjects T are inserted into the processing apparatus 1 at the same time, the processing subjects T can be disentangled from each other and relative positions of the plurality of processing subjects T in the Y direction can be modified.

(Q) In the processing apparatus 1 according to the above embodiment, a component constituted by the carrying plate main body 410, which is formed from a substantially rectangular plate, and the rotary shaft 412 is used as the carrying plate 402, but the present invention is not limited to this configuration, and instead, for example, the carrying plate 402 may be formed from a plurality of plates that are connected to each other to be capable of sliding so that respective magnitudes of a long side and a short side thereof can be modified. The width of the carrying plate 402 can then be halved or reduced to approximately ⅓, for example, during the recognition process (FIG. 13), and then returned to its original size during the folding process (FIG. 14), for example. In another example, when the processing subject T is recognized as being small, the folding process may be performed after reducing the magnitude of the long side or the short side of the carrying plate to one half or approximately ⅓, for example.

Further, for example, plate-shaped members formed from different materials may be used on the front surface, the rear surface, and the side faces of the carrying plate 402. For example, by forming the front surface and one of the side faces of the carrying plate 402 from a material having a large frictional coefficient or coating these surfaces with such a material, and forming the rear surface and the other side face from a material having a small frictional coefficient or coating these surfaces with such a material, the "slidability" of the carrying plate 402 when carrying the processing subject T can be modified freely by selecting a contact surface (the front surface, the side faces, or the rear surface) of the carrying plate 402. Hence, during an operation in which it is necessary to retain the processing subject T securely, for example (when the processing subject T is caught on the carrying plate 402 while retained by the two retaining mechanisms 310A, 310B and then released by the retaining mechanisms 310A, 310B or the like, for example), the surface of the carrying plate 402 having a large frictional coefficient preferably contacts the processing subject T. Further, when the carrying plate 402 alone is moved away while the carrying plate 402 and the processing subject T are clamped between the upper and lower clamping plates 702 and 704 (FIGS. 22(*u*) and 23(*v*)) or the like, for example, the surface of the carrying plate 402 having a small frictional coefficient preferably contacts the processing subject T so that the folded processing subject T does not become wrinkled.

(R) As described in (1) of the [Features of the processing apparatus 1] according to the above embodiment, the processing apparatus 1 is configured such that when the upper portion of the processing subject T has been moved to the first side of the carrying plate 402 but the lower portion of the processing subject T is still on the second side of the carrying plate 402, the lower portion of the processing subject T remaining on the second side can be hoisted up and moved to the first side of the carrying plate 402 by rotating the carrying plate 402 toward the first side. In addition, the processing apparatus 1 may perform the following operation to shift the position in which the processing subject T hangs down onto the carrying plate 402 to the lower side of the processing subject T by controlling the retaining device control unit 904 and the carrying device control unit 906.

Figure 34:
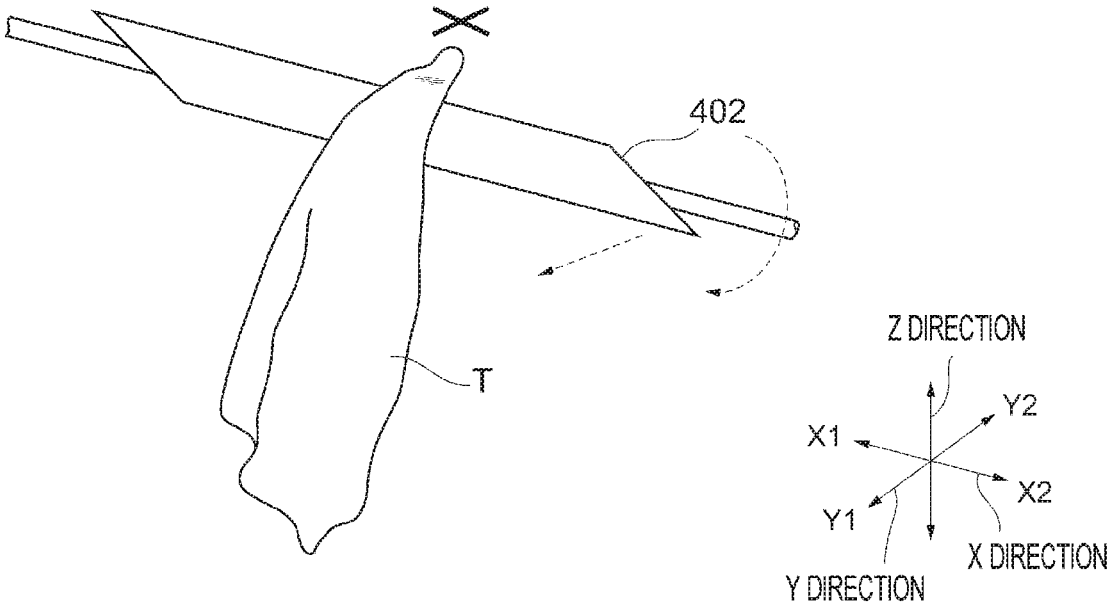
FIG. 34 is a view illustrating a T-shirt processing operation according to modified example (R).
Figure 34:
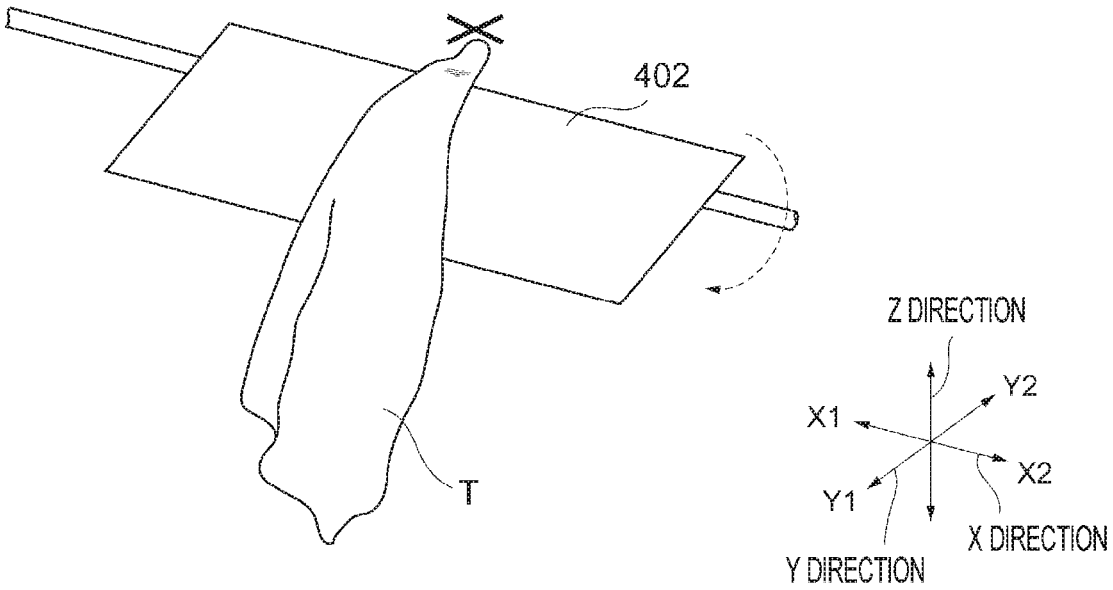
Figure 35:
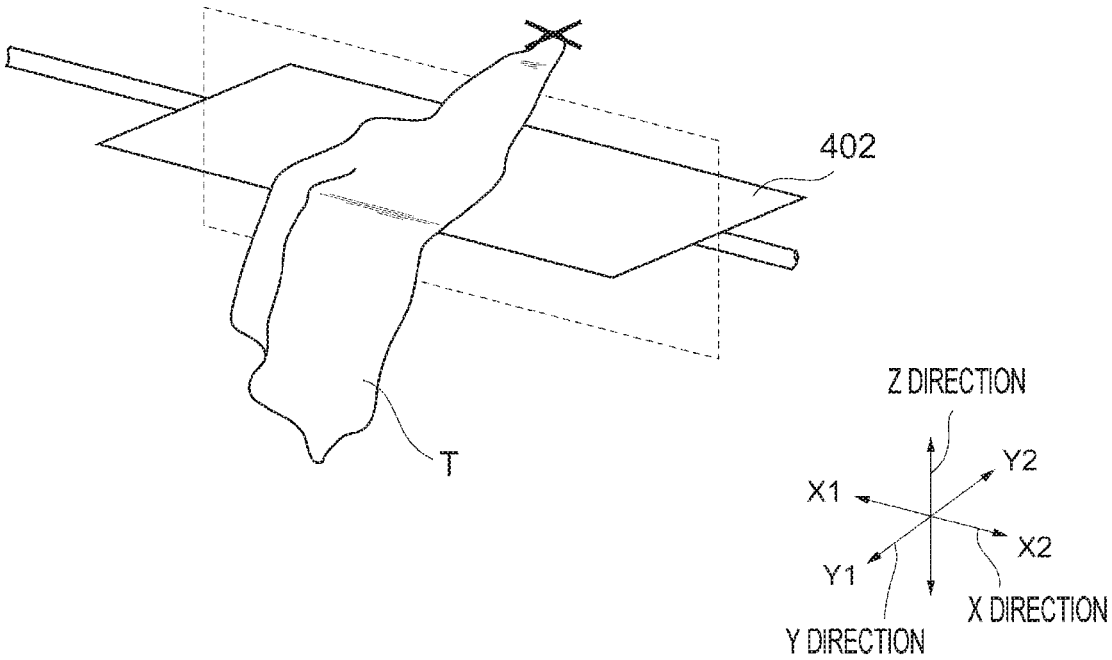
FIG. 35 is a view illustrating the T-shirt processing operation according to modified example (R).
Figure 35:
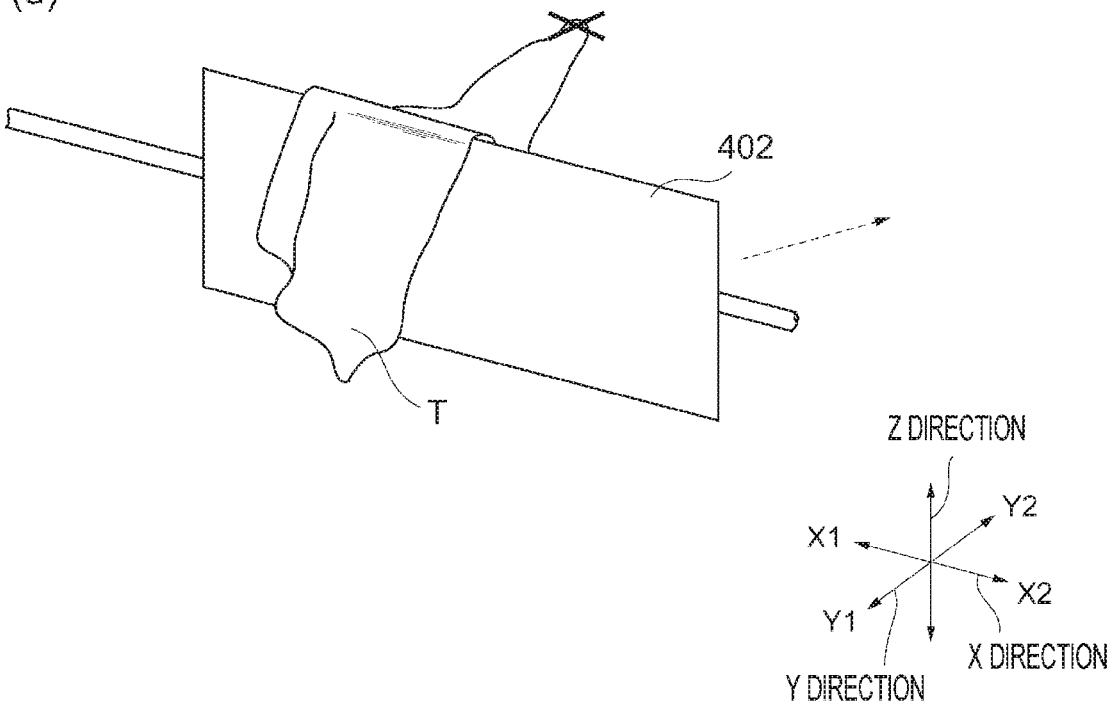
Figure 36:
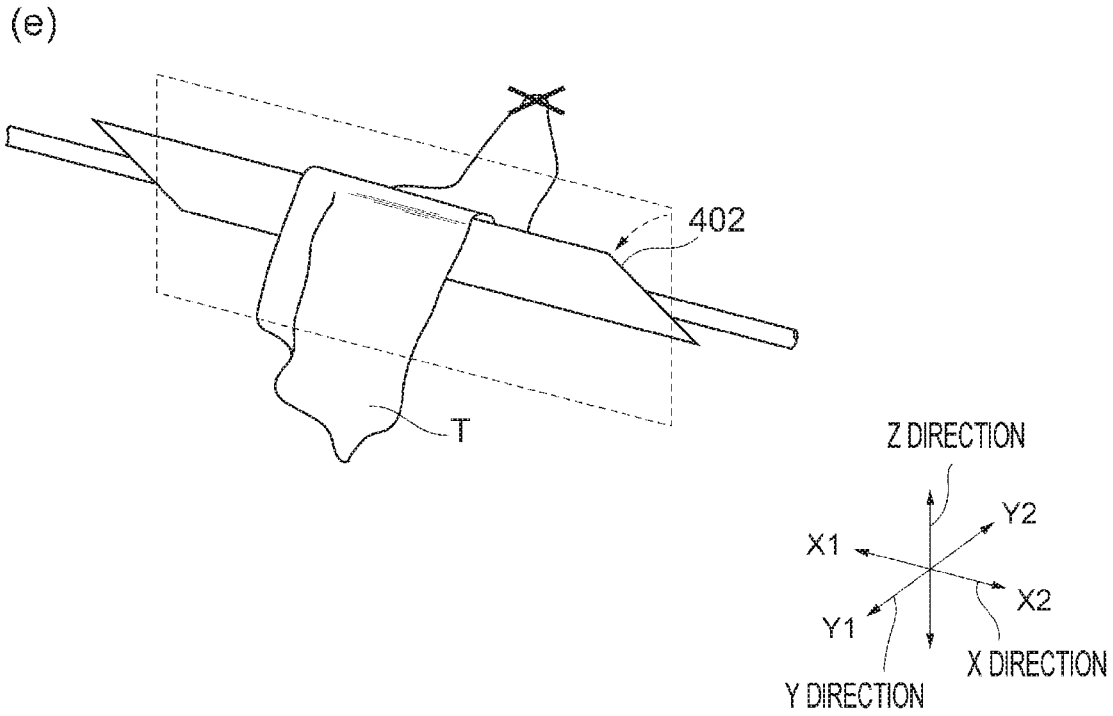
FIG. 36 is a view illustrating the T-shirt processing operation according to modified example (R).

As shown in FIG. 34(*a*), the processing subject T is lifted up over the carrying plate 402 to a prescribed position by the retaining mechanism 310A or 310B (not shown). In this condition, image data showing the processing subject T are obtained by the imaging device 500, and the length of the processing device T (for example, a distance from the position in which the processing subject T is retained by the retaining mechanism 310A or 310B to the lowermost point of the processing subject T) is calculated. Next, the carrying plate 402 is caused to move toward the far side (the direction of the arrow Y1) of the processing apparatus 1 while catching/hoisting the processing subject T by rotating the carrying plate 402 alternately in the forward direction and the reverse direction while keeping the position of the retaining mechanism 310A or 3106 fixed (FIGS. 34(*a*) and 34(*b*)). Once the carrying plate 402 has moved by a predetermined distance prescribed in accordance with the length of the processing subject T, movement thereof in the far side direction is stopped, and the carrying plate 402 is rotated to the vertical condition (FIG. 35(*c*)). Next, the carrying plate 402 is moved in the door direction (the direction of the arrow Y2) of the processing apparatus 1 while remaining vertical (FIG. 35(*d*)). At this time, the carrying plate 402 is held in the vertical condition, and therefore the processing subject T is retained securely on the upper edge of the carrying plate 402 and thereby prevented from sliding off as the carrying plate 402 moves. When the carrying plate 402 returns to a predetermined position, the carrying plate 402 is rotated to a predetermined angle (FIG. 36(*e*)). During the operation up to this point, the position of the retaining mechanism 310A or 310B remains fixed. In other words, by performing this operation, the position in which the processing subject T hangs down onto the carrying plate 402 can be shifted to the lower side of the processing subject T without moving the retaining mechanism 310A or 310B. This operation is particularly effective when unfurling a long processing subject T in a situation where the movable range of the retaining mechanism 310A or 310B is limited.

(S) In the above embodiment, a processing operation in which the T-shirt T is used as the processing subject T was described, but needless to mention, the type of processing subject T processed by the processing apparatus 1 is not limited to a T-shirt. A recognition process and a folding process performed when slacks T are used as the processing subject T will be described below. The reception transportation process and the transportation process are identical to those of a case in which the processing subject T is the T-shirt T, and therefore description thereof has been omitted.

Figure 37:
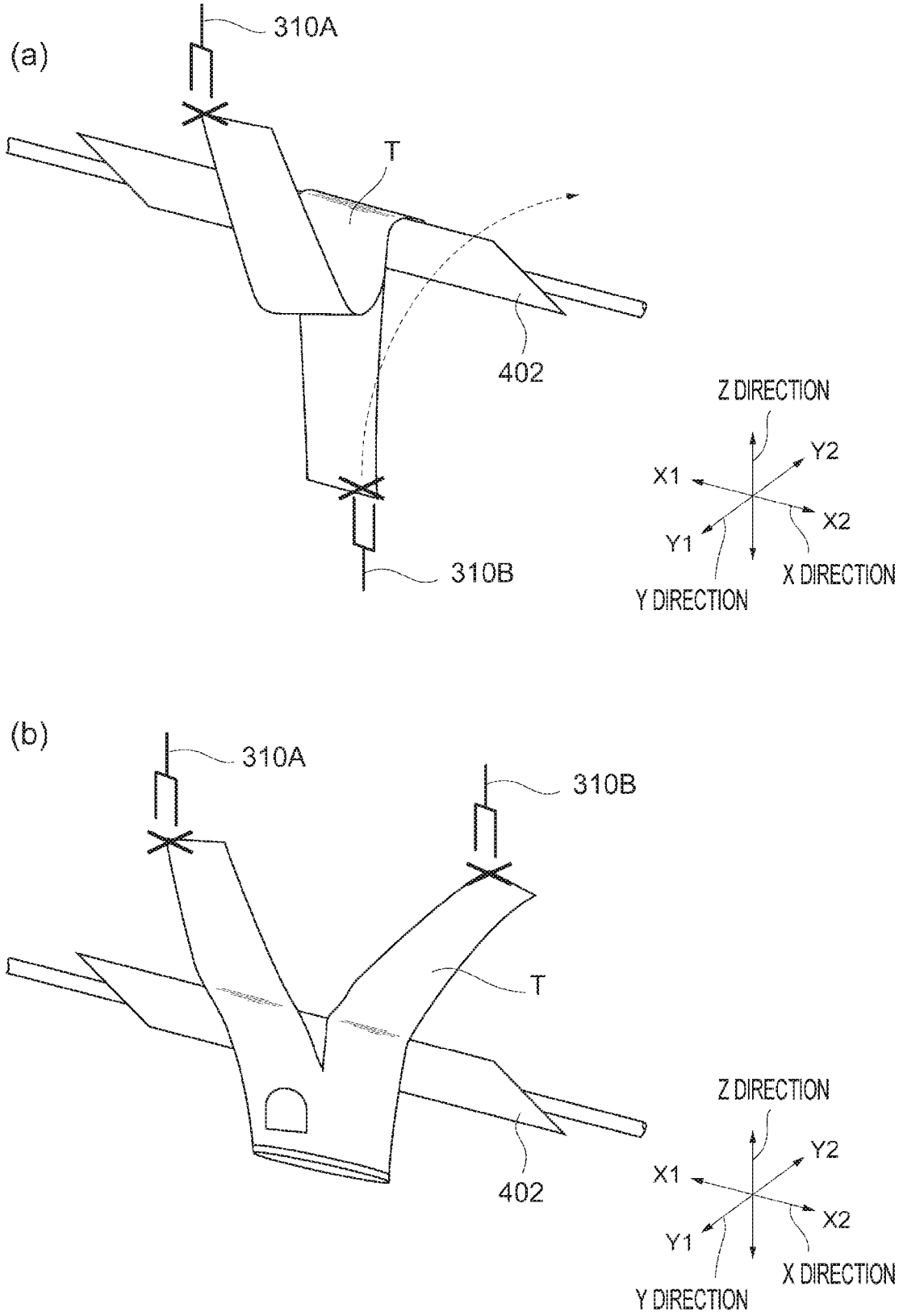
FIG. 37 is a view illustrating a slacks processing operation according to modified example (S).

By switching the lowermost point of the slacks T repeatedly as shown in FIG. 37(*a*) after the first point P of the processing subject T has been retained and lifted up by the retaining mechanism 310A at the end of the reception transportation process, the retaining mechanisms 310A and 310B end up retaining the respective lower edges of the slacks T as shown in FIG. 37(*b*). The image data showing the processing subject T are input into the type recognition unit 914 from the imaging device 500 every time the lowermost point of the processing subject T is switched, and when image data showing this condition are input, the type recognition unit 914 recognizes the slacks T as "slacks" and obtains the folding information corresponding to "slacks". Further, at this time, the length detection unit 915 measures dimensions of respective parts of the slacks T, such as the width of a waist part of the slacks T and the length from the waist to the lower edges, on the basis of the image data obtained from the imaging device 500, and stores the measurement results temporarily in the RAM or the like of the control device 900.

Figure 38:
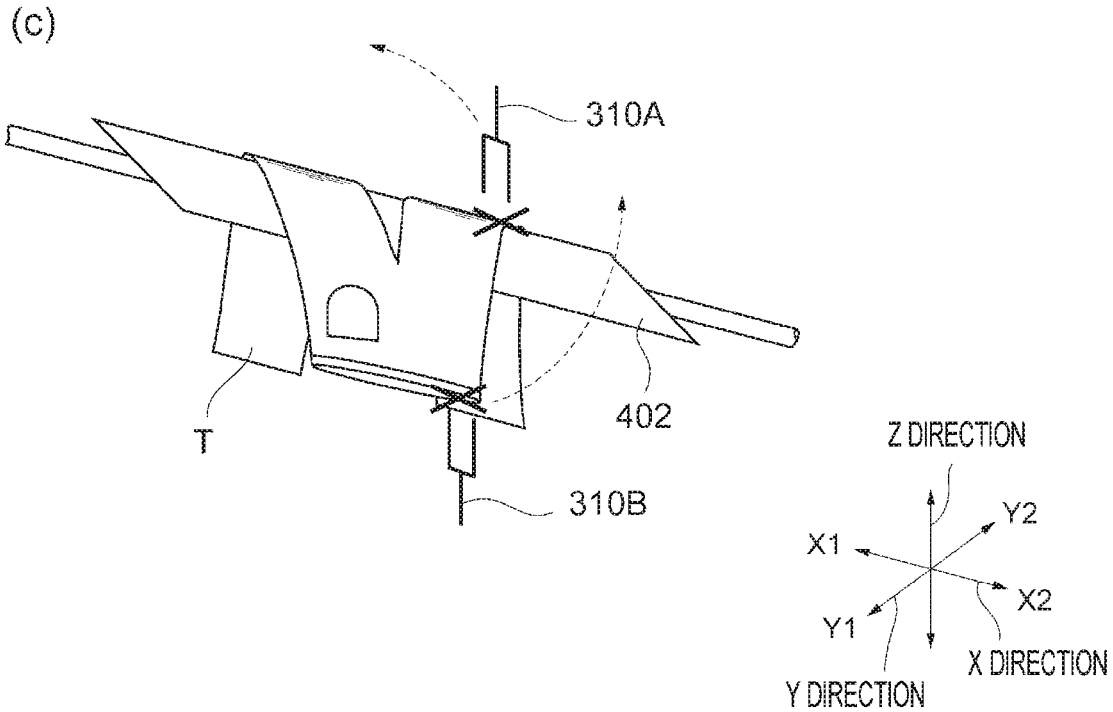
FIG. 38 is a view illustrating the slacks processing operation according to modified example (S).
Figure 38:
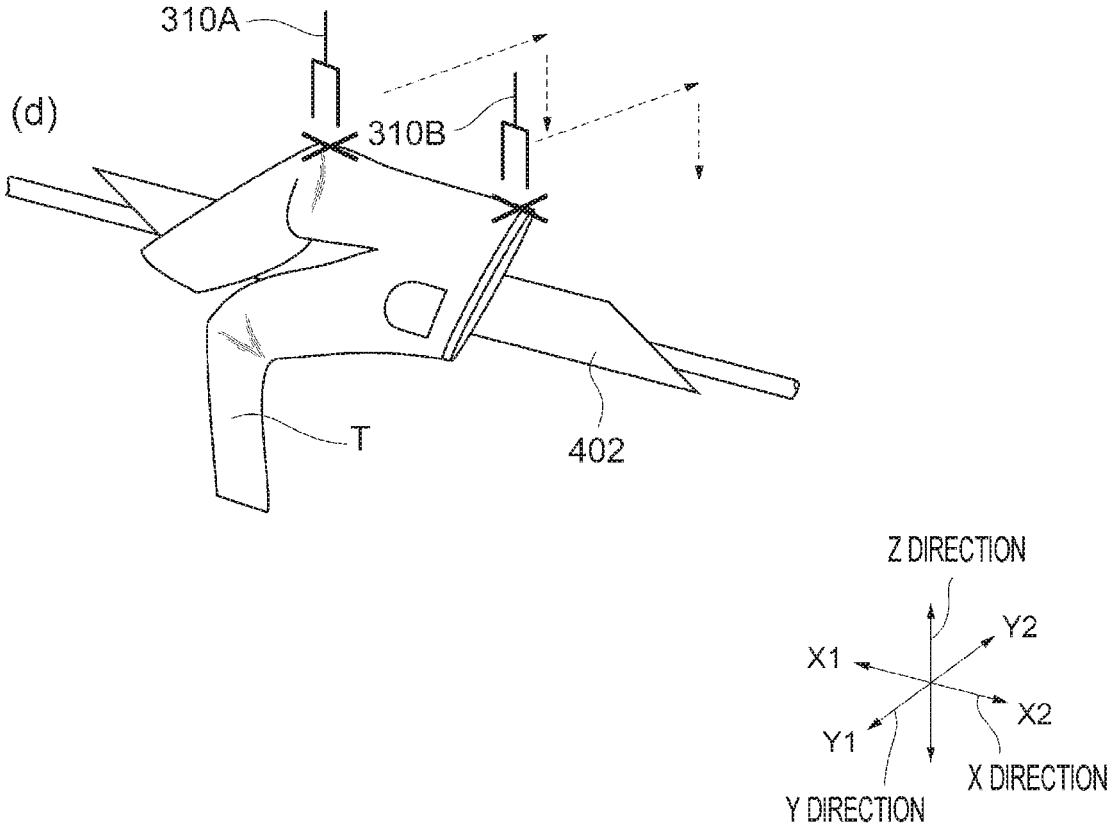

Next, the folding process is started. First, as shown in FIG. 38(*c*), the slacks T are caught on and lowered onto the carrying plate 402 in a substantially central position in a lengthwise direction thereof. In this condition, the retaining mechanism 310A retains and lifts up an end portion of the slacks T lying on the carrying plate 402, and the retaining mechanism 310 B retains and lifts up an end portion of the waist of the slacks T hanging down from the carrying plate 402. Next, the retaining mechanisms 310A and 310B are moved on the basis of the width of the waist part of the slacks T so that a straight line linking a central portion of the waist part and a crotch part of the slacks T is disposed on the edge line of the carrying plate 402 (FIGS. 38(*d*) and 39(*e*)). When it is determined at this time on the basis of the image data of the processing subject T obtained from the imaging device 500 that a part of an inseam of the slacks T remains on the carrying plate 402, the retaining mechanism 310A retains the remaining inseam part and removes the remaining part from the carrying plate 402 (FIG. 39(*e*)).

Figure 39:
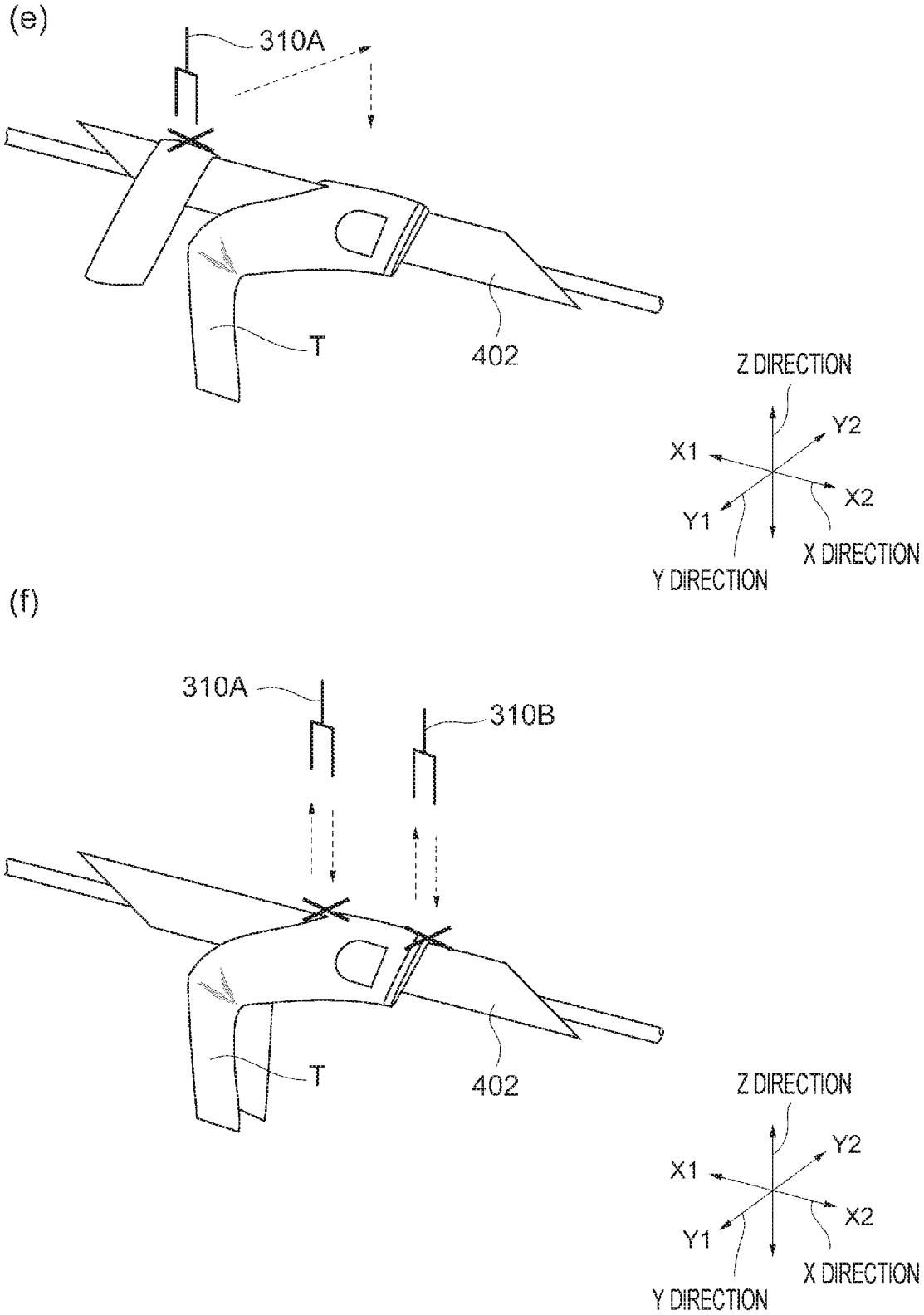
FIG. 39 is a view illustrating the slacks processing operation according to modified example (S).
Figure 40:
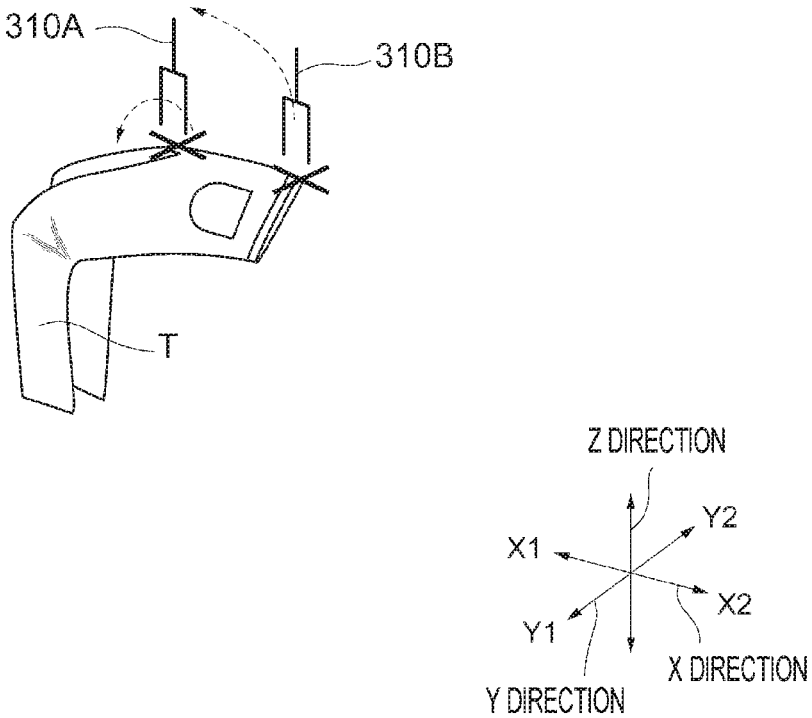
FIG. 40 is a view illustrating the slacks processing operation according to modified example (S).
Figure 40:
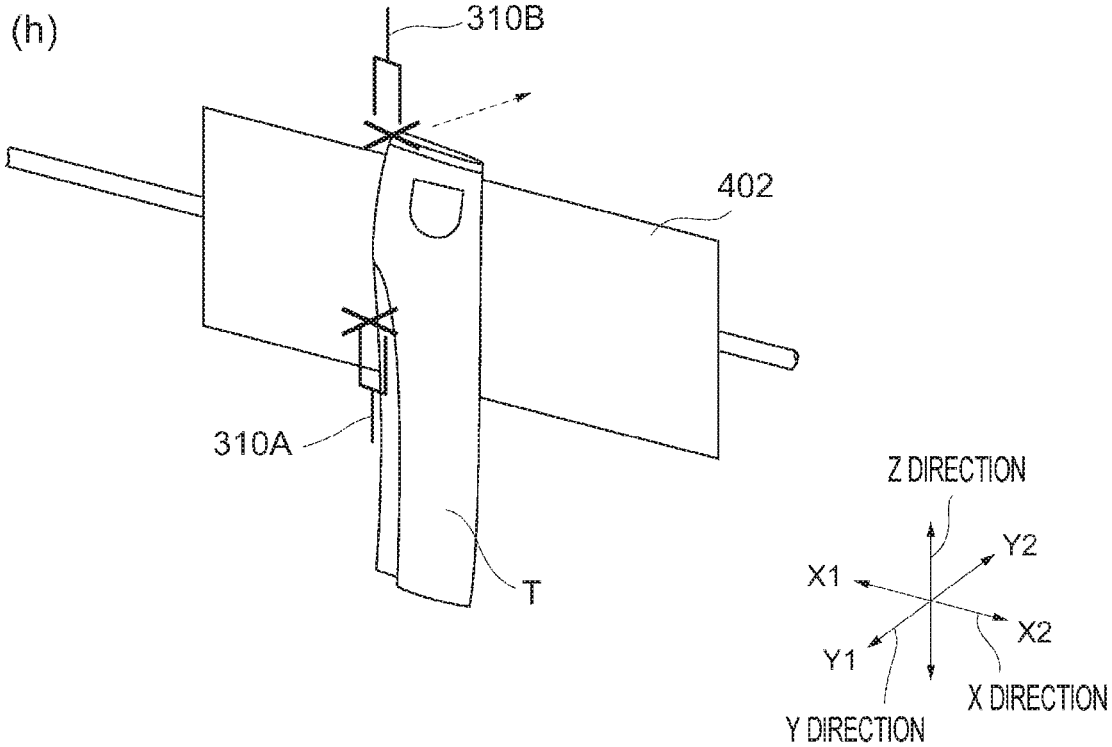
Figure 41:
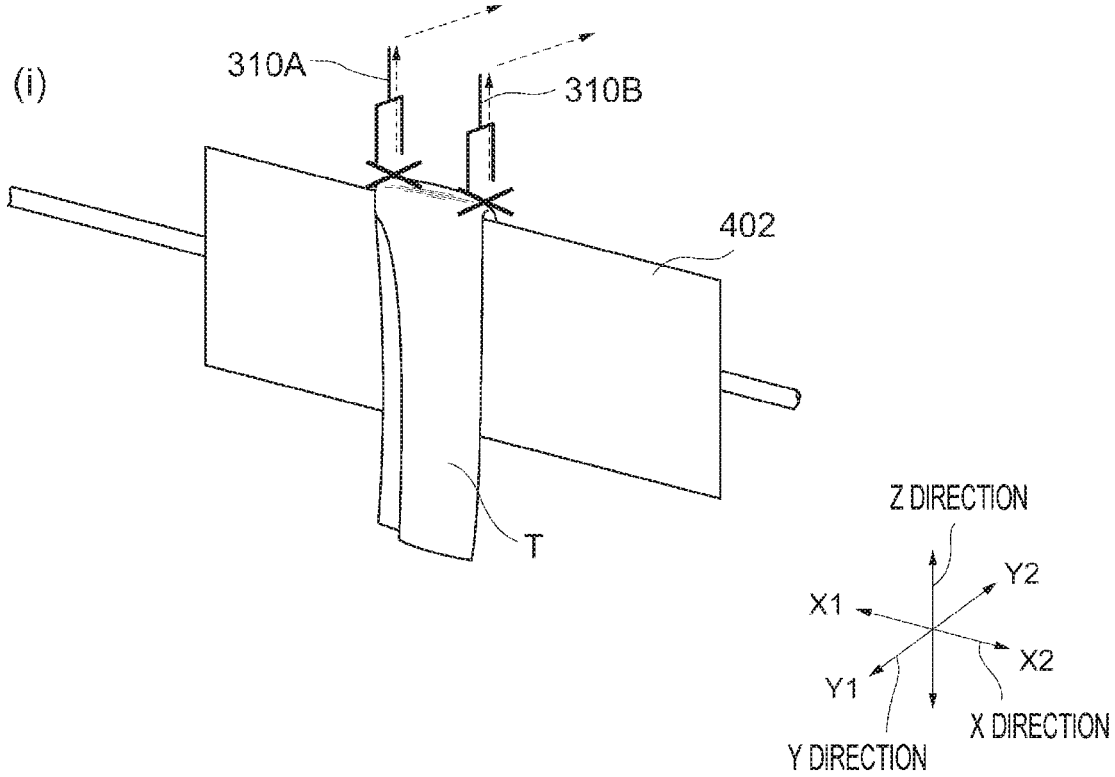
FIG. 41 is a view illustrating the slacks processing operation according to modified example (S).
Figure 41:
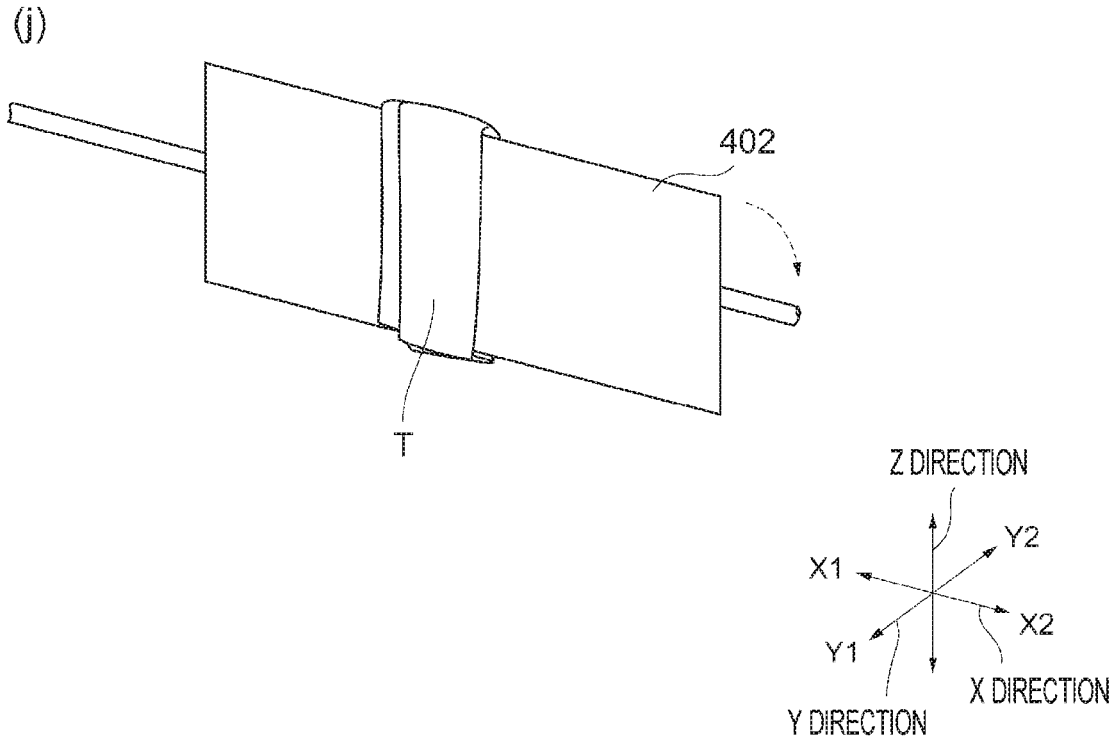
Figure 42:
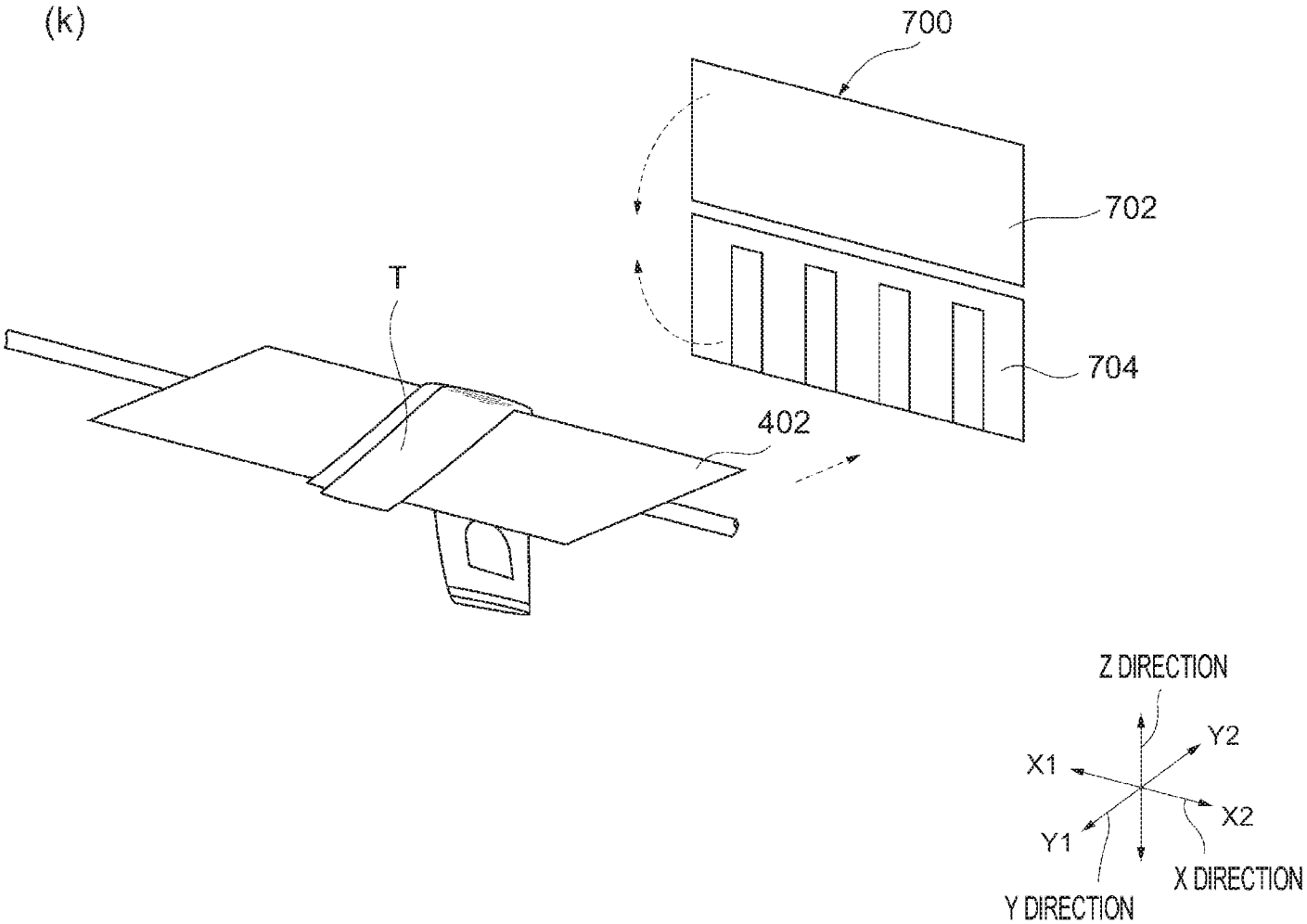
FIG. 42 is a view illustrating the slacks processing operation according to modified example (S).

Next, the crotch part and the central portion of the waist part of the slacks T are retained and lifted up from the carrying plate 402 by the respective retaining mechanisms 310A and 310B so as to be removed from the carrying plate 402 (FIG. 39(*f*)), whereupon the retaining mechanism 310B is rotated about the retaining mechanism 310A (FIG. 40(*g*)) such that the slacks T hang down vertically from the waist part toward the lower edges (FIG. 40(*h*)). From this condition, the retaining mechanism 310B is moved to the opposite side of the carrying plate 402 (in the direction of the arrow Y2) so that the slacks T are temporarily caught on the carrying plate 402 (FIG. 41(*i*)). Next, the respective end portions of the slacks T temporarily placed on the carrying plate 402 are retained by the retaining mechanisms 310A and 310B, whereupon the retaining mechanisms 310A and 310B are moved to the opposite side of the carrying plate 402 (in the direction of the arrow Y2) so that the lengthwise direction center of the slacks T (half the length thereof from the waist to the lower edges) is caught on the carrying plate 402 (FIG. 41(*j*)). Next, the carrying device control unit 906 rotates the carrying plate 402 in the horizontal direction so as to move the carrying plate 402 in the horizontal direction to the vicinity of the clamping device 700 (FIG. 42(*k*)). When the carrying plate 402 approaches, the upper side clamping plate 702 and the lower side clamping plate 704 of the clamping device 700 are rotated in the mutually approaching direction (FIG. 42(*k*)). As a result, the waist portion of the slacks T hanging down from the carrying plate 402 is lifted up by the lower side clamping plate 704, whereby folding is completed.

(T) In the processing apparatus 1 according to the above embodiment, once the folding process is started (FIG. 14), a folding operation corresponding to the type of the processing subject T recognized in the recognition process (FIG. 13) is continued on the assumption that the type of the processing subject T has been recognized correctly. However, the processing subject T may be recognized erroneously in the recognition process (FIG. 13), and the folding operation may be performed on the basis of the erroneous recognition (for example, the processing subject T may be recognized mistakenly as a T-shirt even though in actuality the processing subject T is a pair of slacks, and a T-shirt folding method may be applied to the slacks). Hence, image data showing the processing subject T may be obtained by the imaging device 500 during or after the folding process, and a determination may be made on the basis of the image data as to whether or not the processing subject T deviates from a prescribed folded shape corresponding to the type thereof. When it is determined that the processing subject T deviates from the prescribed folded shape, the type of the processing subject T may be determined to have been recognized erroneously, and the folding operation may be interrupted, whereupon the retaining mechanisms 310A, 310B retain the processing subject T again and the recognition process is restarted. Alternatively, the processing subject T may be determined to be "unfoldable", and the folding process may be interrupted, whereupon the retaining mechanisms 310A, 310B store the processing subject T in a predetermined location within the processing apparatus 1, for example a dedicated storage box (for an example of this storage box, see the "unprocessed item storage portion H2" to be described in detail below in "(Y)").

(U) In the processing apparatus 1 according to the above embodiment, the type recognition unit 914 recognizes the type of the processing subject T as a "T-shirt" in a condition where the respective ends of the sleeve openings of the T-shirt T are retained by the retaining mechanisms 310A, 310B (FIG. 19(*j*)). In other words, when the type of the processing subject T is a "T-shirt", the end point switching operation is repeated until the retaining mechanisms 310A, 310B retain the respective ends of the sleeve openings of the T-shirt T. Depending on the retaining condition, however, either the retaining mechanisms 310A, 310B may not be able to retain the respective ends of the sleeve openings of the T-shirt T regardless of how many times the switching operation is repeated, or an extremely large number of repetitions may be required to retain the respective ends of the sleeve openings. When the retaining condition of the processing subject T is found to be in this deadlocked condition (when the image data generated by the imaging device 500 indicates a predetermined shape, when the number of times the lowermost point of the processing subject T is switched reaches or exceeds a predetermined number, or the like, for example), the retaining device control unit 904 may release the processing subject T from both of the retaining mechanisms 310A, 310B so that the processing subject T drops onto the transportation conveyor 204 or is placed on the carrying plate 402, and then restart the operation for grabbing the lowermost point using the retaining mechanism 310A (310B). Alternatively, it may be determined that the processing subject T "cannot be unfurled", and the recognition process may be interrupted, whereupon the retaining mechanisms 310A, 310B store the processing subject T in a predetermined location within the processing apparatus 1, for example a dedicated storage box (for an example of this storage box, see the "unprocessed item storage portion H2" to be described in detail below in "(Y)").

An example of a method of resolving a deadlocked condition by recognizing that the T-shirt T serving as the processing subject T is retained in a horizontal orientation will now be described using FIGS. 43 and 44.

Figure 43:
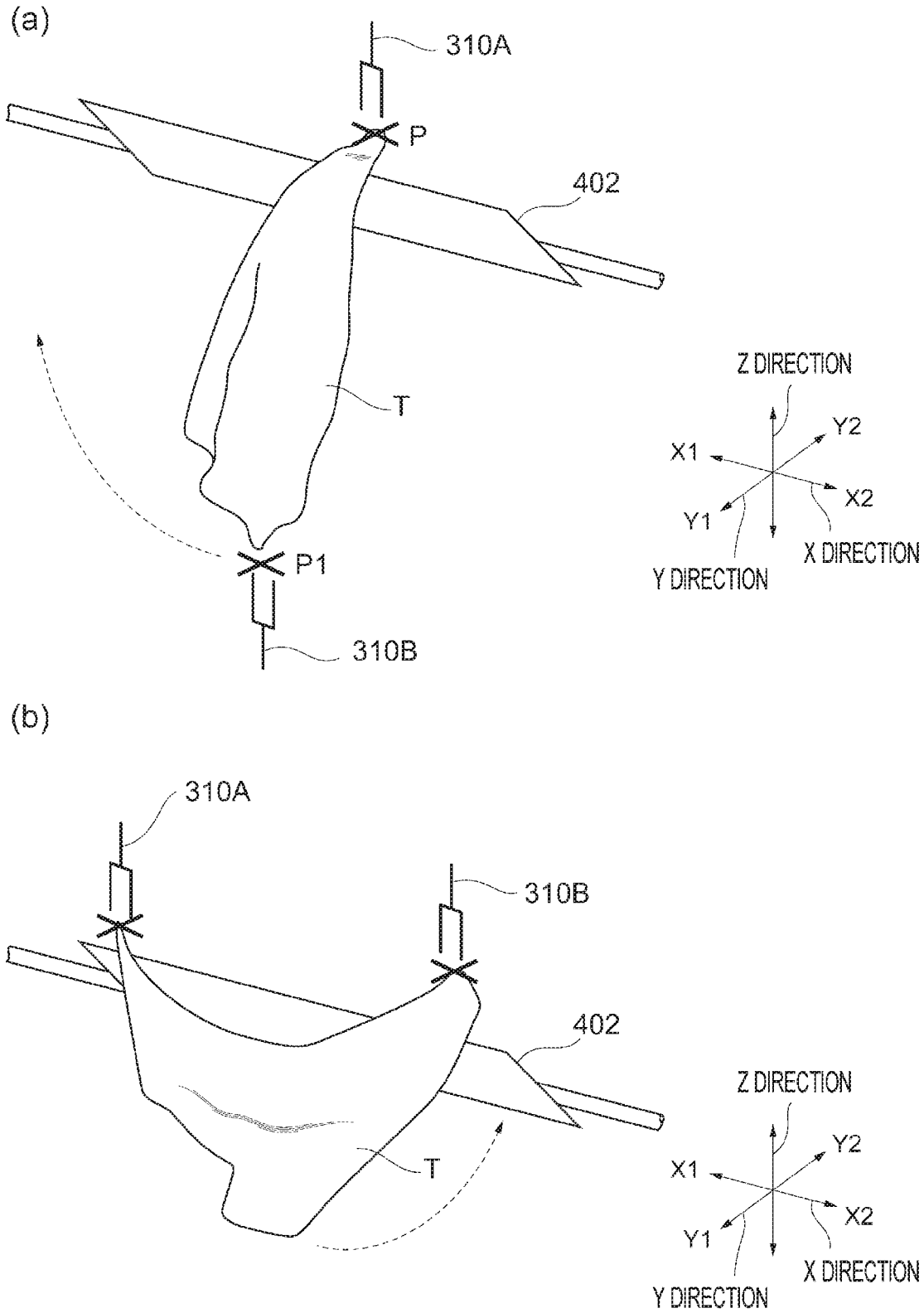
FIG. 43 is a view illustrating a T-shirt processing operation according to modified example (U).
Figure 44:
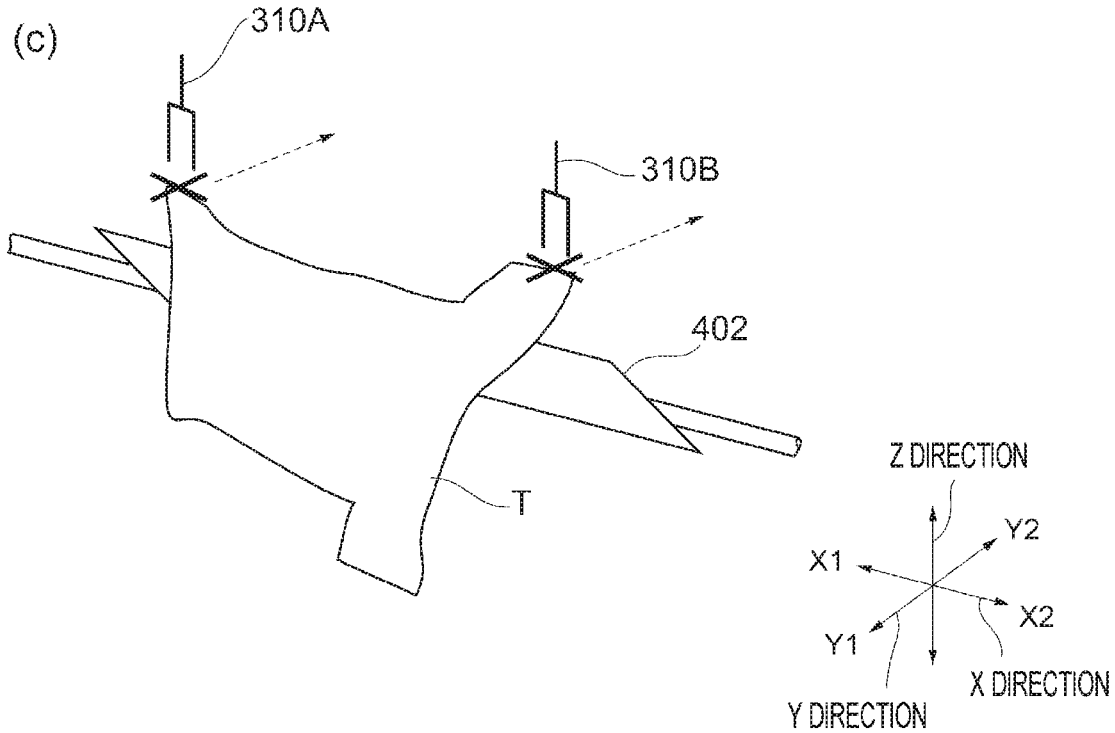
FIG. 44 is a view illustrating the T-shirt processing operation according to modified example (U).
Figure 44:
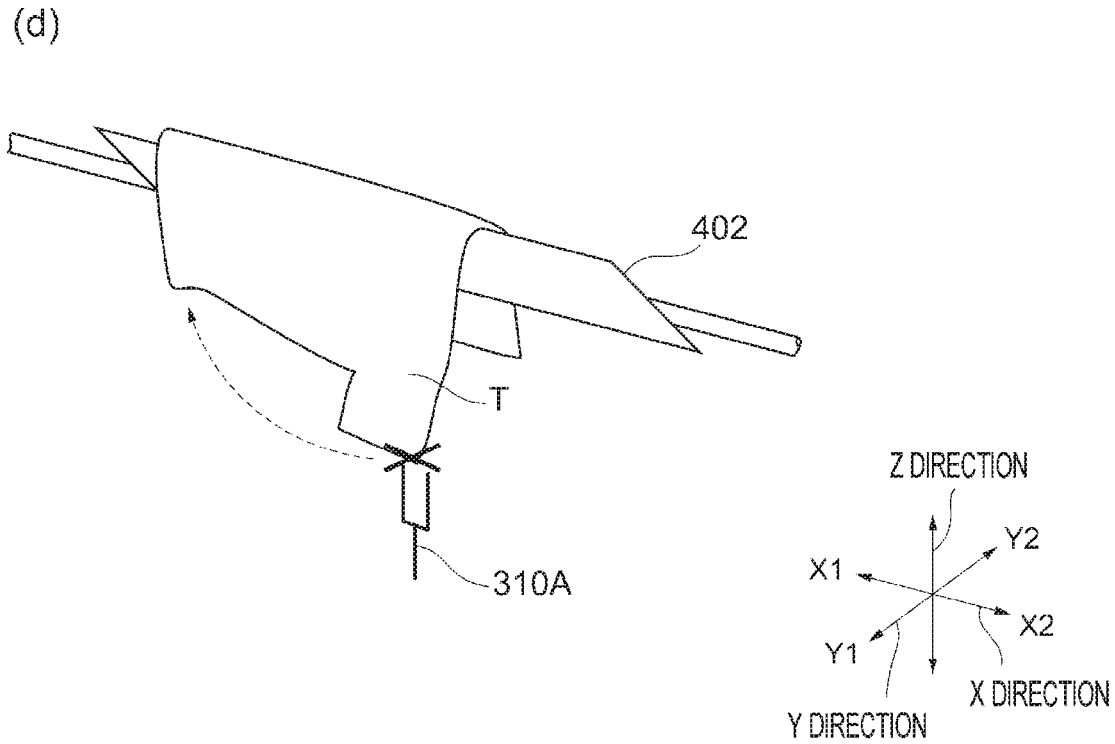

When the lowermost point (the end point furthest removed from the straight line linking the parts of the processing subject T retained by the retaining mechanisms 310A, 310B) is switched repeatedly (FIG. 43(*b*)) from a condition in which the first point P and the first end point P1 are retained (FIG. 43(*a*)), the T-shirt T may be retained in a lateral orientation (FIG. 44(*c*)). The retaining device control unit 904 determines that a deadlocked condition is established (i.e. that the respective ends of the sleeve openings of the T-shirt T will not be retained by the retaining mechanisms 310A, 310B even if the switching operation is continued normally) after recognizing, on the basis of the image data showing the T-shirt T, which are input therein from the imaging device 500, that the T-shirt T has been retained in the lateral orientation. In this case, the retaining device control unit 904 moves the retaining mechanisms 310A, 310B in the horizontal direction (the Y2 direction) toward the carrying plate 402, and releases the T-shirt T so that the T-shirt hangs down over the carrying plate 402 (FIG. 44(*d*)). In this condition, the retaining device control unit 904 detects an end portion (in this example, one of the sleeve openings of the T-shirt T) serving as a Z direction lowermost point of the T-shirt T on the basis of the image data input from the imaging device 500, and causes the retaining mechanism 310A to grip this end portion. Then, by repeating the lowermost point gripping operation normally (in this example, one of the sleeve openings of the T-shirt T has been gripped, and therefore two further operations are required) or, since in this example the type of the processing subject T has already been recognized as a "T-shirt", by directly gripping the other sleeve opening of the T-shirt T (in this case, one further operation is required), the respective ends of the sleeve openings of the T-shirt T are retained by the retaining mechanisms 310A, 300B. In so doing, the deadlocked condition can be resolved, and as a result, the processing prior to the folding process can be completed more quickly.

Figure 14:
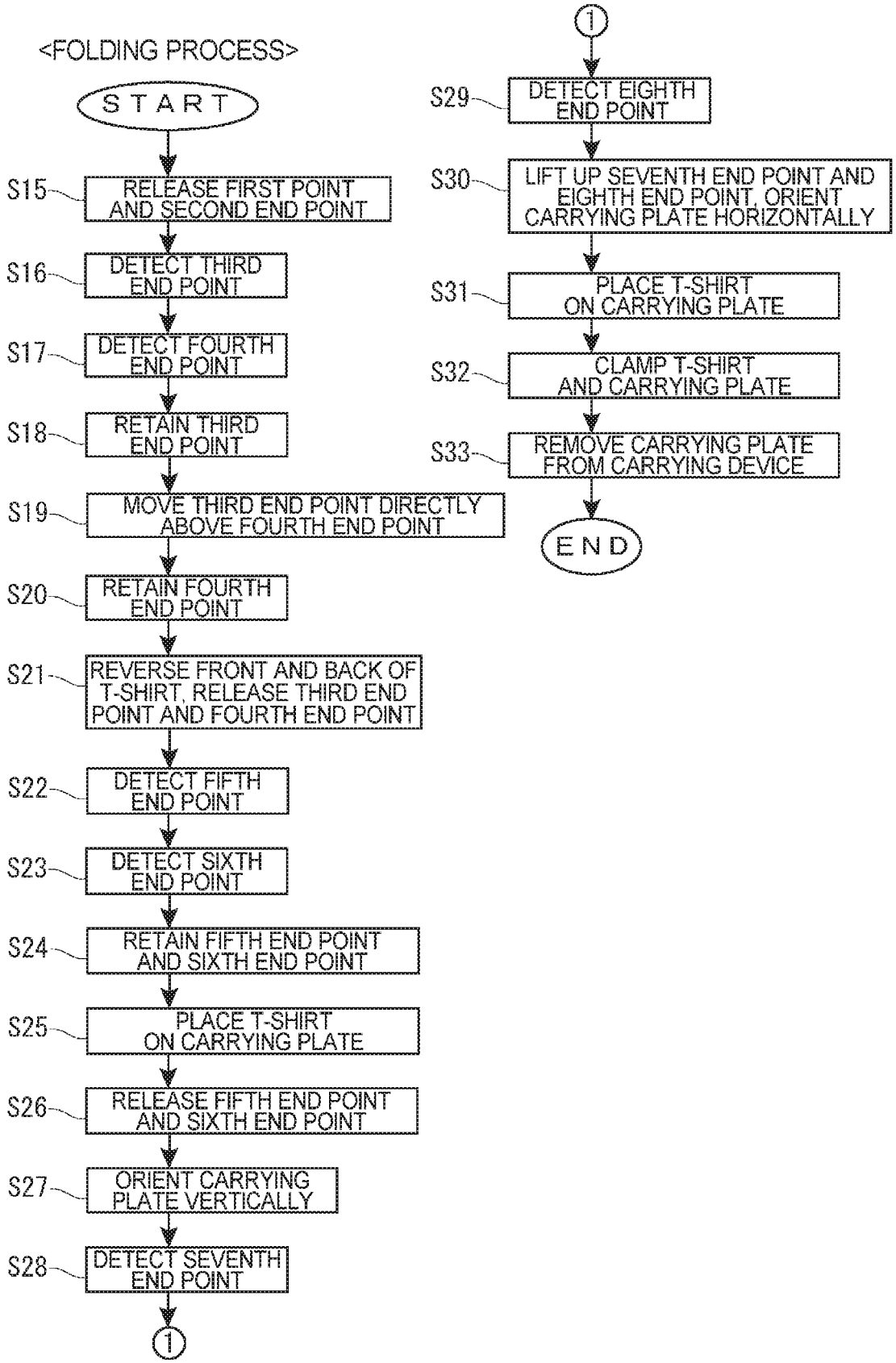
FIG. 14 is a flowchart showing a T-shirt folding process performed by the processing apparatus shown in FIG. 1.
Figure 15:
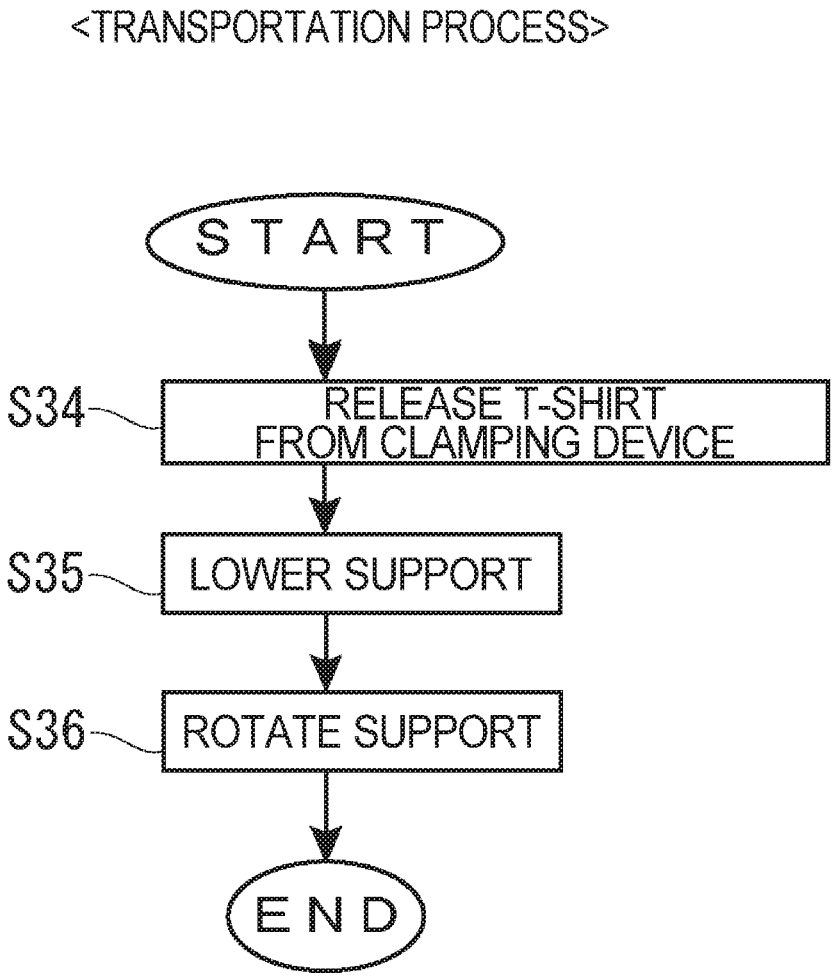
FIG. 15 is a flowchart showing a T-shirt transportation process performed by the processing apparatus shown in FIG. 1.

(V) In the processing apparatus 1 according to the above embodiment, the T-shirt folding process (FIGS. 14 and 19(*k*)) is started as soon as the type recognition unit 914 recognizes the type of the processing subject T as a "T-shirt" after the respective ends of the sleeve openings of the T-shirt T are retained by the retaining mechanism 310A, 310B (FIG. 19(*j*)). However, the timing at which to recognize the type of the processing subject T and the shape of the processing subject T required for recognition are not limited thereto. For example, the type recognition unit 914 may recognize the type of the processing subject T before the processing subject T is unfurled (during the reception transportation process, for example) or while the processing subject T is being unfurled (before the processing subject T achieves the shape required to start the folding process), whereupon the unfurling operation may be performed in accordance with the recognized type of the processing subject T so that the processing subject T achieves the shape required to start the folding operation (in the example of the T-shirt T, the condition shown in FIG. 19(*j*), in which the respective ends of the sleeve openings of the T-shirt T are retained by the retaining mechanisms 310A, 310B). As a method of recognizing the processing subject T early before the processing subject T is unfurled or while the processing subject T is being unfurled, data associating a certain specific feature of the outer appearance of the processing subject T (a specific color ("yellow", for example), a specific character string ("ABC" or the like, for example), a specific pattern or mark ("stripes", for example), and so on) with the type of the processing subject T may be retained in advance in the type recognition unit 914, for example, and the type recognition unit 914 may recognize the type of the processing subject after detecting this feature of the outer appearance. By determining the type of the processing subject T before the processing subject T is unfurled or while the processing subject T is being unfurled and then performing an optimum unfurling operation corresponding to the type of the processing subject T, the processing prior to the folding process can be completed more quickly.

Figure 46:
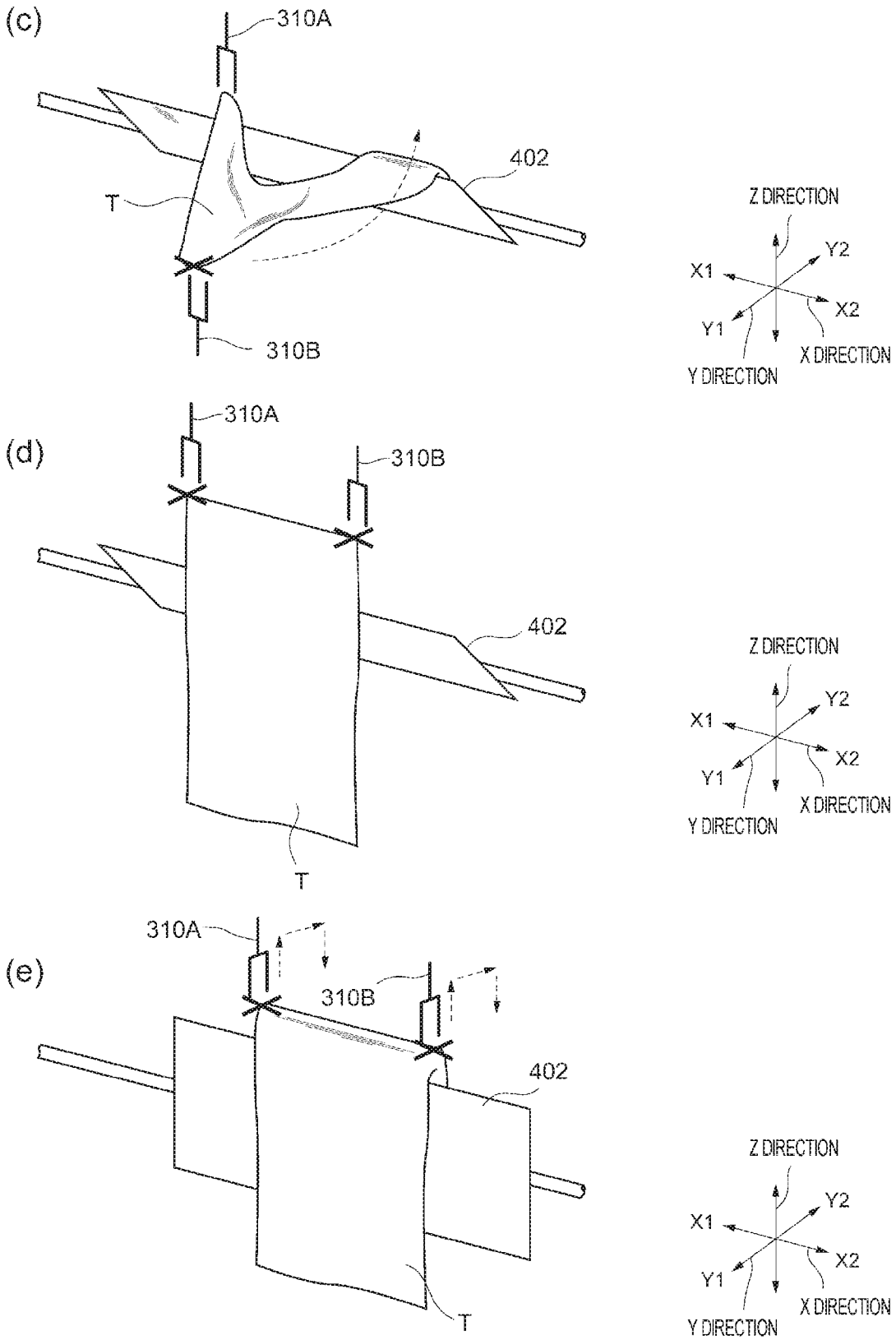
FIG. 46 is a view illustrating the towel processing operation according to modified example (V).
Figure 47:
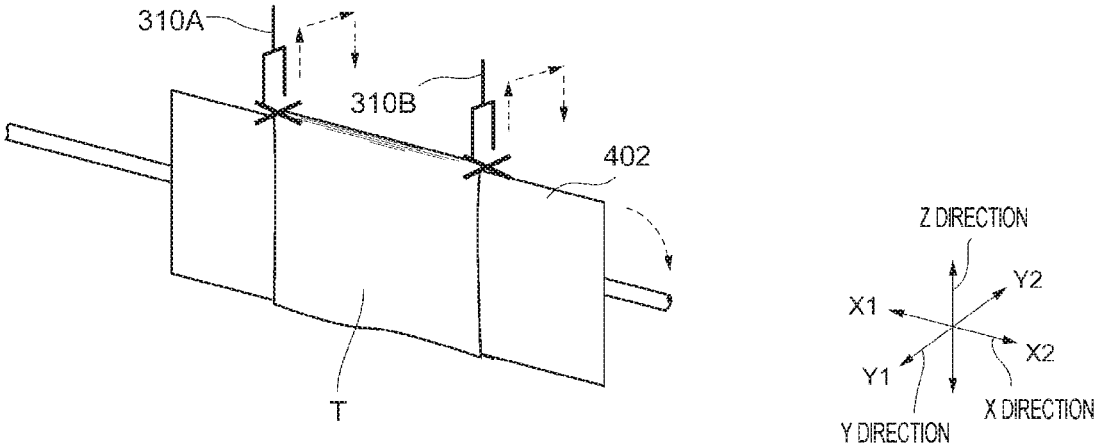
FIG. 47 is a view illustrating the towel processing operation according to modified example (V).
Figure 47:
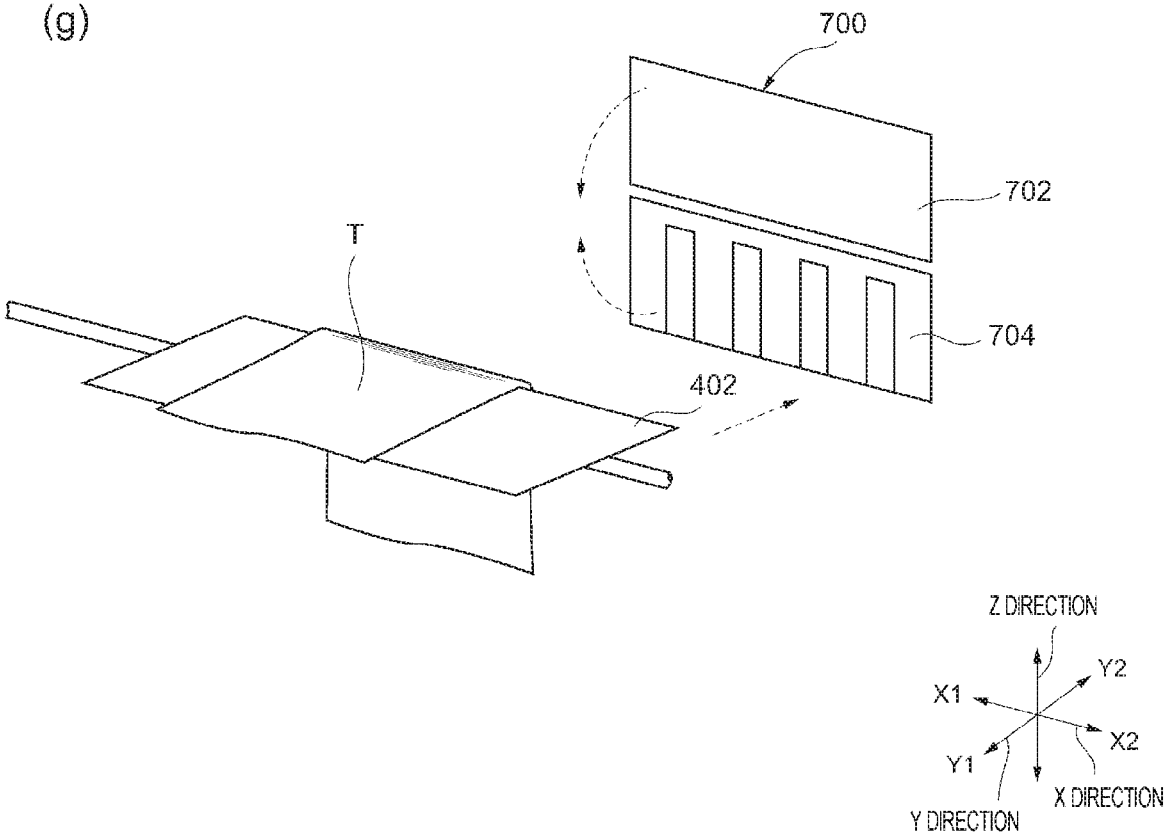

An example of a method of recognizing that the processing subject T is a "towel" while the processing subject is being unfurled and then unfurling and folding the processing subject T will now be described using FIGS. 45 to 47.

Figure 45:
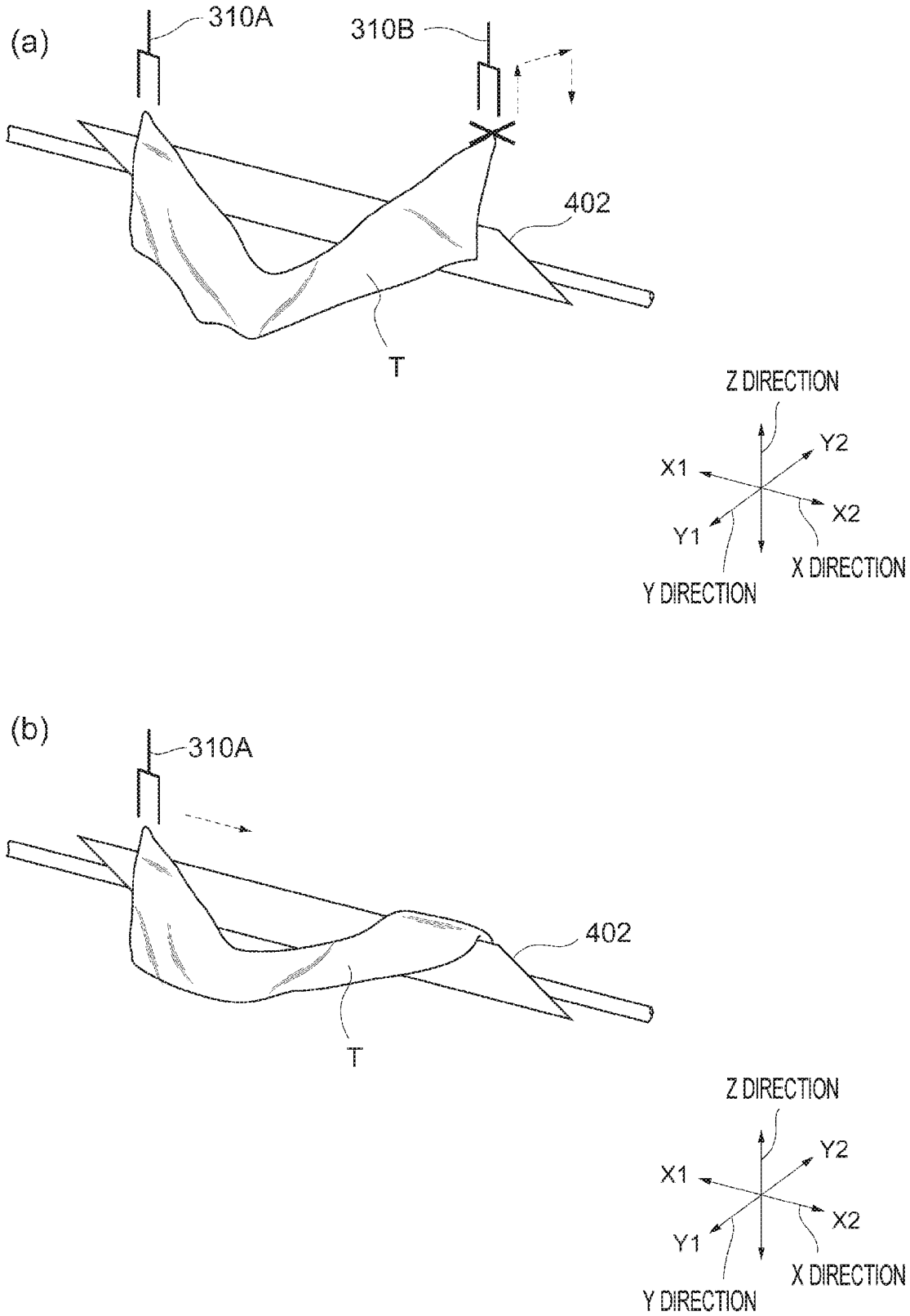
FIG. 45 is a view illustrating a towel processing operation according to modified example (V).

When the type of the processing subject T is a "towel" and the lowermost point (the end point furthest removed from the straight line linking the parts of the processing subject T retained by the retaining mechanisms 310A, 310B) is switched repeatedly, as shown in FIG. 45(*a*), the processing subject T takes on a specific shape in which a central part thereof hangs down in a downward direction (the Z direction) from respective width direction (X direction) end portions. At this stage, the type recognition unit 914 recognizes that the processing subject T is a "towel" on the basis of the image data obtained from the imaging device 500. The retaining device control unit 904 then performs a following unfurling operation determined in advance for use with a "towel" in order to set the processing subject T in an optimum shape for starting the folding operation (in this example, a condition shown in FIG. 46(*d*)).

First, the retaining mechanism 310B is moved in the horizontal direction (the Y2 direction) toward the carrying plate 402 and then caused to release the processing subject T so that one lengthwise direction end portion of the towel serving as this processing subject T hangs down over the carrying plate 402 (FIG. 45(*b*)). Next, the retaining mechanism 310A is moved in a width direction center direction (the X2 direction) of the carrying plate 402 while continuing to grip the processing subject T (FIG. 45(*b*)), whereby the other lengthwise direction end portion of the towel serving as the processing subject T becomes the lowermost point (FIG. 46(*c*)). The retaining mechanism 310B then grips the other lengthwise direction end portion, with the result that the processing subject T achieves the shape required to start the folding operation (FIG. 46(*d*)). By determining the type of the processing subject T (in this case, a towel) and performing an optimum unfurling operation corresponding to the type in this manner, the processing prior to the folding process can be completed more quickly.

Note that when the processing subject T is a "towel", the folding process is performed as follows. In the condition shown in FIG. 46(*d*), the control device 900 calculates the length (the lengthwise direction size) of the towel serving as the processing subject T on the basis of the image data obtained from the imaging device 500, and then calculates the number of required folds (in this example, two folds are required, for example). Next, the carrying device control unit 906 rotates the carrying plate 402 to the vertical orientation. In this condition, the retaining device control unit 904 moves the retaining mechanisms 310A, 310B toward the carrying plate so that the lengthwise direction center of the processing subject T, i.e. the part thereof that is hanging down, is placed over the upper edge portion of the carrying plate 402, then causes the retaining mechanisms 310A, 310B to release the processing subject T temporarily, and then causes the retaining mechanisms 310A, 310B to grip the respective end portions of the processing subject T positioned on the carrying plate 402 again (FIG. 46(*e*)). In this condition, the processing subject T is not sufficiently folded, and therefore folding is performed once more. More specifically, the retaining device control unit 904 moves the retaining mechanisms 310A, 310B toward the carrying plate so that the lengthwise direction center of the processing subject T, i.e. the part thereof that is hanging down, is placed over the upper edge portion of the carrying plate 402, and then causes the retaining mechanisms 310A, 310B to release the processing subject T (FIG. 47(*f*)). At this time, the towel serving as the processing subject T is folded in four in the lengthwise direction. Next, the carrying device control unit 906 rotates the carrying plate 402 in the horizontal direction (FIG. 47(*g*)), and then moves the carrying plate 402 in the horizontal direction to the vicinity of the clamping device 700 (FIG. 47(*g*)). When the carrying plate 402 approaches, the clamping device control unit 910 rotates the upper side clamping plate 702 and the lower side clamping plate 704 of the clamping device 700 in the mutually approaching direction (FIG. 47(*g*)). As a result, the end portions of the processing subject T hanging down from the carrying plate 402 are lifted up by the lower side clamping plate 704, whereby folding is completed.

(W) In the above embodiment, the processing apparatus 1 recognizes the type of the processing subject T inserted therein after unfurling the processing subject T, and then folds the processing subject T in accordance with the recognized type thereof. Depending on the processing subject T, however, the type may be unrecognizable, and as a result, folding may be impossible. In this case, the control device 900 may determine that the processing subject T is "unrecognizable" and "unfoldable", interrupt the recognition process and the folding process, and separate this processing subject T from the other processing subjects T by causing the retaining mechanisms 310A, 310B to store the processing subject T in a predetermined location within the processing apparatus 1, for example a dedicated storage box (for an example of this storage box, see the "unprocessed item storage portion H2" to be described in detail below in "(Y)").

For example, when the control device 900 cannot recognize the processing subject T during the recognition process even after the lowermost point of the processing subject T has been switched more times than a predetermined threshold, the processing subject T may be determined to be "unrecognizable". When patterns corresponding only to a "T-shirt", "slacks", a "towel", and a "skirt" are stored in the control device 900 as the types of the processing subject T, for example, and a "sock" is inserted as the processing subject T, the features of the sock do not match the prestored features of a "T-shirt", "slacks", a "towel", and a "skirt" during the recognition process even after the lowermost point unfurling operation has been repeated a plurality of times, and therefore recognition of the processing subject T fails even after the lowermost point of the processing subject T has been switched more times than the predetermined threshold. In this case, the processing subject T (the sock) is stored in the dedicated storage box as an "unrecognizable" item.

Further, for example, the control device 900 may determine that the processing subject T is "unfoldable" and store the processing subject T in the dedicated storage box when the end points of the processing subject T required to fold the processing subject T cannot be recognized during the folding process or it is determined that the processing subject T cannot be retained on the carrying plate 402 with stability (for example, when the size of the processing subject T exceeds a predetermined allowable folding size corresponding to the type or the like).

(X) In the above embodiment, the carrying device 400 including the carrying plate 402 was described, but the carrying device may include a carrying body that provides a plurality of points, one or a plurality of straight lines or curves, a planar surface, or a curved surface for carrying the processing subject T. Examples of such carrying bodies include one or a plurality of thread-like members (strings, wires, or the like, for example), one or a plurality of rod-shaped members or tubular members (in FIG. 8, for example, the carrying plate 402 may be removed and the rotary shaft 412 may be used in place of the carrying plate 402 or the like), a comb-shaped member (the plurality of teeth of the comb constitute a plurality of carrying points), and so on, for example.

Figure 48:
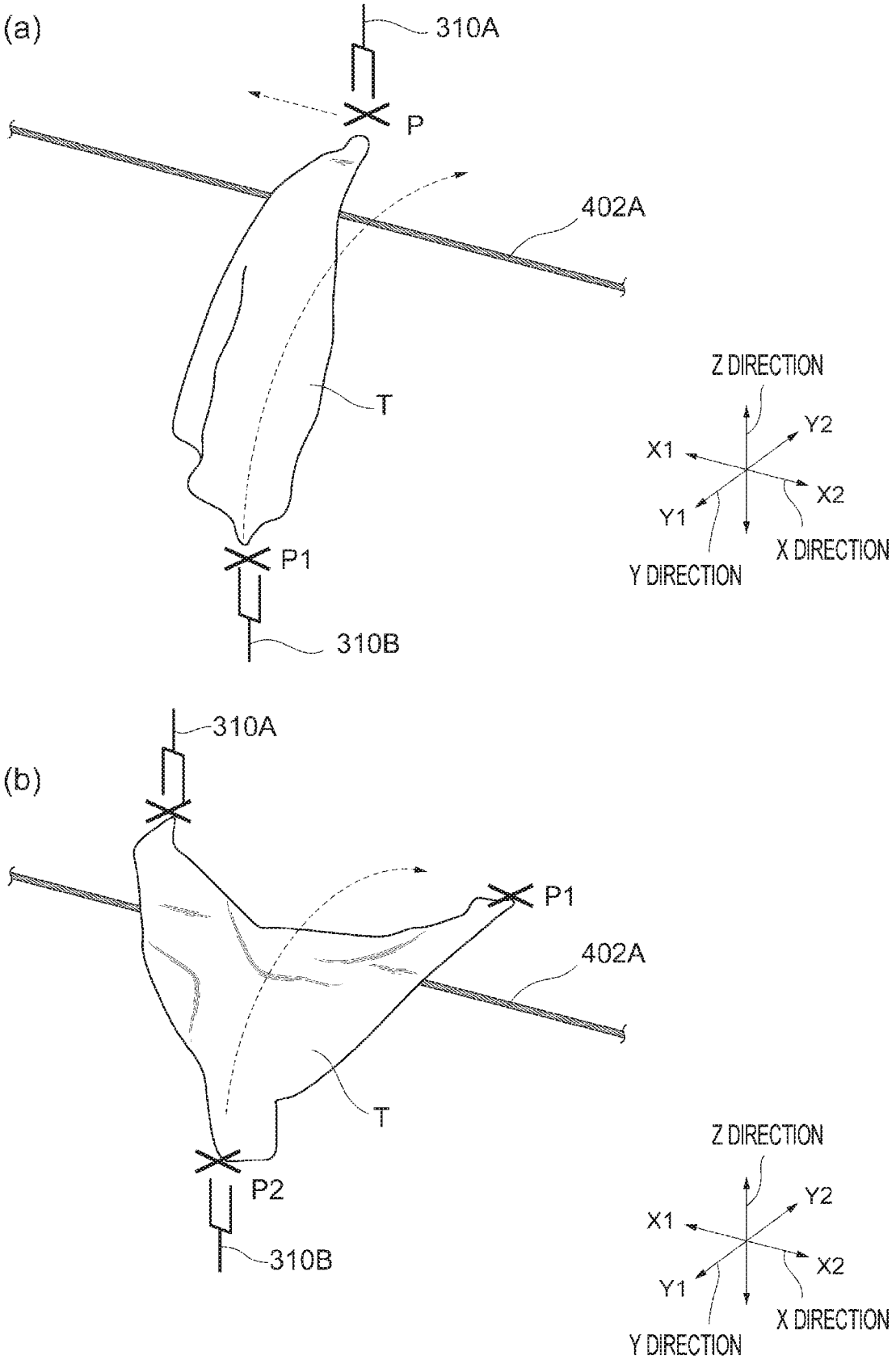
FIG. 48 is a view illustrating processing operation performed using a carrying body according to modified example (X).
Figure 49:
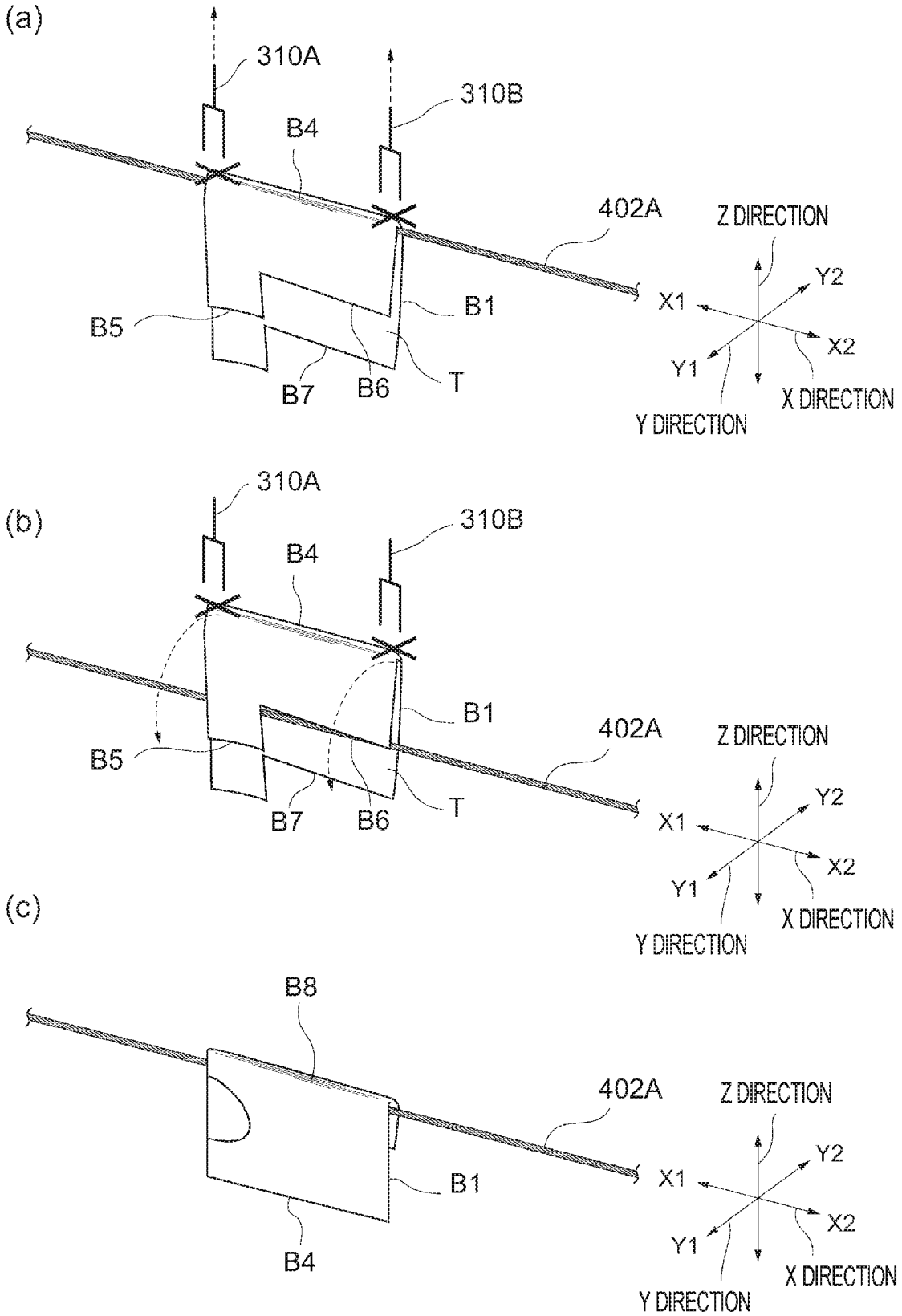
FIG. 49 is a view illustrating the processing operation performed using the carrying body according to modified example (X).

As shown in FIGS. 48 and 49, for example, a carrying body 402A constituted by a single string may be used as the carrying body. As shown in these drawings, the carrying body 402A is suspended in the width direction (the direction of the arrow X) of the processing apparatus 1 by the carrying device (not shown), and retained thereby so as to be capable of moving in the up-down direction (the direction of the arrow Z) and the front-rear direction (the direction of the arrow Y). The carrying body 402A can be used to perform the recognition processing, the folding processing, and so on in place of the carrying plate 402.

FIGS. 48(*a*) and 48(*b*) are views showing a part of the recognition process performed using the carrying body 402A. As shown in these drawings, by bringing the processing subject T and the carrying body 402A into contact with each other along a straight line, the recognition processing can be performed by means of a substantially identical operation to the process using the carrying plate 402, shown in FIGS. 18(*h*) and 18(*i*) (in which the processing subject T and the side edge of the carrying plate 402 likewise come into contact with each other along a straight line). With the carrying body 402A, different advantages to those obtained by using the carrying plate 402 can be obtained. Specifically, the carrying body 402A is a single string retained at respective ends thereof by the carrying device so as to be suspended, and therefore the string can be relaxed by loosening the hold exerted thereon by the carrying device. Accordingly, for example, the position of the entire processing subject T carried thereon can be lowered, and as a result, the lowermost point of the processing subject T can be shifted.

FIGS. 49(*a*) to 49(*c*) are views showing a part of the folding process performed using the carrying body 402A. In the carrying body 402A constituted by a single string, a "plane" such as that of the carrying plate 402 does not exist, and therefore the processing subject T must be folded in a different manner to the folding process (the process illustrated in FIG. 22(*t*), for example) using the "plane" of the carrying plate 402, as described in the above embodiment. For example, the processing subject T may be folded as follows.

FIG. 49(*a*) shows a process performed after the T-shirt T has been folded in two along the first fold line B1 (this process is similar to the process shown in FIG. 21(*p*)). The retaining mechanisms 310A, 310B retain the processing subject T on the carrying body 402A so that a third fold line B4 of the processing subject T is positioned on the carrying body 402A. Here, the third fold line B4 is positioned further toward the center of the T-shirt T than the first fold line B2 and the second fold line B3 (see FIG. 21(*q*)) described in the above embodiment. As shown in FIG. 49(*a*), the third fold line is positioned such that when the processing subject T hangs down over the carrying body 402A, an end edge B5 of one sleeve of the T-shirt T and a second end edge B7 of a midriff portion of the T-shirt T are substantially aligned.

Next, as shown in FIG. 49(*b*), the retaining mechanisms 310A, 310B lift up the processing subject T such that a first end edge of the midriff portion of the T-shirt T and the carrying body 402A are at substantially equal heights while continuing to retain the processing subject T by the third fold line B4. Simultaneously at this time, the retaining mechanisms 310A, 310B and/or the carrying body 402A are moved in the front-rear direction (the direction of the arrow Y) until the carrying body 402A is positioned on the front side (the direction of the arrow Y1) of the processing subject T. At this stage, the retaining mechanisms 310A, 310B are moved downward in the front side direction of the carrying body 402A. As a result, one of the sleeves is caught on the carrying body 402A such that a fourth fold line B8 is formed in the processing subject T (FIG. 49(*c*)). Hence, the processing subject T can be folded likewise with the carrying body 402A constituted by a single string.

The processing following the folding process described above may be executed in a similar manner to the above embodiment. More specifically, the carrying body 402A is moved away from the clamping device 700 while the processing subject T remains clamped by the clamping device 700, whereupon the transportation processing is performed. Note that since the carrying body 402A is a string, a following method may be used to move the carrying body 402A away instead of moving the carrying body 402A and the clamping device 700 relative to each other. Specifically, by attaching a first end of the carrying body 402A, which is constituted by a single string, detachably to the carrying device, and once folding is complete, pulling a second end of the carrying body 402A after detaching the first end from the carrying device, the carrying body 402A can be "withdrawn" from the clamping device 700 (whereupon the first end of the withdrawn carrying body 402A is attached to the carrying device again). Note that in the processing following the folding process described above, the clamping device 700 does not have to be used. More specifically, the carrying body 402A may be "withdrawn" from the processing subject T in the manner described above while the respective ends of the processing subject T are retained by the retaining mechanisms 310A, 310B, and then the processing subject T may be transported directly to the processing subject reception box R by the retaining mechanisms 310A, 310B.

(Y) There are also no particular limitations on the arrangements and so on of the respective members of the processing apparatus 1, and various arrangements and structures may be employed within a scope that does not depart from the spirit of the present invention. For example, a processing apparatus 1A shown schematically in FIGS. 50(*a*) and 50(*b*) includes an insertion portion H1, an unprocessed item storage portion H2, and a processed item storage portion H3, and is configured such that the user can insert and extract the processing subject T in different positions.

Figure 50:
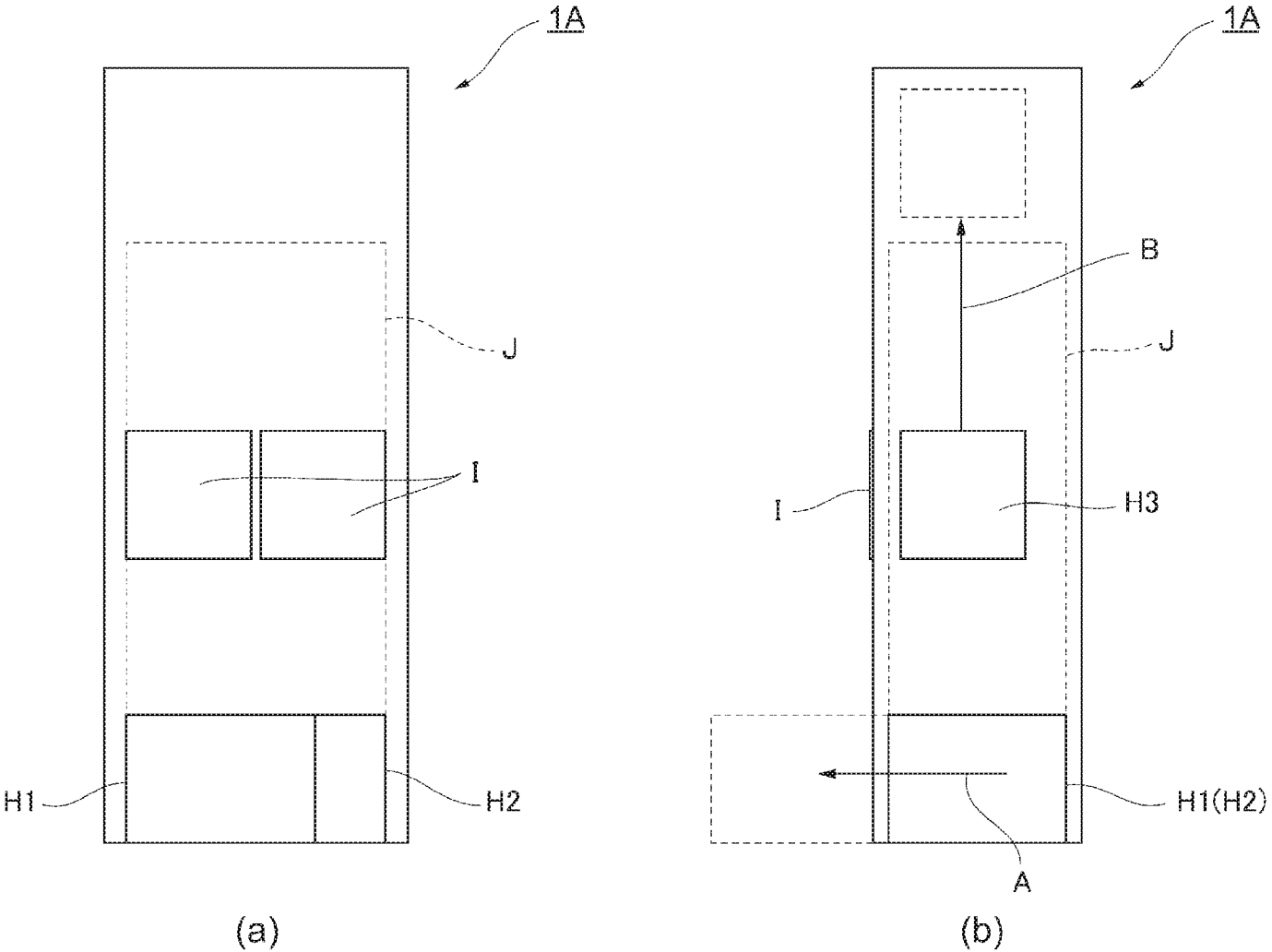
FIG. 50(*a*) is a schematic front view showing a processing apparatus 1A according to modified example (Z), and FIG. 50(*b*) is a side view thereof.

The insertion portion H1 is a sliding door-type box-shaped member disposed in a lowermost portion of the processing apparatus 1A, and as shown by an arrow A in FIG. 50(*b*), is configured to slide frontward from the processing apparatus 1A so that a processing subject can be inserted therein. As a result, the user can insert a processing subject into the insertion portion H1 by performing a simple operation to drop the processing subject therein from above.

The unprocessed item storage portion H2 is disposed alongside the insertion portion H1. The unprocessed item storage portion H2 is a dedicated sliding door-type box-shaped member for storing the processing subjects T determined by the control device 900 to be "unrecognizable", "unfoldable", and so on, and is configured to slide frontward. As a result, the user can collect the processing subjects T that have not been folded separately from the folded processing subjects T, which is more convenient for the user.

The processed item storage portion H3 is a box-shaped member disposed above the insertion portion H1, in which the folded processing subject T are stored. As shown by an arrow B in FIG. 50(*b*), the processed item storage portion H3 is removed to the uppermost portion of the processing apparatus 1A during the processes for recognizing and folding the processing subject T so as to avoid a movable area J of a folding unit (the retaining devices 300A, 300B, the carrying device 400, the clamping device 700, and so on) of the processing apparatus 1A. During the transportation process following the process for folding the processing subject T, the processed item storage portion H3 is lowered to the vicinity of the center of the processing apparatus 1A, and the folded processing subject T is stored therein. Hence, the user can access the processed item storage portion H3 by opening an extraction door I provided in front of the processed item storage portion H3. At this time, the processed item storage portion H3 is positioned near the center of the processing apparatus 1A, and therefore the user can extract the folded processing subject T easily without bending down or the like. Note that the processed item storage portion H3 may be constituted by a plurality of box-shaped members, or may be divided into a plurality of partitioned spaces by providing a plurality of partitions or the like therein. In this case, the processing subjects T can be stored separately in accordance with the types and properties thereof. In so doing, the processing subjects T are less likely to lose their shape and so on than in a case where processing subjects T of different types are stacked in a single space, and the processing subjects T do not have to be sorted after being removed from the processing apparatus 1A. As a result, convenience of the user can be improved even further.

REFERENCE SIGNS LIST

1, 1A Processing apparatus
100 Frame
102 Frame piece
104 Frame base
105 Lateral frame piece
106A Front surface
106B Back surface
106C Right side surface
106D Left side surface
200 Reception transportation device
202 Door
204 Transportation conveyor
204A First conveyor
204B Second conveyor
206 Barrier member
210 Door main body
212 Door shaft
214 Door shaft retaining member
216 Door opening/closing motor
218 Door opening/closing motor power transmitting means
220 Processing subject reception member
222 Barrier member
224 Drive side pulley
226 Driven side pulley
228 Belt
230 Side surface plate
232 Bottom surface plate
234 Back surface plate
236 Support member
238 Support frame
240 Roller
242 Conveyor belt
244 Conveyor drive motor
246 Conveyor drive motor power transmitting means
248 Drive side pulley
250 Driven side pulley
252 Belt
260 Auxiliary reception member
300 Retaining device
310 Retaining mechanism
320 Moving mechanism
322 Finger member
324 Linear actuator
326 Rotary actuator
328 Gripping member
330 Connecting plate
332 Width direction moving mechanism
334 Up-down direction moving mechanism

336 Front-rear direction moving mechanism
338 Width direction moving motor
340 Linear guide
344 Up-down moving plate
346 Elevating unit
348 Frame body
350 Up-down direction drive motor
352 Ball screw
354 Nut
356 Slide guide
358 Front-rear direction drive motor
360 Linear guide
362 LM guide
364 Slider
400 Carrying device
402 Carrying plate
402A Carrying body
404 Frame body
406 Rotation mechanism
408 Front-rear direction moving mechanism
409 Processing subject sensor
410 Carrying plate main body
412 Rotary shaft
414 Upper side pulley
416 Moving plate
418 Hollow member
419 Strut
420 Bracket
422 Rotation motor
424 Lower side pulley
426 Upper side pulley
428 Belt
430 Turntable
432 Lower side pulley retaining member
434 Connecting member
436 Front-rear direction drive motor
438 Linear guide
440 Bracket
500 Imaging device
502 First imaging unit
504 Second imaging unit
700 Clamping device
702 Upper side clamping plate
704 Lower side clamping plate
706 Upper side clamping plate rotary shaft
708 Lower side clamping plate rotary shaft
710 Upper side bearing
712 Lower side bearing
714 Clamping plate rotation motor
716 Driving force transmitting means
718 Drive side pulley
720 Driven side pulley
722 Belt
724 Interlocking means
726 First gear
728 Second gear
730 Slit
800 Transportation device
802 Support
804 Support rotation mechanism (rotation mechanism)
806 Support up-down moving mechanism
808 Support member
810 Support shaft
812 Frame
814 Rotation motor
816 Ball screw
817 Nut
818 Up-down moving motor
820 Driving force transmitting means
822 Drive side pulley
824 Driven side pulley
826 Interlocking pulley
828 Drive belt
830 Interlocking belt
832 Reception portion
834 Curved portion
900 Control device
902 Reception transportation device control unit
904 Retaining device control unit
906 Carrying device control unit
908 Imaging device control unit
910 Clamping device control unit
912 Transportation device control unit
914 Type recognition unit
915 Length detection unit
916 Hanging length detection unit
920 First point detection unit
922 First end point detection unit
924 Second end point detection unit
926 Third end point detection unit
928 Fourth end point detection unit
930 Fifth end point detection unit
932 Sixth end point detection unit
934 Seventh end point detection unit
936 Eighth end point detection unit
T Processing subject
O Opening portion
R, R1, R2, R Processing subject reception box
S Slit
B1 Lateral fold line
B2 First fold line
B3 Second fold line
B4 Third fold line
B5 First sleeve end edge
B6 First midriff portion end edge
B7 Second midriff portion end edge
B8 Fourth fold line
C1 First edge line (of carrying plate)
C2 Second edge line (of carrying plate)
D1 First end part (of processing subject)
D2 Central part (of processing subject)
D3 Second end part (of processing subject)
H1 Insertion portion
H2 Unprocessed item storage portion
H3 Processed item storage portion
I Extraction door
J Folding unit movable area

What is claimed is:

1. A processing apparatus for unfurling or folding a processing subject, comprising:

a pair of retaining devices capable of retaining the processing subject;

a carrying device capable of carrying the processing subject such that a part of the processing subject hangs down therefrom while the processing subject is retained by at least one of the pair of retaining devices; and a control device that controls movement of the retaining devices and the carrying device, wherein the control device rotates the carrying device in a condition where the processing subject retained by at least one of the retaining devices hangs down from the carrying device, wherein, in a condition where the processing subject retained by at least one of the retaining devices hangs down from the carrying device, the control device tilts the carrying device at a predetermined angle relative to a vertical direction of the processing apparatus during unfurling the processing subject.

2. The processing apparatus according to claim 1, wherein, in a condition where the processing subject is retained by a first retaining device of the pair of retaining devices so as to hang down from the carrying device, the control device causes a second retaining device of the pair of retaining devices to retain a lowermost point of the processing subject by moving the second retaining device below the processing subject.

3. The processing apparatus according to claim 1, wherein, when the retaining devices move above the carrying device while lifting up the processing subject, the control device brings a part of the carrying device into contact with the processing subject either by moving the carrying device in a horizontal direction toward the retaining devices or by rotating the carrying device.

4. The processing apparatus according to claim 1, wherein the carrying device is a rectangular plate-shaped member, and the control device tilts the carrying device relative to the horizontal direction, and then places the processing subject, which is retained by both of the pair of retaining devices, on an edge line of the carrying device.

5. The processing apparatus according to claim 1, further comprising a pair of clamping members that move relative to the carrying device in order to clamp the carrying device carrying the processing subject.

6. The processing apparatus according to claim 5, wherein the clamping members clamp the carrying device such that the part of the processing subject that hangs down from the carrying device is folded toward the carrying device.

7. The processing apparatus according to claim 1, further comprising an imaging device that photographs the processing subject while the processing subject is retained by the retaining devices, wherein the control device controls the movement of the retaining devices and the carrying device on the basis of image data obtained from the imaging device in relation to the processing subject.

8. The processing apparatus according to claim 7, wherein the control device includes:

an end point detection unit that detects a lowermost point of the processing subject on the basis of the image data obtained from the imaging device in relation to the processing subject; and a retaining device control unit that causes a first retaining device of the pair of retaining devices to retain the processing subject, and in this condition moves a second retaining device of the pair of retaining devices toward the processing subject and causes the second retaining device to retain the lowermost point.

9. The processing apparatus according to claim 7, wherein the control device includes a type recognition unit that recognizes a type of the processing subject on the basis of the image data obtained from the imaging device in relation to the processing subject.

10. A processing apparatus for unfurling or folding a processing subject, comprising:

a pair of retaining devices capable of retaining the processing subject;

a carrying device capable of carrying the processing subject such that a part of the processing subject hangs down therefrom while the processing subject is retained by at least one of the pair of retaining devices, wherein the carrying device is tilted at a predetermined angle relative to a vertical direction during unfurling the processing subject; and a control device that controls movement of the retaining devices and the carrying device, wherein, in a condition where the processing subject retained by at least one of the retaining devices hangs down from the carrying device, the control device moves the retaining devices in a horizontal direction relative to the carrying device or moves the carrying device in the horizontal direction relative to the retaining devices such that a lowermost point of the processing subject is within a detection range of an end point detection unit that detects a predetermined end point of the processing subject when the lowermost point of the processing subject is not within the detection range.

11. A processing apparatus for unfurling or folding a processing subject, comprising:

a pair of retaining devices capable of retaining the processing subject;

a carrying device capable of carrying the processing subject such that the processing subject hangs down therefrom while the processing subject is retained by at least one of the pair of retaining devices; and a control device that controls movement of the retaining devices and the carrying device, wherein the carrying device includes a rotary axis in approximate horizontal direction, wherein the processing subject is hanged down from a first side to a second side such that the processing subject is crossed to the rotary axis, wherein the control device rotates the carrying device in a condition where the processing subject retained by at least one of the retaining devices hangs down from the carrying device such that a part of the processing subject remaining on the second side is hoisted up and moved so that the entire processing subject including the part is moved to the first side.

* * * * *